US011905607B2

(12) United States Patent
She et al.

(10) Patent No.: US 11,905,607 B2
(45) Date of Patent: Feb. 20, 2024

(54) PURE-$H_2O$-FED ELECTROCATALYTIC $CO_2$ REDUCTION TO $C_2H_4$ BEYOND 1000-HOUR STABILITY

(71) Applicant: THE HONG KONG POLYTECHNIC UNIVERSITY, Hong Kong (CN)

(72) Inventors: Xiaojie She, Hong Kong (CN); Shu-Ping Lau, Hong Kong (CN)

(73) Assignee: THE HONG KONG POLYTECHNIC UNIVERSITY, Hong Kong (CN)

( * ) Notice: Subject to any disclaimer, the term of this patent is extended or adjusted under 35 U.S.C. 154(b) by 0 days.

(21) Appl. No.: 17/806,102

(22) Filed: Jun. 9, 2022

(65) Prior Publication Data

US 2023/0399759 A1 Dec. 14, 2023

(51) Int. Cl.

| | |
|---|---|
| ***C25B 9/23*** | (2021.01) |
| ***C25B 3/26*** | (2021.01) |
| ***C25B 11/052*** | (2021.01) |
| ***C25B 3/03*** | (2021.01) |
| ***C25B 3/07*** | (2021.01) |
| ***C25B 9/77*** | (2021.01) |
| ***C25B 11/056*** | (2021.01) |
| ***C25B 11/069*** | (2021.01) |
| ***C25B 11/075*** | (2021.01) |

(Continued)

(52) U.S. Cl.

CPC ..... *C25B 11/052* (2021.01); *C25B 3/03* (2021.01); *C25B 3/07* (2021.01); *C25B 3/26* (2021.01); *C25B 9/23* (2021.01); *C25B 9/77* (2021.01); *C25B 11/032* (2021.01); *C25B 11/056* (2021.01); *C25B 11/069* (2021.01); *C25B 11/075* (2021.01); *C25B 13/08* (2013.01)

(58) Field of Classification Search

None

See application file for complete search history.

(56) References Cited

U.S. PATENT DOCUMENTS

2019/0127865 A1* 5/2019 Li ..... C25B 3/26
2021/0395908 A1* 12/2021 Kuhl ..... C08J 5/2281

(Continued)

FOREIGN PATENT DOCUMENTS

WO WO-2023004505 A1 * 2/2023

OTHER PUBLICATIONS

Reske et al. J. Am. Chem. Soc. 2014, 136, 6978-6986 (Year: 2014).*

(Continued)

*Primary Examiner* — Wojciech Haske

(74) *Attorney, Agent, or Firm* — S&F/WEHRW

(57) ABSTRACT

The present disclosure provides a pure-$H_2O$-fed membrane-electrode assembly (MEA) electrolysis system for electrocatalytic $CO_2$ reduction ($ECO_2R$) to ethylene ($C_2H_4$) and $C_{2+}$ compounds under an industrial applicable continuous flow condition with at least 1000-hour lifetime, and fabrication method thereof.

20 Claims, 31 Drawing Sheets
(31 of 31 Drawing Sheet(s) Filed in Color)

(51) Int. Cl.
*C25B 13/08* (2006.01)
*C25B 11/032* (2021.01)

(56) References Cited

U.S. PATENT DOCUMENTS

2022/0205119 A1* 6/2022 Huang ..... C25B 11/075
2022/0243348 A1* 8/2022 Bekkedahl ..... C25B 1/04

OTHER PUBLICATIONS

Varcoe et al. Energy Environ. Sci., 2014, 7, 3135 (Year: 2014).*
T. T. Zhuang, Z. Q. Liang, A. Seifitokaldani, Y. Li, P. De Luna, T. Burdyny, F. L. Che, F. Meng, Y. M. Min, R. Quintero-Bermudez, C. T. Dinh, Y. J. Pang, M. Zhong, B. Zhang, J. Li, P. N. Chen, X. L. Zheng, H. Y. Liang, W. N. Ge, B. J. Ye, D. Sinton, S. H. Yu, E. H. Sargent, Steering post-C-C coupling selectivity enables high efficiency electroreduction of carbon dioxide to multi-carbon alcohols. Nat. Catal. 1, 421-428 (2018). doi: 10.1038/s41929-018-0084-7.
S. C. Ma, M. Sadakiyo, R. Luo, M. Heima, M. Yamauchi, P. J. A. Kenis, One-step electrosynthesis of ethylene and ethanol from CO2 in an alkaline electrolyzer. J. Power Sources 301, 219-228 (2016). doi: 10.1016/j.ipowsour.2015.09.124.
T. T. H. Hoang, S. C. Ma, J. I. Gold, P. J. A. Kenis, A. A. Gewirth, Nanoporous copper films by additive-controlled electrodeposition: CO2 reduction catalysis. ACS Catal. 7, 3313-3321 (2017). doi: 10.1021/acscatal.6b03613.
D. H. Nam, O. S. Bushuyev, J. Li, P. De Luna, A. Seifitokaldani, C. T. Dinh, F. P. García de Arquer, Y. H. Wang, Z. Q. Liang, A. H. Proppe, C. S. Tan, P. Todorović, O. Shekhah, C. M. Gabardo, J. W. Jo, J. M. Choi, M. J. Choi, S. W. Baek, J. Kim, D. Sinton, S. O. Kelley, M. Eddaoudi, E. H. Sargent, Metal-organic frameworks mediate Cu coordination or selective CO2 electroreduction. J. Am. Chem. Soc. 140, 11378-11386 (2018). doi: 10.1021/jacs.8b06407.
J. J. Lv, M. Jouny, W. Luc, W. L. Zhu, J. J. Zhu, F. Jiao, A highly porous copper electrocatalyst for carbon dioxide reduction. Adv. Mater. 30, 1803111 (2018). doi: 10.1002/adma.201803111.
T. T. H. Hoang, S. Verma, S. C. Ma, T. T. Fister, J. Timoshenko, A. I. Frenkel, P. J. A. Kenis, A. A. Gewirth, Nanoporous copper-silver alloys by additive-controlled electrodeposition for the selective electroreduction of CO2 to ethylene and ethanol. J. Am. Chem. Soc. 140, 5791-5797 (2018). doi: 10.1021/jacs.8b01868.
Y. G. C. Li, Z. Y. Wang, T. G. Yuan, D. H. Nam, M. C. Luo, J. Wicks, B. Chen, J. Li, F. W. Li, F. P. García de Arquer, Y. Wang, C. T. Dinh, O. Voznyy, D. Sinton, E. H. Sargent, Binding site diversity promotes CO2 electroreduction to ethanol. J. Am. Chem. Soc. 141, 8584-8591 (2019). doi: 10.1021/jacs.9b02945.
C. T. Dinh, T. Burdyny, M. G. Kibria, A. Seifitokaldani, C. M. Gabardo, F. P. García de Arquer, A. Kiani, J. P. Edwards, P. De Luna, O. S. Bushuyev, C. Q. Zou, R. Q. Bermudez, Y. J. Pang, D. Sinton, E. H. Sargent, CO2 electroreduction to ethylene via hydroxide-mediated copper catalysis at an abrupt interface. Science 360, 783-787 (2018). doi:10.1126/science.aas9100.
N. Martić, C. Reller, C. Macauley, M. Löffler, B. Schmid, D. Reinisch, E. Volkova, A. Maltenberger, A. Rucki, K. J. J. Mayrhofer, G. Schmid, Paramelaconite-enriched copper-based material as an efficient and robust catalyst for electrochemical carbon dioxide reduction. Adv. Energy Mater. 9, 1901228 (2019). doi: 10.1002/aenm.201901228.
D. Anastasiadou, M. Schellekens, M. de Heer, S. Verma, E. Negro, Electrodeposited Cu2O films on gas diffusion layers for selective CO2 electroreduction to ethylene in an alkaline flow electrolyzer. ChemElectroChem 6, 3928-3932 (2019). doi: 10.1002/celc.201900971.
W. C. Ma, S. J. Xie, T. T. Liu, Q. Y. Fan, J. Y. Ye, F. F. Sun, Z. Jiang, Q. H. Zhang, J. Cheng, Y. Wang, Electrocatalytic reduction of CO2 to ethylene and ethanol through hydrogen-assisted C-C coupling over fluorine-modified copper. Nat. Catal. 3, 478-487 (2020). doi: 10.1038/s41929-020-0450-0.
M. Zhong, K. Tran, Y. M. Min, C. H. Wang, Z. Y. Wang, C. T. Dinh, P. De Luna, Z. Q. Yu, A. S. Rasouli, P. Brodersen, S. Sun, O. Voznyy, C. S. Tan, M. Askerka, F. L. Che, M. Liu, A. Seifitokaldani, Y. J. Pang, S. C. Lo, A. Ip, Z. Ulissi, E. H. Sargent, Accelerated discovery of CO2 electrocatalysts using active machine learning. Nature 581, 178-183 (2020). doi: 10.1038/s41586-020-2242-8.
M. G. Kibria, C. T. Dinh, A. Seifitokaldani, P. De Luna, T. Burdyny, R. Quintero-Bermudez, M. B. Ross, O. S. Bushuyev, F. P. García de Arquer, P. D. Yang, D. Sinton, E. H. Sargent, A surface reconstruction route to high productivity and selectivity in CO2 electroreduction toward C2+ hydrocarbons. Adv. Mater. 30, 1804867 (2018). doi: 10.1002/adma.201804867.
F. W. Li, A. Thevenon, A. R. Hernández, Z. Y. Wang, Y. L. Li, C. M. Gabardo, A. Ozden, C. T. Dinh, J. Li, Y. H. Wang, J. P. Edwards, Y. Xu, C. McCallum, L. Z. Tao, Z. Q. Liang, M. C. Luo, X. Wang, H. H. Li, C. P. O'Brien, C. S. Tan, D. H. Nam, R. Q. Bermudez, T. T. Zhuang, Y. G. C. Li, Z. J. Han, R. D. Britt, D. Sinton, T. Agapie, J. C. Peters, E. H. Sargent, Molecular tuning of CO2-to-ethylene conversion. Nature 577, 509-513 (2020). doi: 10.1038/s41586-019-1782-2.
F. P. García de Arquer, C. T. Dinh, A. Ozden, J. Wicks, C. McCallum, A. R. Kirmani, D. H. Nam, C. Gabardo, A. Seifitokaldani, X. Wang, Y. C. Li, F. Li, J. Edwards, L. J. Richter, S. J. Thorpe, D. Sinton, E. H. Sargent, CO2 electrolysis to multicarbon products at activities greater than 1 A cm-2. Science 367, 661-666 (2020). doi:10.1126/science.aay4217.
Y. H. Wang, Z. Y. Wang, C. T. Dinh, J. Li, A. Ozden, M. G. Kibria, A. Seifitokaldani, C. S. Tan, C. M. Gabardo, M. C. Luo, H. Zhou, F. W. Li, Y. W. Lum, C. McCallum, Y. Xu, M. X. Liu, A. Proppe, A. Johnston, P. Todorovic, T. T. Zhuang, D. Sinton, S. O. Kelley, E. H. Sargent, Catalyst synthesis under CO2 electroreduction favours faceting and promotes renewable fuels electrosynthesis. Nat. Catal. 3, 98-106 (2020). doi: 10.1038/s41929-019-0397-1.
X. Y. Chen, J. F. Chen, N. M. Alghoraibi, D. A. Henckel, R. X. Zhang, U. O. Nwabara, K. E. Madsen, P. J. A. Kenis, S. C. Zimmerman, A. A. Gewirth, Electrochemical CO2-to-ethylene conversion on polyamine-incorporated Cu electrodes. Nat. Catal. 4, 20-27 (2021). doi: 10.1038/s41929-020-00547-0.
K. J. She, T. Y. Zhang, Z. Y. Li, H. M. Li, H. Xu, J. J. Wu, Tandem electrodes for carbon dioxide reduction into C2+ products at simultaneously high production efficiency and rate. Cell Rep. Phys. Sci. 1, 100051 (2020). doi: 10.1016/j.xcrp.2020.100051.
J. E. Huang, F. W. Li, A. Ozden, A. S. Rasouli, F. P. G. D. Arquer, S. J. Liu, S. Z. Zhang, M. C. Luo, X. Wang, Y. W. Lum, Y. Xu, K. Bertens, R. K. Miao, C. T. Dinh, D. Sinton, E. H. Sargent, CO2 electrolysis to multicarbon products in strong acid. Science 372, 1074-1078 (2021). doi: 10.1126/science.abg6582.
Fan Lei et al., "Strategies in catalysts and electrolyzer design for electrochemical CO2 reduction toward C2+ products", Science Advances, American Association for the Advancement of Science, US, vol. 6, No. 8 (Feb. 21, 2020) pages eaay3111-1.
Extended European Search Report of application No. 22198699.5 issued from the European Patent Office dated Aug. 31, 2023.

* cited by examiner

PURE-$H_2O$-FED ELECTROCATALYTIC $CO_2$ REDUCTION TO $C_2H_4$ BEYOND 1000-HOUR STABILITY

TECHNICAL FIELD

The present invention relates to a pure-$H_2O$-fed electrolysis system for electrocatalytic $CO_2$ reduction ($ECO_2R$). In particular, the present invention provides a pure-$H_2O$-fed membrane-electrode assembly (MEA) electrolysis system under an industrial applicable continuous flow condition for $ECO_2R$-to-$C_2H_4/C_{2+}$ compounds using a high-performance step-facet-rich Cu (SF-Cu) catalyst to result in a lifetime of over 1000 hours.

BACKGROUND $ECO_2R$ has wide variety of applications, for example, formation of high-value chemicals and feedstocks using renewable electricity, which could decouple the chemical and fuel productions from fossil fuels and thus close the carbon loop, offering possibilities to mitigate greenhouse gas emissions. Optimizing selectivity, i.e., Faradaic efficiency (FE), of catalysts for high-value products such as CO, HCOOH, and $C_2H_4$, increasing their productivity (current density), and lowering overpotentials of the reduction reactions have become priorities and been with some significant advances. However, one of the problems is the system stability. Formation and crossover of carbonate in both alkaline and neutral electrolytes during electrolysis result in additional energy consumption and $CO_2$ losses, lowering the durability of $ECO_2R$.

Another problem is the strong local alkaline conditions present in $ECO_2R$ causes a major fraction of the input $CO_2$ to react with the $OH^-$ to produce $CO_3^{2-}$ rather than being reduced into carbon-based products, lowering the reduction efficiency. Some recent studies showed that regenerating $CO_2$ from $CO_3^{2-}$ requires more than 230 kJ/mol in a calcination system, but the energy stored by that $ECO_2R$ was just 100-130 kJ/mol of electrons, depending on different products, which indicated that the net energy balance in the alkaline/neutral electrolyte was negative.

In principle, since each electron from $ECO_2R$ can consume 1 $OH^-$ equivalent, taking $ECO_2R$ to $C_2H_4$ in the alkaline/neutral electrolyte as an example, forming 1 $C_2H_4$ molecule will produce 12 $OH^-$ that can react with 6 $CO_2$ into 6 $CO_3^{2-}$ (Eq. 1 and 2):

$$\text{Cathode: } 2CO_2+8H_2O+12e^-\rightarrow C_2H_4+12OH^- \quad (1)$$

$$12OH^-+6CO_2\rightarrow 6CO_3^{2-}+6H_2O \quad (2).$$

In theory, a large amount of carbonate would precipitate in the gas diffusion electrode (GDE) and $CO_2$ flow channel of the cell, blocking $CO_2$ transport, accelerating electrolyte flooding and eventually shutting down the $ECO_2R$ reaction, which leads to poor $ECO_2R$ stability. As a result, the theoretically maximum carbon efficiency of $ECO_2R$-to-$C_2H_4$ is 25% and it is even far lower than this theoretical limit in the actual electrolysis process where the cathodic catalyst is less efficient or the strong alkaline electrolyte is involved. So far, the stability of $ECO_2R$-to-$C_2H_4$ in the conventional flow cell or membrane-electrode-assembly (MEA) cell with the alkaline/neutral electrolyte is generally less than 200 hours.

In an anion-transporting cell assembled with the anion exchange membrane (AEM), $CO_3^{2-}$ formed at the cathode will be transported to the anode to be protonated and release $CO_2$ and $OH^-$. This process can consume up to ~70% of the energy input for the $ECO_2R$ reaction. Therefore, the conventional electrolysis system of $ECO_2R$ needs to be operated in strong acid (pH<1) in a flow cell to eliminate the carbonate formation and crossover at the expense of a portion of $ECO_2R$ products. However, this acidic-electrolysis system cannot satisfy the MEA configuration, for example, as shown in FIGS. 1A and 1B.

A need therefore exists for an improve MEA cell system that eliminates or at least diminishes the disadvantages and problems described above.

SUMMARY OF INVENTION

Accordingly, the present disclosure provides a pure-$H_2O$-fed MEA electrolysis system on a high-performance step-facet-rich Cu (SF-Cu) catalyst with fast kinetics for $ECO_2R$-to-$C_2H_4$. The system integrates the AEM and proton exchange membrane (PEM) to selectively transport the electrogenerated $OH^-$ and $H^+$, respectively. The system does not only boost the pure-$H_2O$-fed $ECO_2R$ reaction activity by increasing the local pH on the cathode catalyst surface but also eliminates carbonate formation and crossover, leading to prolonged stability.

An aspect of the present invention provides a pure-$H_2O$-fed membrane-electrode assembly electrolysis system for electrocatalytic $CO_2$ reduction to ethylene and $C_{2+}$ compounds including ethanol, propanol, and acetic acid under an industrial applicable continuous flow condition with at least 1000-hour lifetime, where the system includes one or more membrane-electrode assemblies, and each of the membrane-electrode assemblies include:

- an anode;
- a cathode;
- an anion exchange membrane;
- a proton exchange membrane;
- a step-facet-rich copper catalyst disposed at the cathode; and
- an electrolyte, where:

- the cathode is arranged in contact with the anion exchange membrane;
- the anode is arranged in contact with the proton exchange membrane;
- the anion exchange membrane and proton exchange membrane are arranged in contact with each other;
- the electrolyte is selected from pure $H_2O$ as proton source for the electrocatalytic $CO_2$ reduction at the cathode under a forward bias mode of the system;
- the anion exchange membrane is selected from alkaline anion exchange membrane or bipolar membrane; and
- the proton exchange membrane is selected from acidic proton exchange membrane or bipolar membrane.

In certain embodiments, the cathode is selected from a gas diffusion electrode deposited with at least a layer of the step-facet-rich copper catalyst.

Preferably, the cathode is a carbon paper with a microporous carbon gas diffusion layer coated with the step-facet-rich copper catalyst.

In certain embodiments, the anode is selected from titanium fiber felt supported by one or more of platinum, iridium, ruthenium, and palladium, and any oxide or alloy thereof.

Preferably, the anode is a titanium fiber felt sputtered by platinum thereon.

In other embodiments, the anode can be a titanium fiber felt sputtered by iridium, ruthenium, and palladium, and any oxide or alloy thereof.

In some other embodiments, the anode can be a carbon paper supported by the one or more of platinum, iridium, ruthenium, and palladium, and any oxide or alloy thereof.

In certain embodiments, the electrocatalytic $CO_2$ reduction is conducted at a temperature of about 60° C. or lower but above room temperature.

Preferably, the electrocatalytic $CO_2$ reduction is conducted at about 60° C.

In certain embodiments, the alkaline anion exchange membrane is an anion exchange membrane made of N-methylimidazolium-functionalized styrene polymer.

Preferably, the alkaline anion exchange membrane is an anion exchange membrane made of N-methylimidazolium-functionalized styrene polymer with a thickness of about 0.002 inches.

In certain embodiments, the acidic proton exchange membrane is a proton exchange membrane made of tetrafluoroethylene-perfluoro-3,6-dioxa-4-methyl-7-octenesulfonic acid copolymer.

Preferably, the acidic proton exchange membrane is a proton exchange membrane made of tetrafluoroethylene-perfluoro-3,6-dioxa-4-methyl-7-octenesulfonic acid copolymer with a thickness of about 0.007 inches and an equivalent weight of about 1100 g/mol.

In certain embodiments, the step-facet-rich copper catalyst has a variable surface atom coordination number from 4 to 9 at either one or both of Cu (111) and Cu (100) exposed facets.

In certain embodiments, the step-facet-rich copper catalyst has a variable surface tensile strain within 10% of an initial tensile strain thereof measured at room temperature.

In certain embodiments, at least six of the membrane-electrode assemblies are stacked together.

In certain embodiments, up to about 50% of Faradaic efficiency towards ethylene with a carbon dioxide-to-ethylene conversion efficiency of about 39% is achieved when a total current of 10 A is supplied across the at least six membrane-electrode assemblies through two conductive substrates sandwiching the stack of the at least six membrane-electrode assemblies with a total geometrical area of 30 $cm^2$.

In other embodiments, the total geometrical area of the one or more of the membrane-electrode assemblies is variable subject to the demand for $CO_2$ reduction, current density, size of the electrolysis cell, conductivity of the electrodes, membranes and substrates thereof, etc.

In some other embodiments, the electrolysis cell includes a stack of multiple membrane-electrode assemblies or a single membrane-electrode assembly with a relatively larger geometrical area, or both.

Preferably, the stack of multiple membrane-electrode assemblies is selected over the single membrane-electrode assembly in an industrial applicable continuous flow condition since the stack configuration is relatively more flexible and easier to be scaled up or down according to the demand for $CO_2$ reduction and compatibility to other equipment in an industrial plant or setting.

Another aspect of the present invention provides a method for fabricating a pure-$H_2O$-fed membrane-electrode assembly electrolysis system for electrocatalytic $CO_2$ reduction to ethylene and $C_2$±compounds including ethanol, propanol, and acetic acid with at least 1000-hour lifetime, where the method includes:

providing a step-facet-rich copper catalyst;

preparing a step-facet-rich copper catalyst-containing ink composition for forming a cathode with the step-facet-rich copper catalyst thereon;

forming the cathode with the step-facet-rich copper catalyst thereon;

preparing an anode-forming mixture for forming an anode;

forming the anode from the anode-forming mixture supporting an anode material; providing an alkaline anion exchange membrane and an acidic proton exchange membrane between said cathode and anode, where the alkaline anion exchange membrane is arranged in contact with the cathode; the acidic proton exchange membrane is arranged in contact with the anode; and the alkaline exchange membrane and acidic proton exchange membrane are in contact with each other, thereby forming a multi-layered structure of the membrane-electrode assembly;

sandwiching one or more of the membrane-electrode assemblies with two conductive substrates;

feeding pure $H_2O$ as an electrolyte into a container containing the one or more of the membrane-electrode assemblies being sandwiched between the conductive substrate; providing a power supply to the one or more of the membrane-electrode assemblies through the two conductive substrates;

maintaining the electrolyte at a temperature sufficient for the electrocatalytic $CO_2$ reduction to ethylene to last for at least 1000 hours with no dominant hydrogen evolution reaction.

In certain embodiments, the step-facet-rich copper catalyst is provided by:

dissolving copper chloride and octadecylamine into squalene at about 80° C. under an argon atmosphere for about 0.5 hours until a copper-based stock solution is formed;

mixing oleylamine and trioctylphosphine under heating the mixture to about 200° C. at the argon atmosphere with vigorous agitation to form a mixture;

injecting the copper-based stock solution into the mixture at about 200° C. and maintained for about 5 hours to form a reaction mixture;

cooling the reaction mixture naturally, centrifuging the cooled reaction mixture, followed by washing with an organic solution for a few times; and removing supernatant after said washing and blow drying pellet with argon gas under room temperature to obtain the step-facet-rich copper catalyst in solid form.

In certain embodiments, at about 1:2 weight ratio of copper chloride to octadecylamine are dissolved in squalene.

In certain embodiments, about 20:1 volume ratio of oleylamine to trioctylphosphine are mixed under heating at 200° C. under argon gas.

In certain embodiments, the organic solution for washing the centrifuged, cooled reaction mixture is n-hexane.

In certain embodiments, the cathode is formed with the step-facet-rich copper catalyst coated thereon by:

dispersing the solid step-facet-rich copper catalyst into a mixed solution containing water, isopropyl alcohol and an alkaline ionomer solution;

mixing the solid step-facet-rich copper catalyst with the mixed solution by sonication for about an hour until the step-facet-rich copper catalyst-containing ink composition is formed;

coating the step-facet-rich copper catalyst-containing ink composition onto a carbon paper with a microporous carbon gas diffusion layer;

drying the coated step-facet-rich copper catalyst-containing ink composition on the carbon paper in vacuum for about an hour.

In certain embodiments, the anode is formed from a titanium fiber felt supported by the anode forming mixture comprising one or more of platinum, iridium, ruthenium, and palladium, and any oxide or alloy thereof.

In certain embodiments, the alkaline anion exchange membrane is selected from an anion exchange membrane made of N-methylimidazolium-functionalized styrene polymer with a thickness of about 0.002 inches; the acidic proton exchange membrane is selected from a proton exchange membrane made of tetrafluoroethylene-perfluoro-3,6-dioxa-4-methyl-7-octenesulfonic acid copolymer with a thickness of about 0.007 inches and equivalent weight of 1100 g/mol.

In certain embodiments, at least six of the membrane-electrode assemblies are stacked with each other and sandwiched between the two conductive substrates; the electrolyte temperature is maintained at about 60° C.

In certain embodiments, the at least six of the membrane-electrode assemblies have a total geometrical area of about 30 $cm^2$.

This summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter. Other aspects of the present invention are disclosed as illustrated by the embodiments hereinafter.

BRIEF DESCRIPTION OF DRAWINGS

The patent or application file contains at least one drawing executed in color. Copies of this patent or patent application publication with color drawing(s) will be provided by the Office upon request and payment of the necessary fee.

The appended drawings, where like reference numerals refer to identical or functionally similar elements, contain figures of certain embodiments to further illustrate and clarify the above and other aspects, advantages and features of the present invention. It will be appreciated that these drawings depict embodiments of the invention and are not intended to limit its scope. The invention will be described and explained with additional specificity and detail through the use of the accompanying drawings in which.

Skilled artisans will appreciate that elements in the figures are illustrated for simplicity and clarity and have not necessarily been depicted to scale.

DETAILED DESCRIPTION OF THE INVENTION

It will be apparent to those skilled in the art that modifications, including additions and/or substitutions, may be made without departing from the scope and spirit of the invention. Specific details may be omitted so as not to obscure the invention; however, the disclosure is written to enable one skilled in the art to practice the teachings herein without undue experimentation.

Figure 1A:
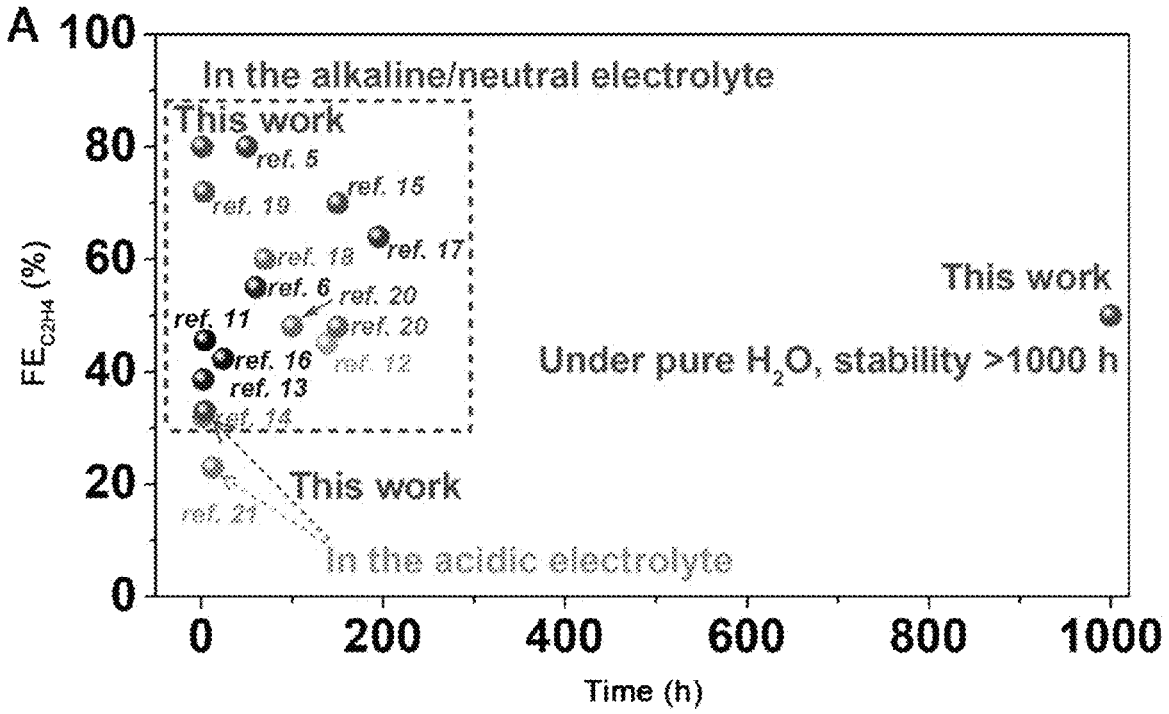
FIG. 1A shows a comparison of the stability of $ECO_2R$-to-$C_2H_4$ on Cu-based catalysts in the flow cell or MEA cell according to certain embodiments of the present invention with that of conventional systems according to certain literatures.
Figure 1B:
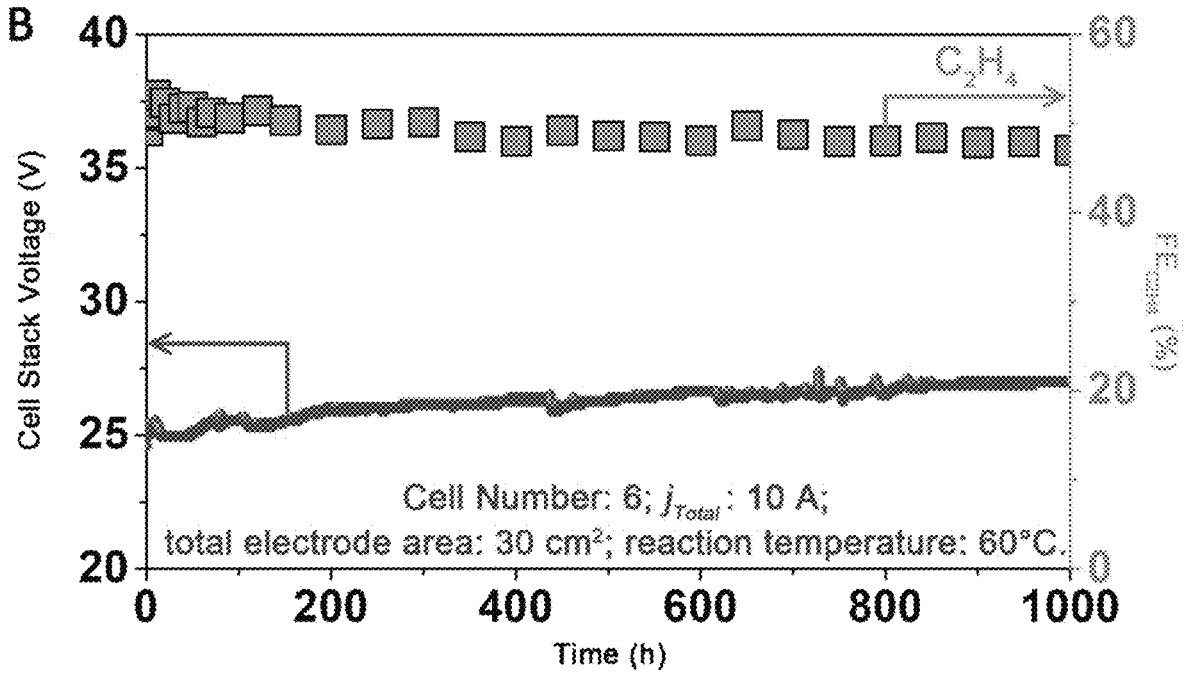
FIG. 1B shows a result of a long-stability performance test on $ECO_2R$-to-$C_2H_4$ on SF-Cu in a pure-$H_2O$-fed MEA-cell stack containing 6 MEA cells at a constant current of 10 A according to certain embodiments of the present invention, where the total cathode electrode area is set to be 30 $cm^2$ and the reaction temperature is set to be 60° C.
Figure 5A:
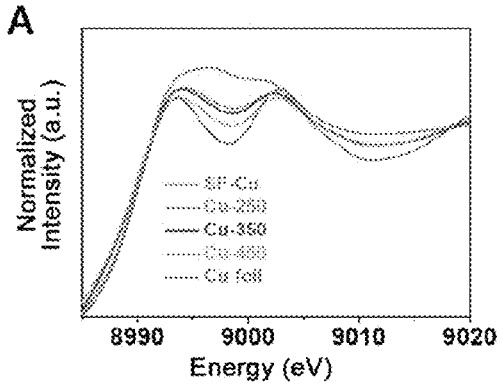
FIG. 5A shows X-ray absorption near edge structure (XANES) spectra of SF-Cu, Cu-250, Cu-350, Cu-450 and the standard Cu foil reference recorded at the Cu K-edge; values are means; error bars indicate SD (n=3 replicates)
Figure 5B:
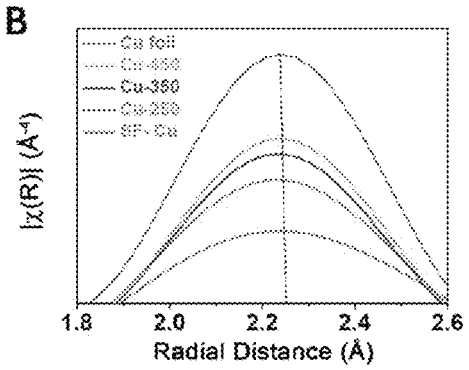
FIG. 5B shows Fourier transform of Cu K-edge EXAFS spectra of SF-Cu, Cu-250, Cu-350, Cu-450 and the standard Cu foil reference; values are means; error bars indicate SD (n=3 replicates)
Figure 5C:
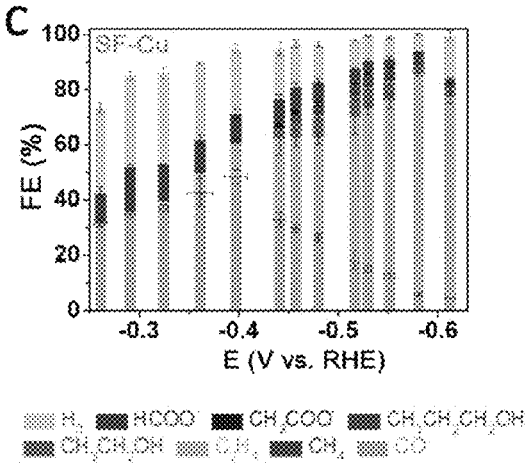
FIG. 5C shows FEs toward $ECO_2R$ products on SF-Cu under a range of applied potentials in a flow cell with 1 M KOH as the electrolyte; values are means; error bars indicate SD (n=3 replicates)
Figure 5D:
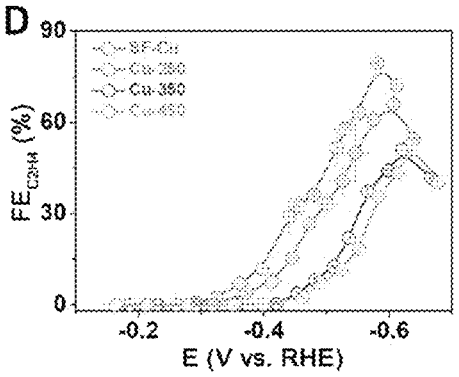
FIG. 5D shows comparisons of FEs toward $C_2H_4$ of SF-Cu, Cu-250, Cu-350 and Cu-450; values are means; error bars indicate SD (n=3 replicates)
Figure 5E:
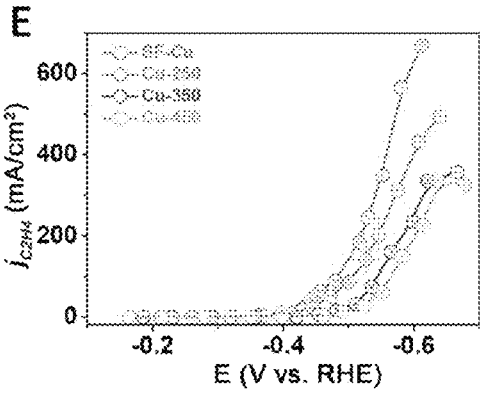
FIG. 5E shows comparisons of partial current densities (J) toward $C_2H_4$ of SF-Cu, Cu-250, Cu-350 and Cu-450; values are means; error bars indicate SD (n=3 replicates)
Figure 5F:
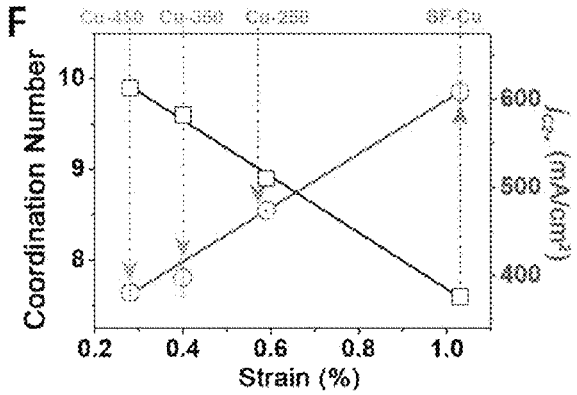
FIG. 5F shows the relationship between the tensile strain, CN and the peak $j_{C2+}$; values are means; error bars indicate SD (n=3 replicates)
Figure 23:
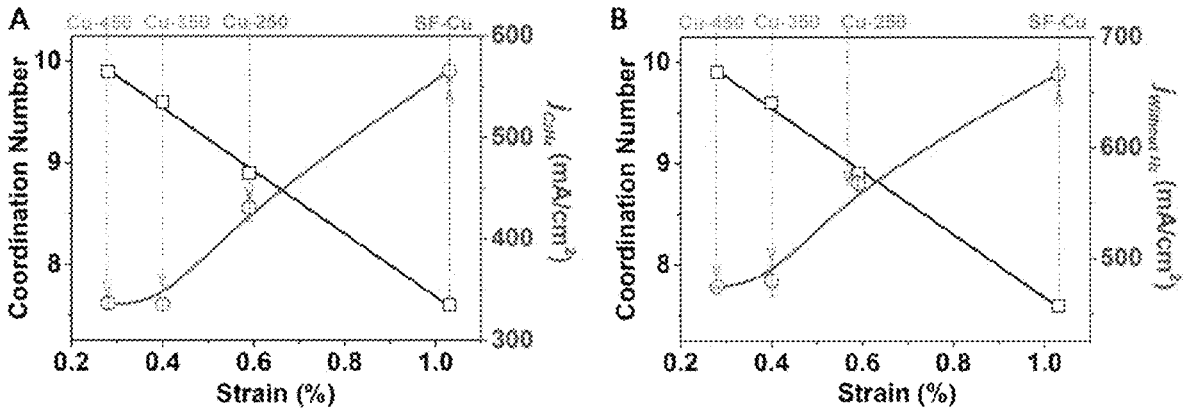
FIG. 23 shows relationships between (A) strain, CN and the peak $j_{C2H4}$; and (B) strain, CN and the $j_{without\ H2}$ for the $ECO_2R$ reaction in a flow cell with 1 M KOH as the electrolyte.
Figure 41:
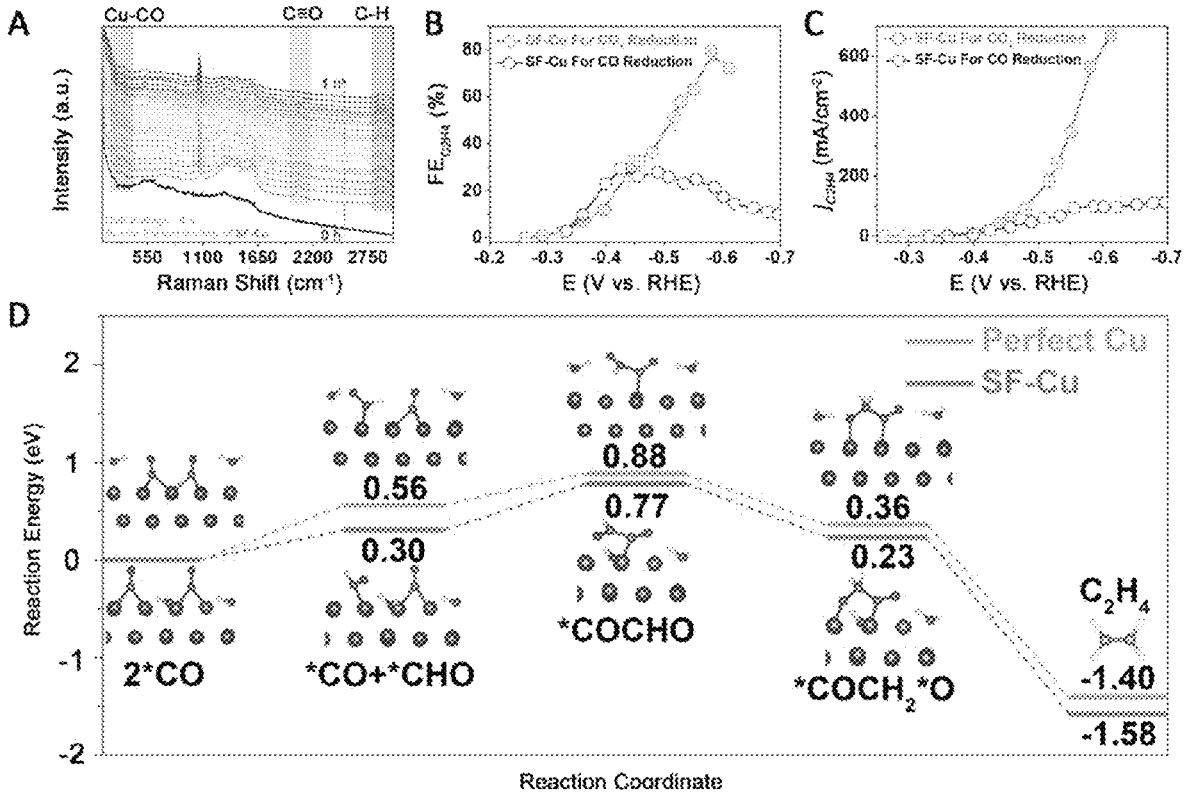
FIG. 41 shows the $ECO_2R$ mechanism and effects of CN and tensile strain on $ECO_2R$ by DFT calculations and experiments: (A) In-situ Raman spectra of $ECO_2R$ on SF-Cu for 1 h in a customized flow cell with a two-electrode system at 4 V cell voltage according to certain embodiments of the present invention; (B) FEs and (C) partial current densities toward $C_2H_4$ on SF-Cu for $ECO_2R$ and ECOR reactions in 1 M KOH under a range of the applied potentials; (D) A reaction energy diagram for the $ECO_2R$ to $C_2H_4$ on the perfect Cu and SF-Cu models via the direct *CO hydrogenation to *CHO followed by the unoccupied *CO and the *CHO dimerization pathway.
Figure 42:
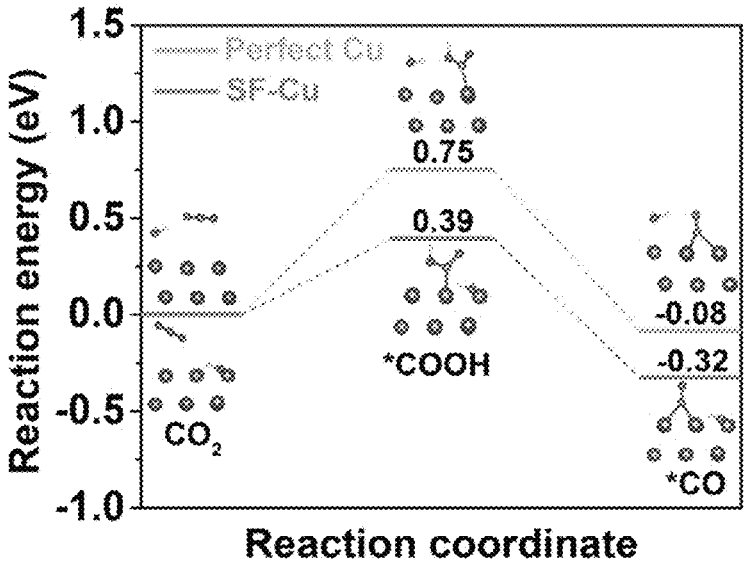
FIG. 42 shows a reaction energy diagram for the $ECO_2R$ into the *CO intermediate on the perfect Cu and SF-Cu models.
Figure 43:
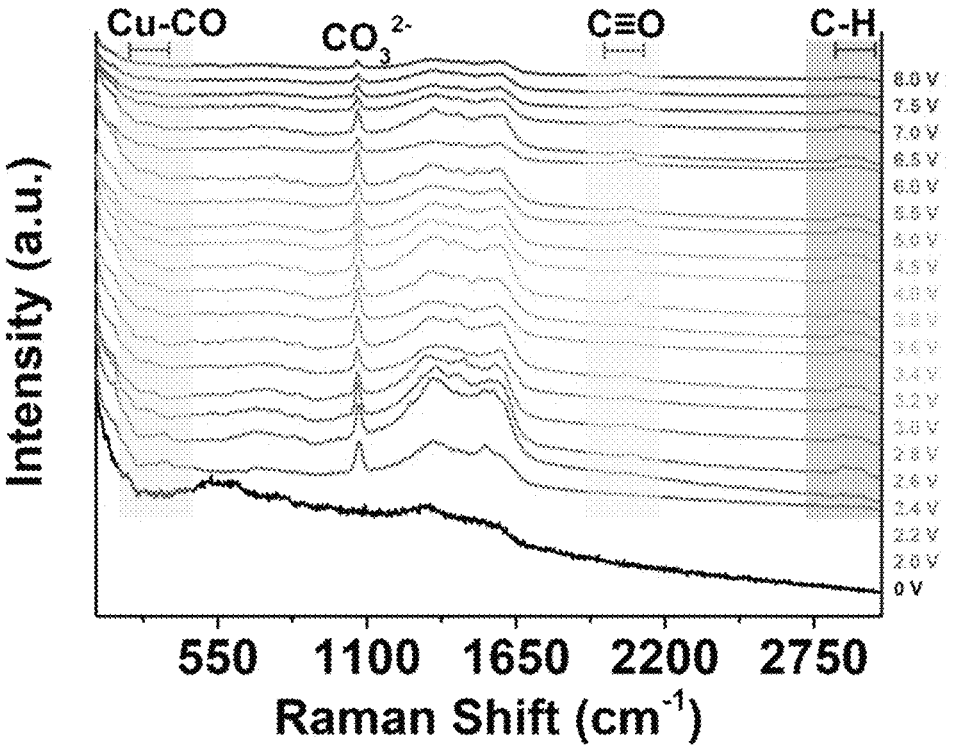
FIG. 43 shows in-situ Raman measurements on SF-Cu for the $ECO_2R$ reaction in 0.1 M KOH at the different cell voltages.
Figure 44:
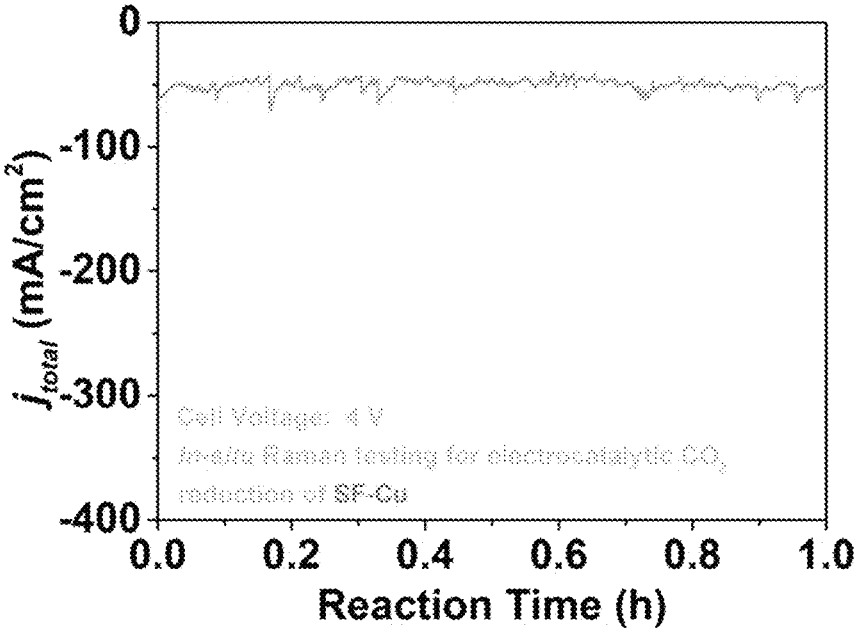
FIG. 44 shows the total current density of the in-situ Raman measurement on SF-Cu for the $ECO_2R$ reaction in a flow cell with 0.1 M KOH at a cell voltage of 4 V.
Figure 45:
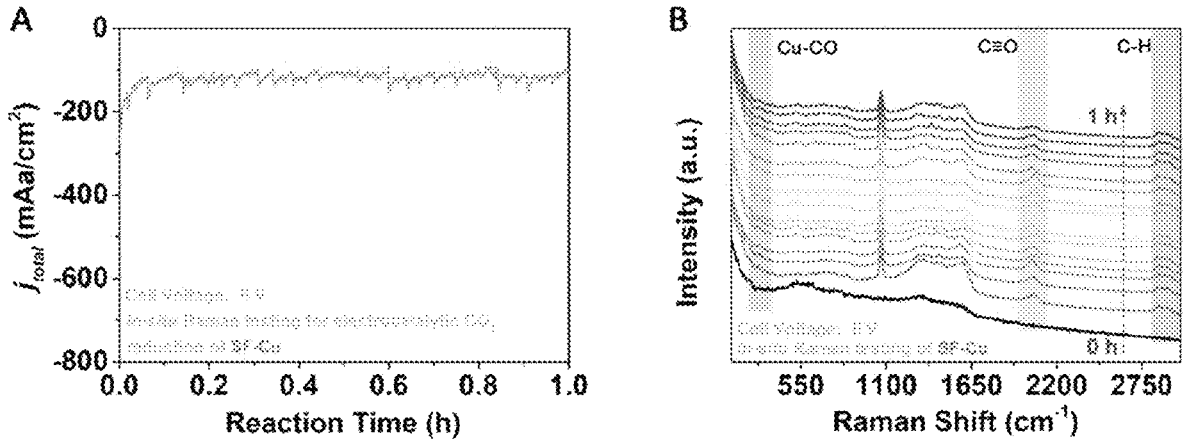
FIG. 45 shows in-situ Raman measurement on SF-Cu for the $ECO_2R$ reaction in a flow cell with 0.1 M KOH at a cell voltage of 6 V: (A) Total current density; (B) In-situ Raman spectra for 1 h.
Figure 46:
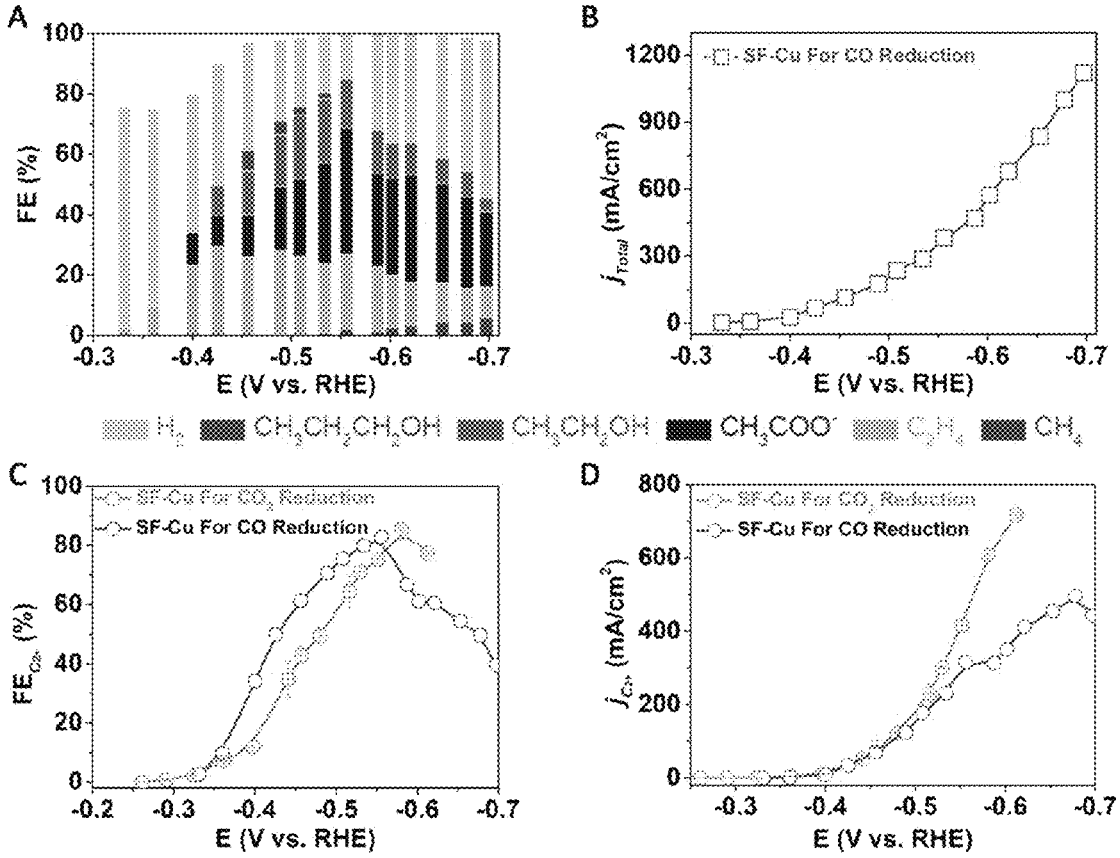
FIG. 46 shows ECOR performance and comparisons with $ECO_2R$ performance on SF-Cu in the flow cell with 1 M KOH as the electrolyte: (A) FEs toward ECOR products under a range of applied potentials; (B) Total current density for ECOR under a range of applied potentials; (C) Comparisons of FEs and (D) partial current densities toward $C_{2+}$ on SF-Cu for $ECO_2R$ and ECOR in 1 M KOH under a range of applied potentials.

Turning to FIGS. 1A and 1B, under the conventional alkaline condition (1 M KOH), the SF-Cu catalyst delivered $ECO_2R$ to $C_2H_4$ with ~80% FE and 568 mA/cm$^2$ partial current density ($j_{C2H4}$) at about ~0.58 V (versus a reversible hydrogen electrode (RHE) throughout the text, unless otherwise noted) in a flow cell. The impressive $ECO_2R$ performance of SF-Cu is explicitly linked with the manipulations of its coordination number (CN) and tensile strain (FIGS. 5F, 23 and 41). To eliminate carbonate formation and crossover in the alkaline electrolyte, the $ECO_2R$ reaction is then carried out in a flow cell with the strong acid as the electrolyte, but the strong-acid system cannot satisfy the industrially more promising MEA-cell architecture. Finally, pure $H_2O$ is used as an electrolyte to perform $ECO_2R$-to-$C_2H_4/C_{2+}$ compounds in an MEA cell assembled with AEM and PEM. Under pure $H_2O$, the SF-Cu catalyst reduces $CO_2$ to $C_2H_4$ with ~42% FE and 300 mA/cm$^2$ total current density at ~4.3 V cell voltage without iR compensation. In addition, the $ECO_2R$ is scaled up in a pure-$H_2O$-fed 6-MEA-cell stack. At a total current of 10 A, the FE of ~50% toward $C_2H_4$ is achieved and the $CO_2$-to-$C_2H_4$ conversion is up to ~39%. This MEA-cell-stack system could be operated stably for over 1000 h, which has outperformed the conventional $ECO_2R$-to-$C_2H_4$ system.

Figure 2A:
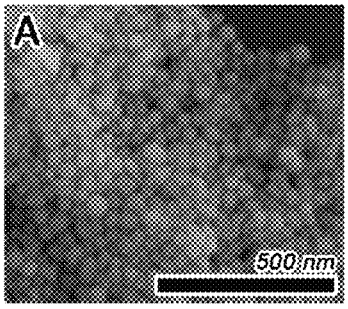
FIG. 2A shows an SEM image of the SF-Cu catalyst according to certain embodiments of the present invention.
Figure 2B:
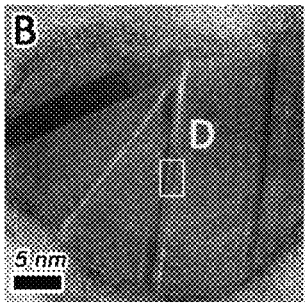
FIG. 2B shows a HRTEM image of the SF-Cu according to certain embodiments of the present invention, revealing abundant stacking faults (yellow rectangular box marked with D)
Figure 2C:
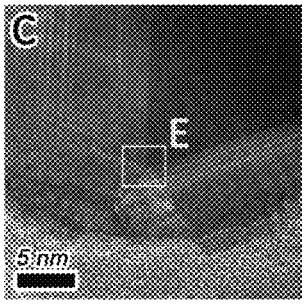
FIG. 2C shows a HRTEM image of the SF-Cu in certain embodiments of the present invention, revealing interlaced grain (twin) boundaries (yellow rectangular box marked with E)
Figure 2D:
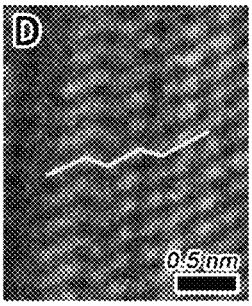
FIG. 2D shows an atomic-resolution HAADF-STEM image of stacking faults from the selected area marked with D in the rectangular box as shown in FIG. 2B; yellow lines highlight stacking faults.
Figure 2E:
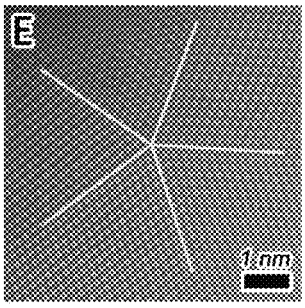
FIG. 2E shows an atomic-resolution HAADF-STEM image of twin boundaries from the selected area marked with E in the rectangular box as shown in FIG. 2C; yellow lines highlight five-fold twin boundaries.
Figure 2F:
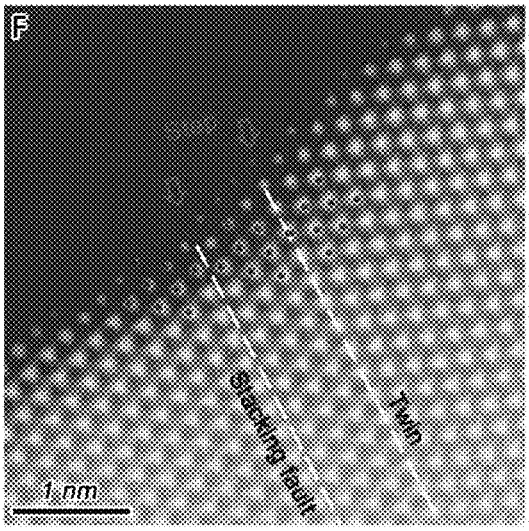
FIG. 2F shows an atomic-resolution HAADF-STEM image of surface step-facets of the SF-Cu induced by a stacking fault and a twin boundary, where both the stacking fault and twin boundary along {111} planes are indicated by white dashed lines.
Figure 2G:
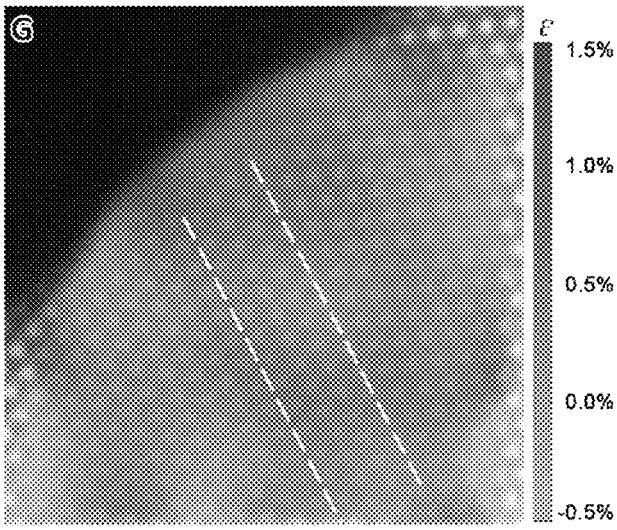
FIG. 2G shows geometric-phase analysis (GPA) strain mapping of tensile strain (C) near the surface exits of the stacking fault and the twin boundary as shown in FIG. 2F using the lattice far from defects as a reference (zero strain), where the tensile strain as measured is perpendicular to the {111} plane along which the stacking fault and twin boundary align with each other.

Turning to FIGS. 2A-2E, the SF-Cu nanoparticles with an average diameter of ~60 nm (FIG. 2A) are first prepared. Detailed preparation methods of the SF-Cu nanoparticles can be found in some of the examples described hereinafter. The high-resolution transmission electron microscopy (HR-TEM) and aberration-corrected high-angle-annular-dark-filed scanning TEM (HAADF-STEM) images of the SF-Cu nanoparticles reveal abundant stacking faults that intersect with each other (FIGS. 2B and 2D). The selected area (marked with E) in HRTEM image of FIG. 2C shows that the multitudinous interlaced grain boundaries in SF-Cu contain Σ3 coincident site lattice (CSL) boundaries and form some typical five-fold twinning structures (being twin boundaries as highlighted by yellow lines in HAADF-STEM image shown in FIG. 2E), which can induce the intrinsic stress, especially large tensile strain/stress on the surface layer. The GPA map shown in FIG. 2G reveals the local tensile strain as large as ~0.8% around the surface exits of both twin boundaries and stacking faults. As seen in FIG. 2F, the stepped facets are induced at the surface exits of twin boundaries and stacking faults, giving rise to surface Cu atoms with reduced CNs. As both the high surface tensile strain and low CNs can lead to the high-energy active surfaces for catalytic reactions, it suggests that the abundant stacking faults and grain boundaries in SF-Cu induce the extraordinary $ECO_2R$ performance in the present invention.

Figure 3:
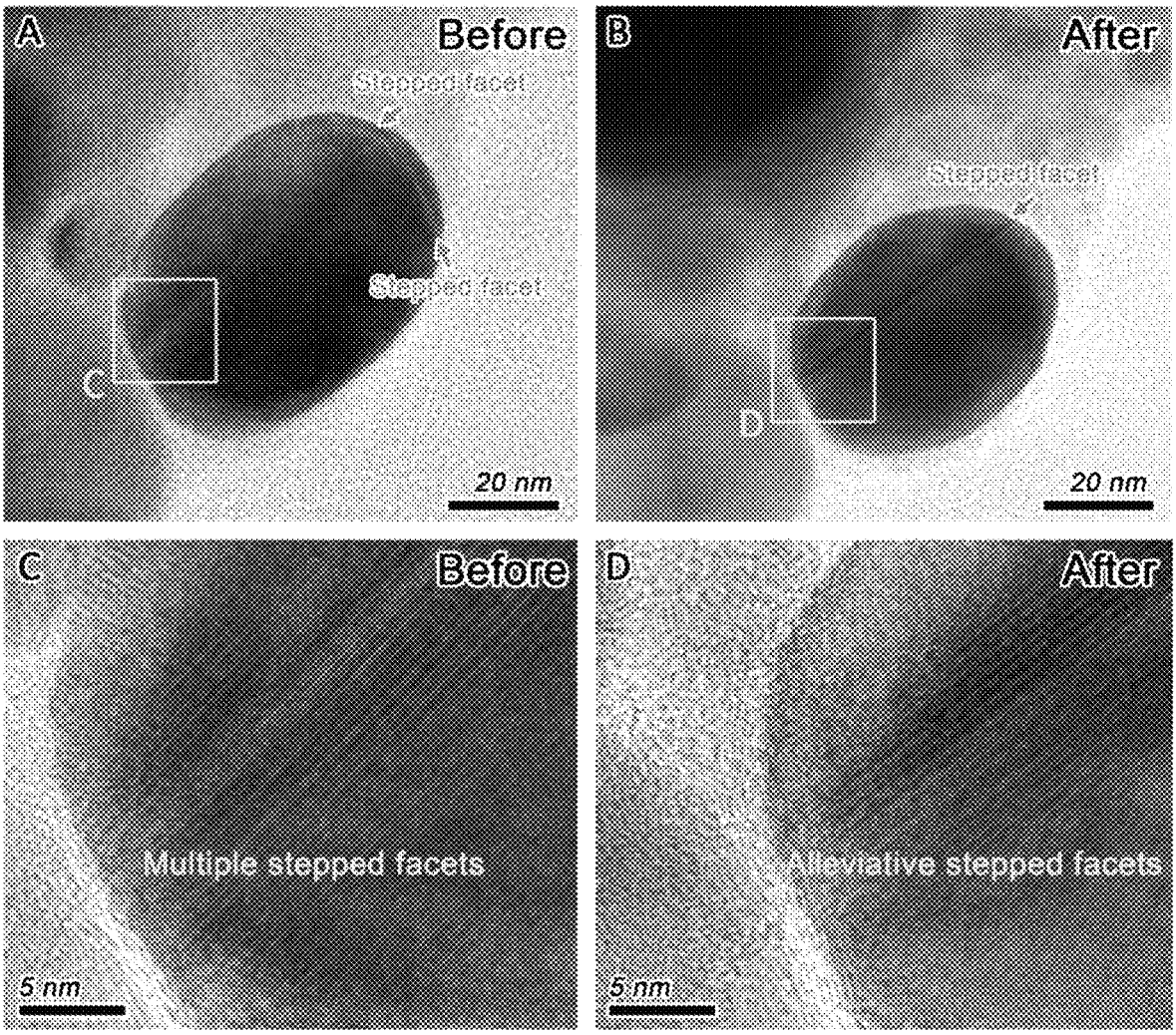
FIG. 3 shows in-situ heating characterization on different states of SF-Cu: (A and B) TEM images of the pristine SF-Cu (Before) and the SF-Cu heated at 650° C. for 20 min (After); (C and D) HRTEM images of the pristine SF-Cu (Before) and the SF-Cu heated at 650° C. for 20 min (After)
Figure 4:
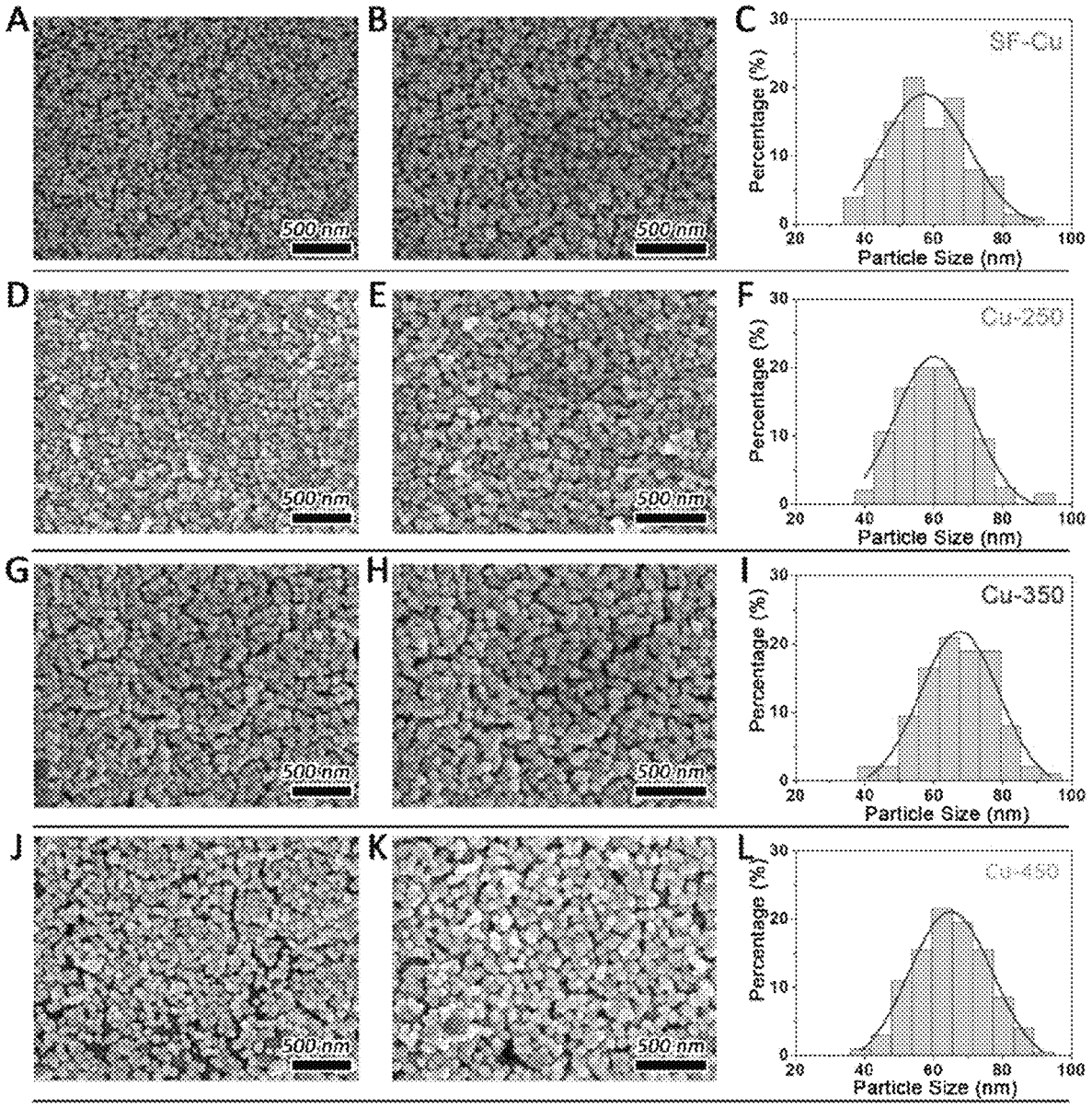
FIG. 4 shows SEM images and size distribution of different catalyst nanoparticles: (A-C) SF-Cu; (D-F) Cu-250; (G-I) Cu-350; (J-L) Cu-450.
Figure 7:
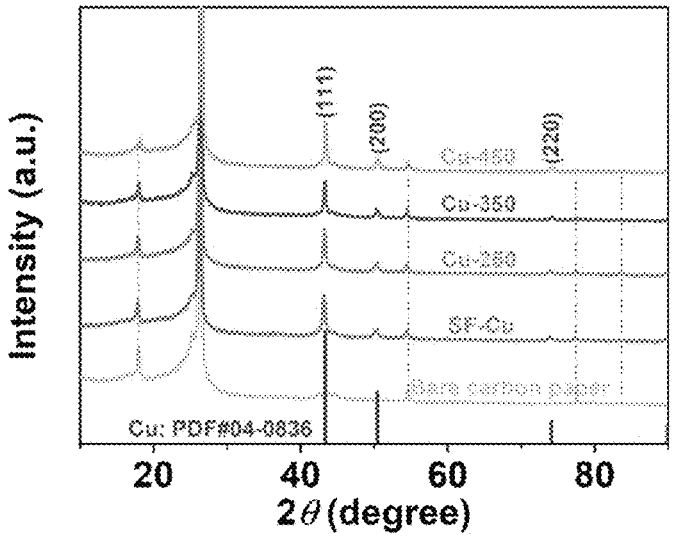
FIG. 7 shows an X-ray diffraction (XRD) patterns of SF-Cu, Cu-250, Cu-350 and Cu-450 on the carbon paper, and bare carbon paper.
Figure 8:
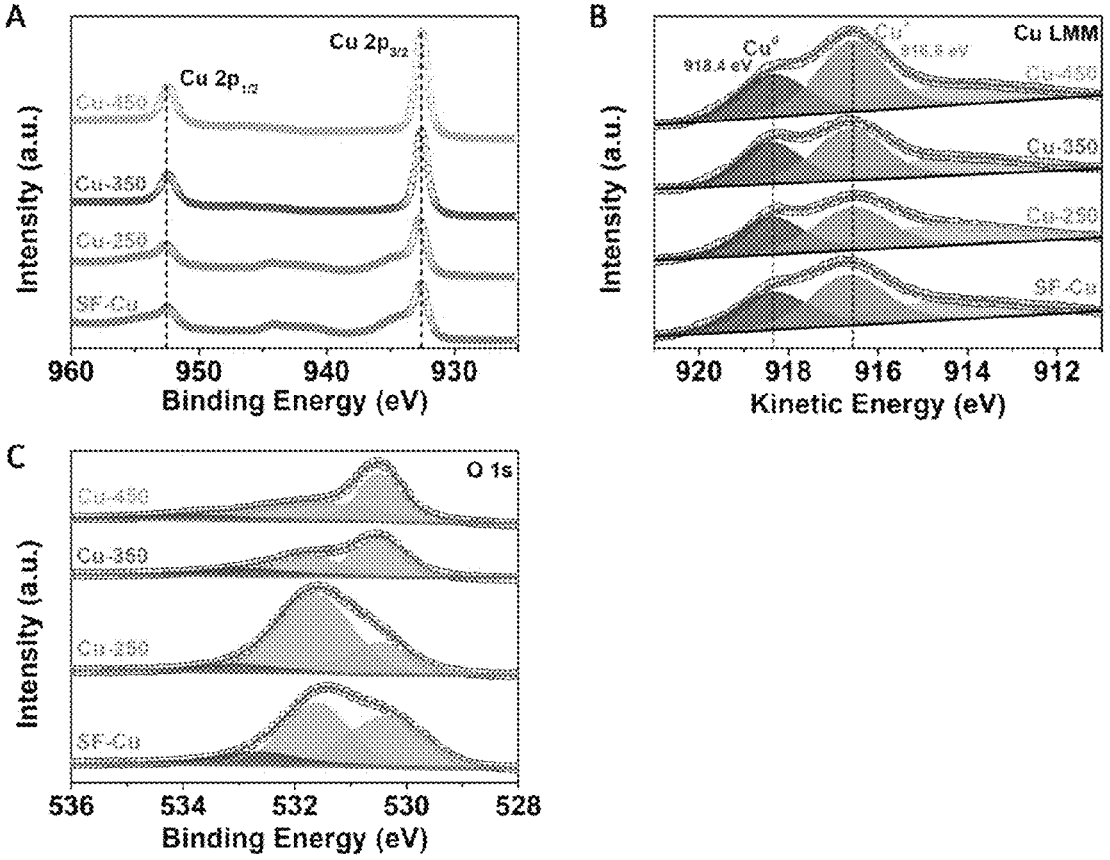
FIG. 8 shows an X-ray photoelectron spectroscopy (XPS) spectra of SF-Cu, Cu-250, Cu-350 and Cu-450: (A) Cu 2p XPS spectra. (B) Cu LMM Auger spectra. (C) O is XPS spectra.
Figure 9:
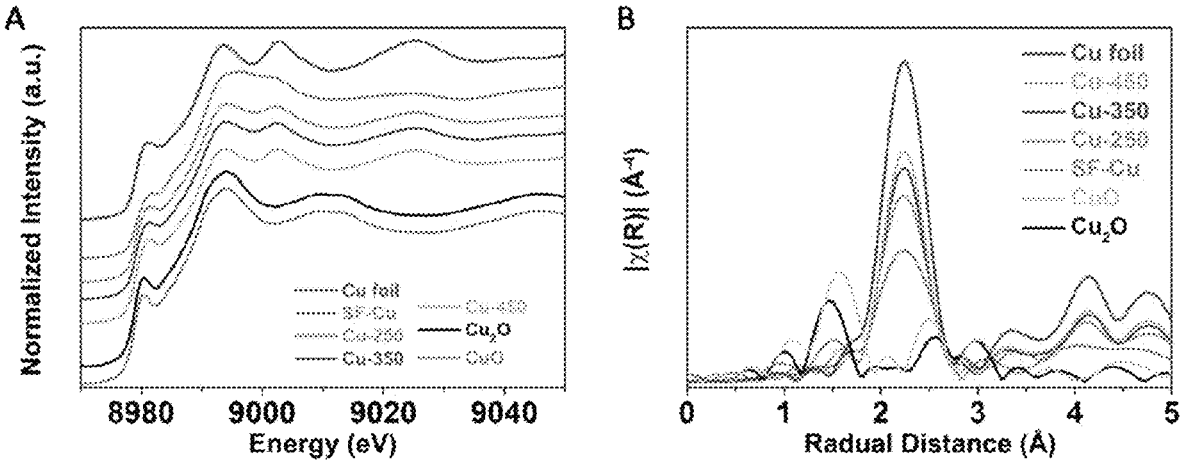
FIG. 9 shows an X-ray absorption spectroscopy (XAS) spectra of SF-Cu, Cu-250, Cu-350 and Cu-450, and the standard Cu foil, CuO and $Cu_2O$ references: (A) Cu K-edge XANES spectra; (B) Fourier transform of Cu K-edge extended X-ray absorption fine structure (EXAFS) spectra.
Figure 10:
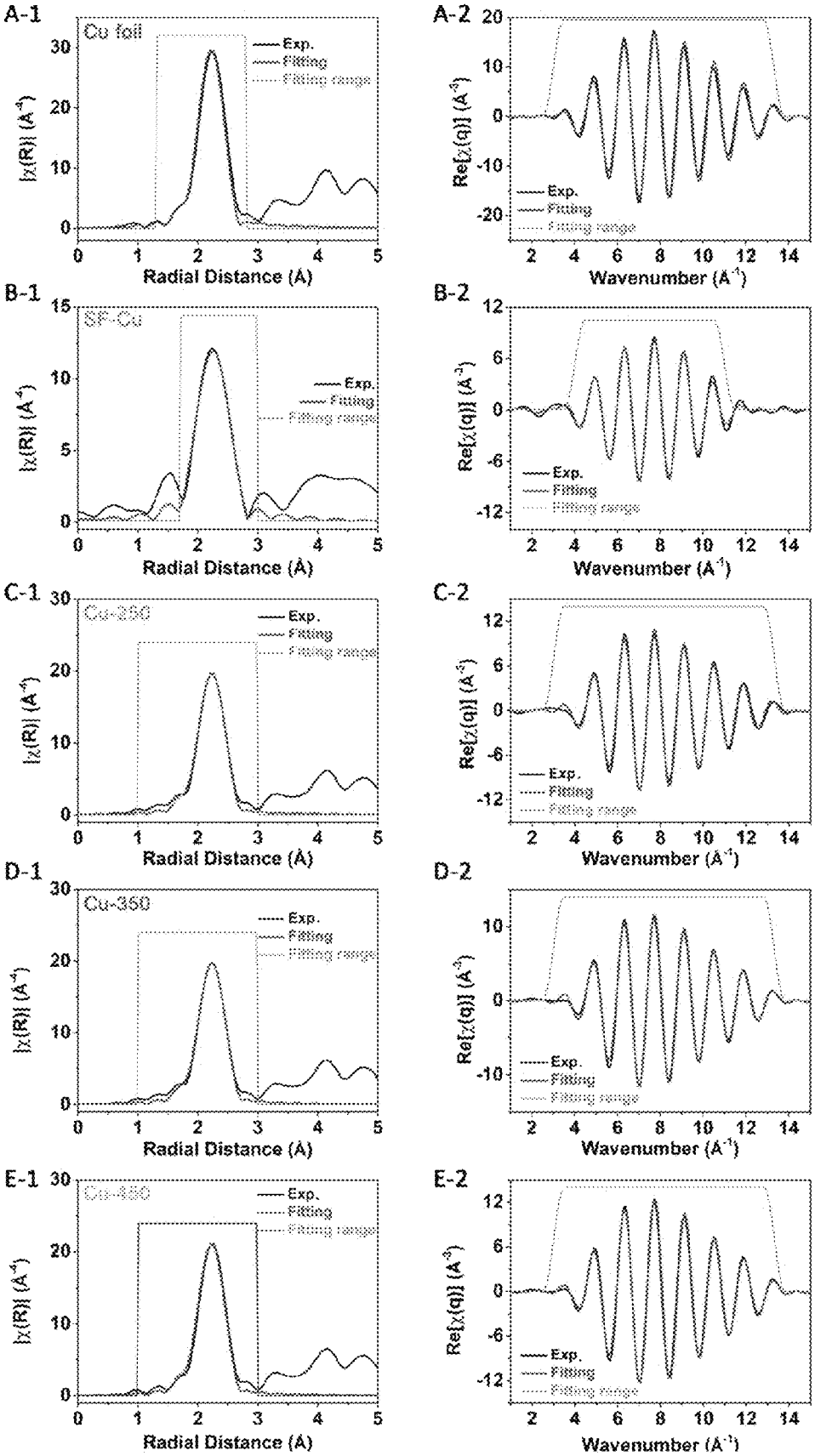
FIG. 10 shows Cu K-edge EXAFS fitting curves at R and q space, respectively: (A1-A2) Cu foil reference; (B1-B2) SF-Cu; (C1-C2) Cu-250; (D1-D2) Cu-350; (E1-E2) Cu-450.
Figure 11:
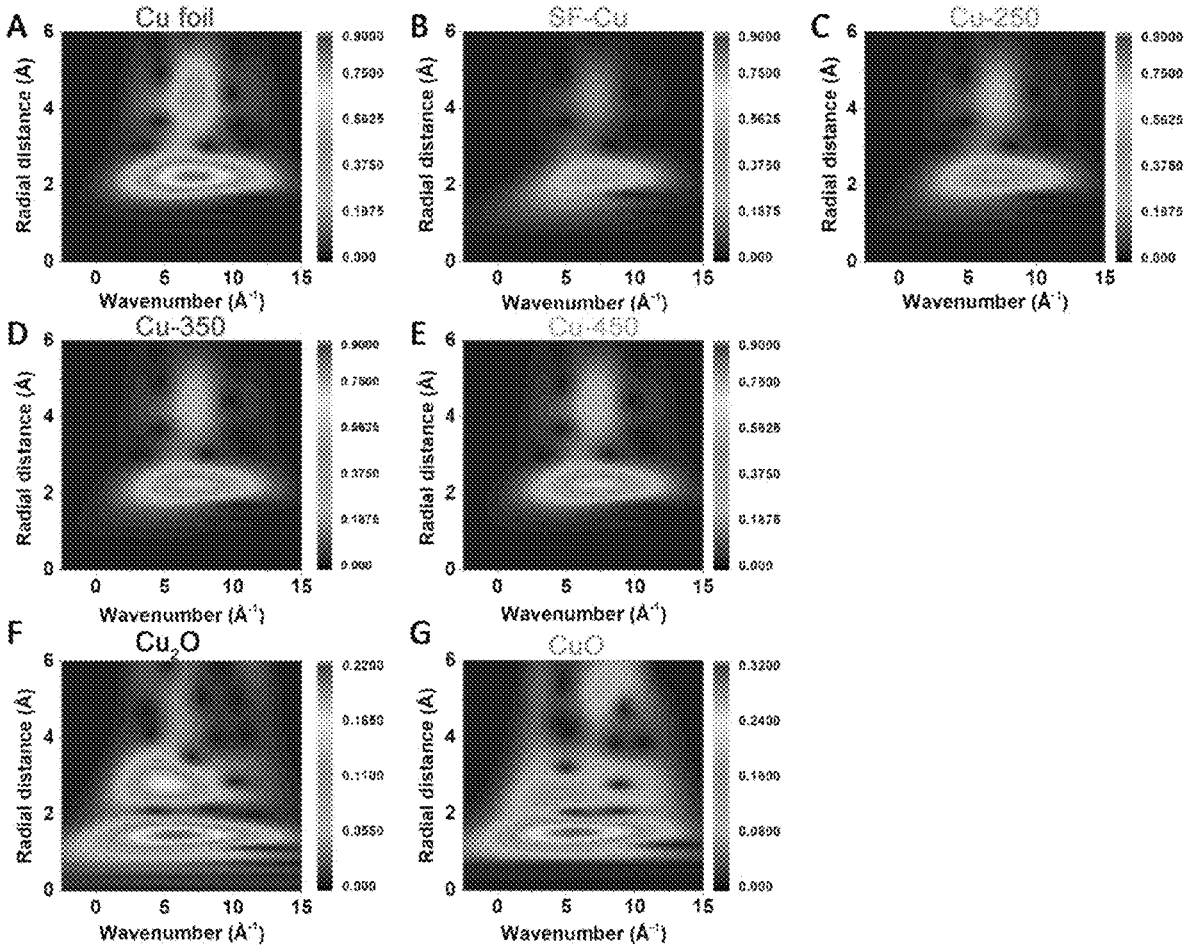
FIG. 11 shows two-dimensional plots of wavelet transform EXAFS (2D WT EXAFS): (A) Standard Cu foil reference; (B) SF-Cu; (C) Cu-250; (D) Cu-350; (E) Cu-450; (F) Standard $Cu_2O$ reference; (G) Standard CuO reference.

To verify these structural effects on $ECO_2R$ performance, SF-Cu is annealed at various elevated temperatures (250, 350 and 450° C.; Cu-250, Cu-350 and Cu-450) to alter their microstructures. In theory, the high-temperature treatment will induce rearranging atoms to reach a more thermodynamically favorable state in minimizing the total surface energy. The effect of annealing on the SF-Cu in the present invention has been explicitly shown by in-situ heating TEM images, which demonstrate a decrease or even a disappearance of stacking faults and twin boundaries in the SF-Cu at high temperatures (FIG. 3). After each high-temperature treatment, there is no appreciable change in sample size distributions (FIG. 4), while all samples remain as metallic Cu (revealed by XRD pattern on carbon paper in FIG. 7). Only a small extent of surface oxidation is observed on all samples by an X-ray photoelectron spectroscopy (XPS) measurements (FIG. 8). Cu K-Edge X-ray absorption spectroscopy (XAS) is conducted to investigate the local coordination of Cu in the SF-Cu (FIGS. 9-11; Table 1). X-ray absorption near-edge structure spectroscopy (XANES) spectra in FIG. 5A confirmed that all the samples comprise almost a pure metallic Cu phase. In addition, Fourier-transformed X(R) functions of extended X-ray absorption fine structure (EXAFS) data in the frequency domain (R) revealed an increase in CN as increasing the annealing temperature (FIG. 5B). In FIG. 5F, structural parameters from EXAFS fitting results further indicate that the CNs of Cu increase gradually (from ~7.6 to 9.9), and tensile strains decrease gradually (from ~1.03% to 0.28%) in the order of SF-Cu, Cu-250, Cu-350 and Cu-450 (Table 1), consistent with the observed decrease in stacking faults and twin boundaries by in-situ heating TEM as described hereinabove.

TABLE 1

| Sample | Path | CN | R, Å | ΔR, Å | D-W factor (62) | Enot, eV | R-factor, % | Strain, % |
|---|---|---|---|---|---|---|---|---|
| SF-Cu | Cu—Cu | 7.6 ± 0.5 | 2.551 ± 0.004 | 0.026 ± 0.002 | 0.009 ± 0.001 | 6.2 ± 0.8 | 1.4 | 1.03 |
| Cu-250 | | 9.8 ± 0.4 | 2.540 ± 0.003 | 0.021 ± 0.003 | 0.009 ± 0.001 | 3.8 ± 0.5 | 1.7 | 0.59 |
| Cu-350 | | 9.6 ± 0.9 | 2.535 ± 0.003 | 0.016 ± 0.003 | 0.009 ± 0.001 | 3.3 ± 0.4 | 1.3 | 0.40 |
| Cu-450 | | 9.9 ± 0.8 | 2.532 ± 0.002 | 0.004 ± 0.004 | 0.008 ± 0.001 | 2.7 ± 0.4 | 1.2 | 0.28 |
| Cu foil | | 12 | 2.525 ± 0.005 | — | 0.007 ± 0.001 | 2.1 ± 0.5 | 1.8 | — |

CN: coordination number; R: bond length; o: Debye-Waller factor.

Figure 12:
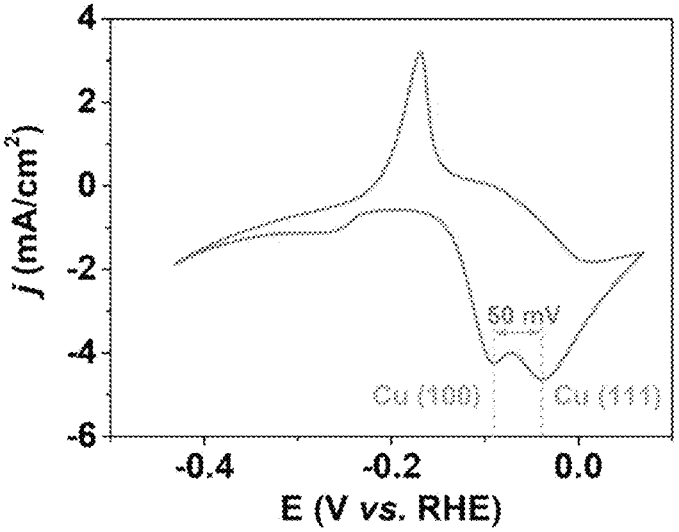
FIG. 12 shows exposed facets of SF-Cu determined by lead underpotential deposition (Pd-UPD)
Figure 13:
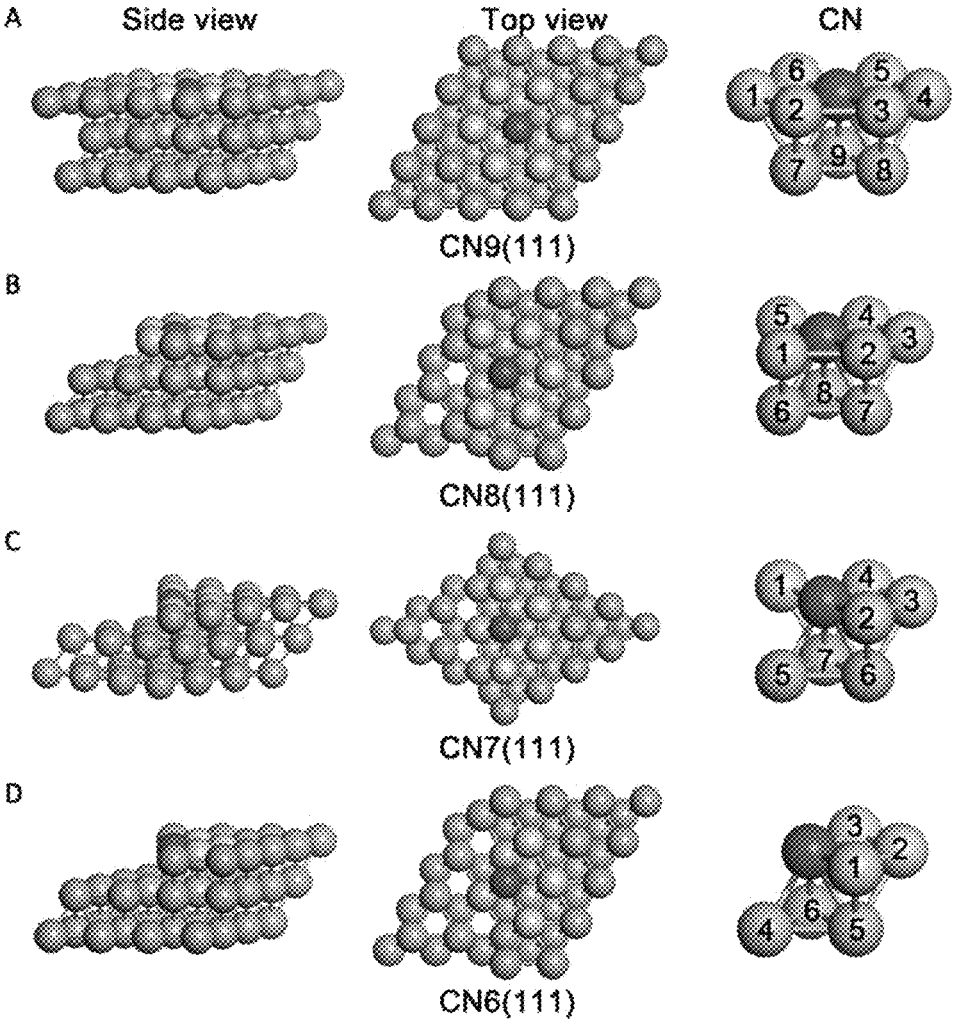
FIG. 13 shows atomic models with different CNs on Cu (111) (side view, top view and Cu site with the different CN): (A) The perfect Cu (111), CN: 9; (B-D) CN: 8, 7 and 6, respectively.
Figure 14:
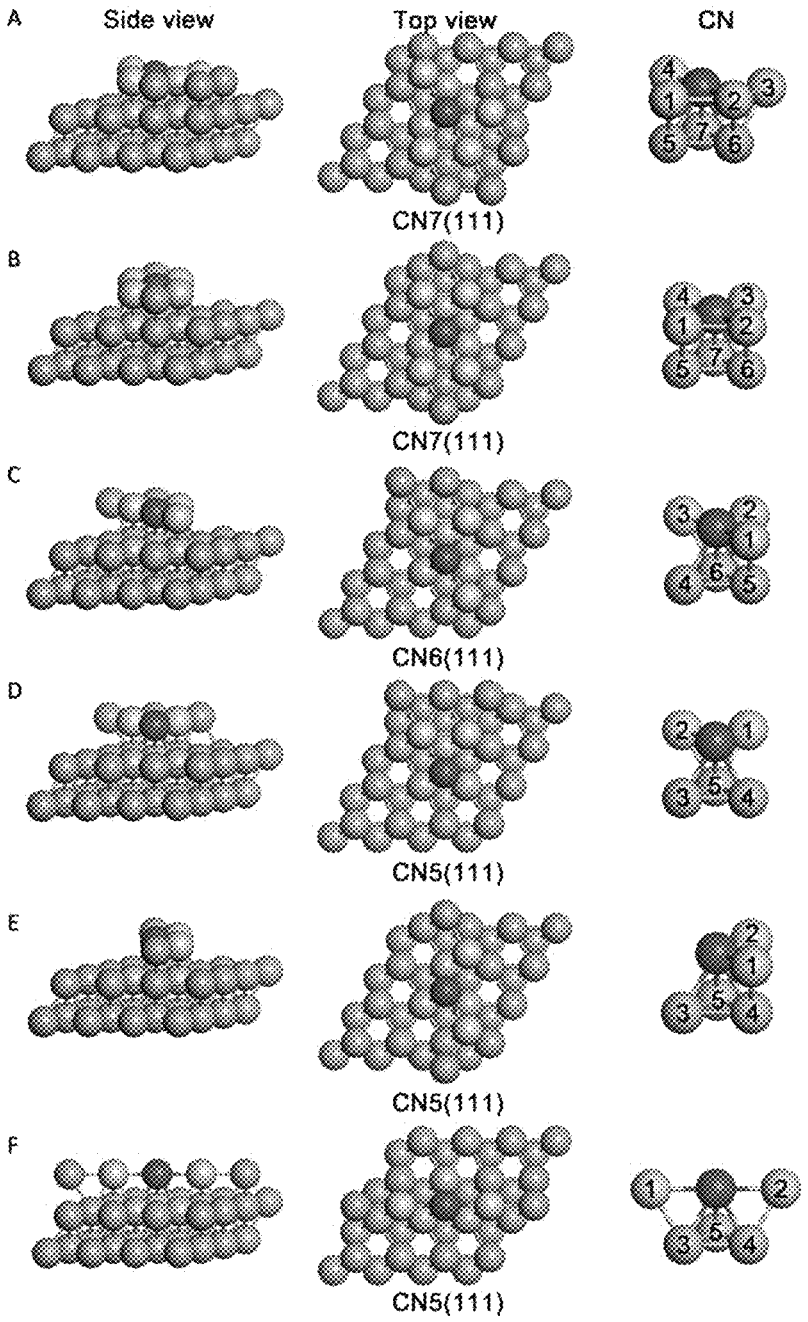
FIG. 14 shows atomic models with different CNs on Cu (111) (side view, top view and Cu site with the different CN): (A-F) CN: 7, 7, 6, 5, 5 and 5, respectively.
Figure 15:
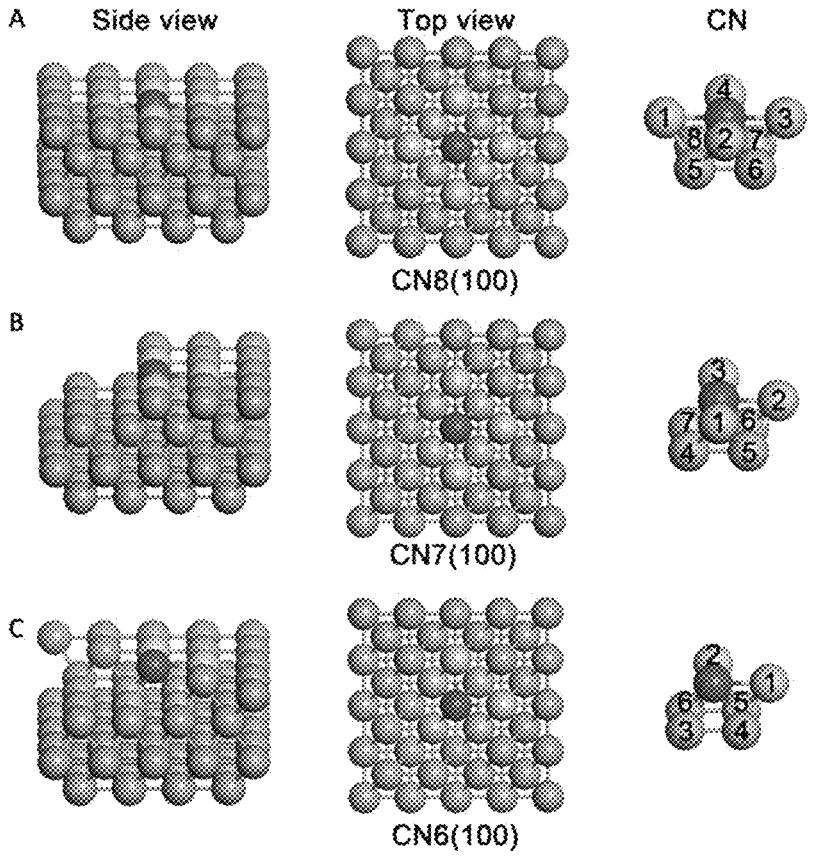
FIG. 15 shows Atomic models with different CNs on Cu (100) (side view, top view and Cu site with the different CN): (A) The perfect Cu(100), CN: 8. (B and C) CN: 7 and 6, respectively.
Figure 16:
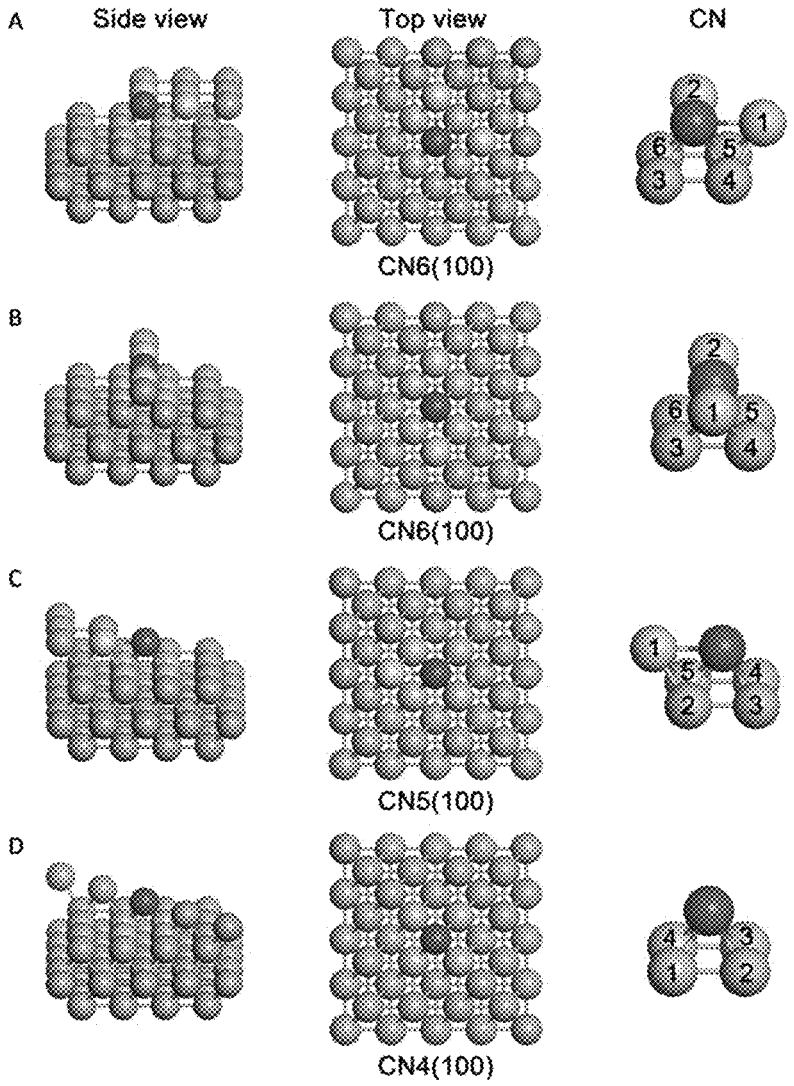
FIG. 16 shows atomic models with different CNs on Cu(100) (side view, top view and Cu site with the different CN): (A-D) CN: 6, 6, 5 and 4, respectively.
Figure 17:
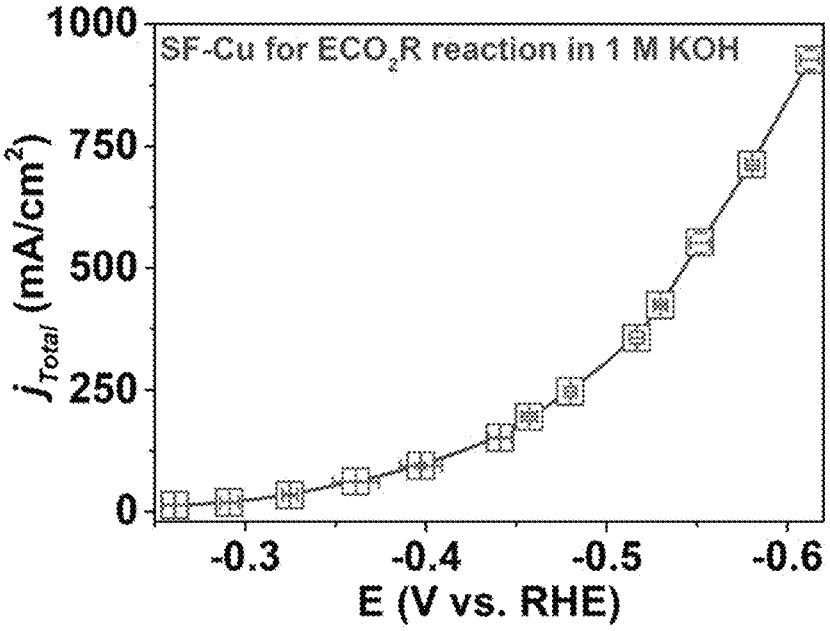
FIG. 17 shows the total current density of $ECO_2R$ under different applied potentials over SF-Cu in a flow cell with 1 M KOH as the electrolyte; values are means; error bars indicate SD (n=3 replicates)
Figure 18:
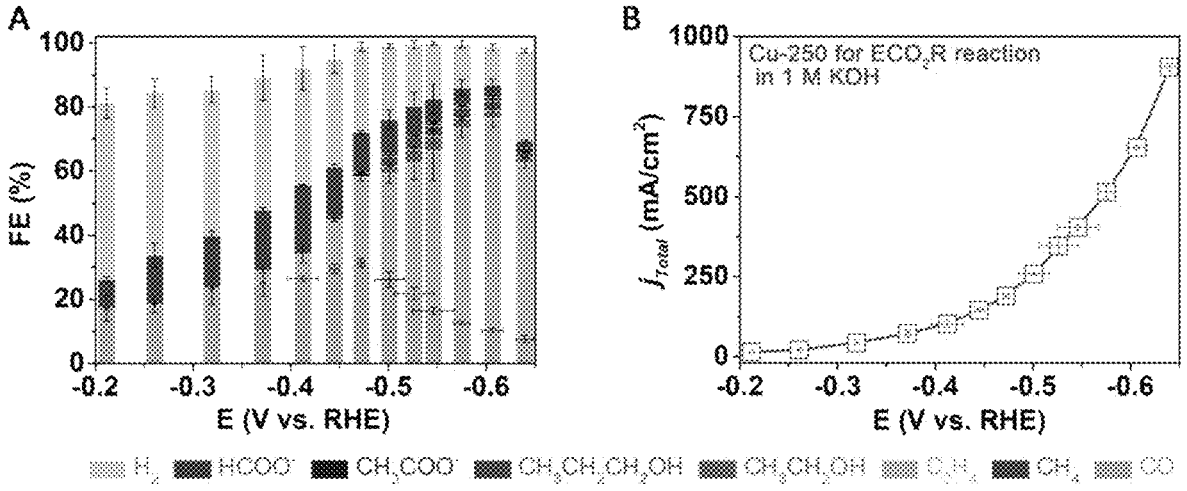
FIG. 18 shows $ECO_2R$ performance on Cu-250 under different applied potentials in a flow cell with 1 M KOH as the electrolyte: (A) FEs towards $ECO_2R$ products; (B) total current density; values are means; error bars indicate SD (n=3 replicates)
Figure 19:
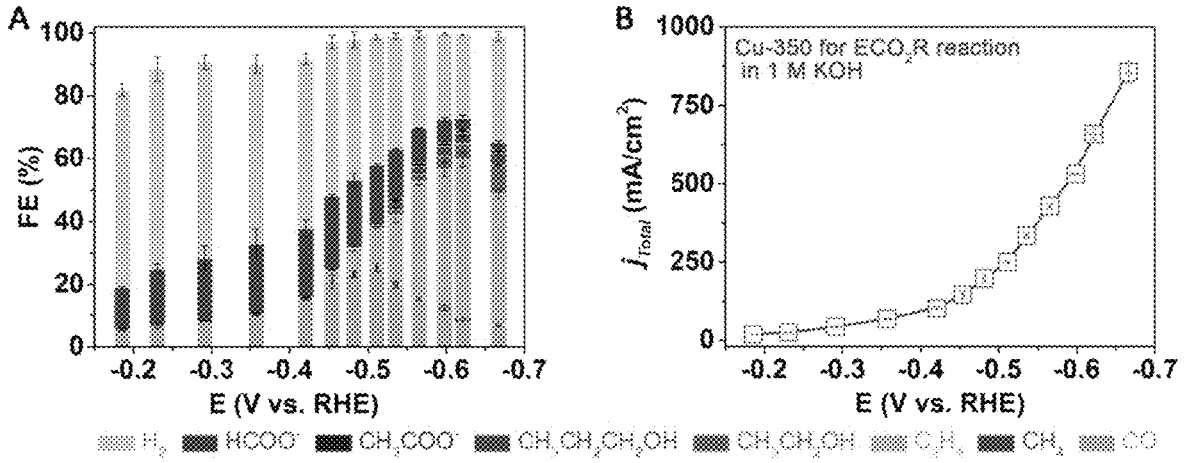
FIG. 19 shows $ECO_2R$ performance on Cu-350 under different applied potentials in a flow cell with 1 M KOH as the electrolyte: (A) FEs towards $ECO_2R$ products; (B) total current density; values are means; error bars indicate SD (n=3 replicates)
Figure 20:
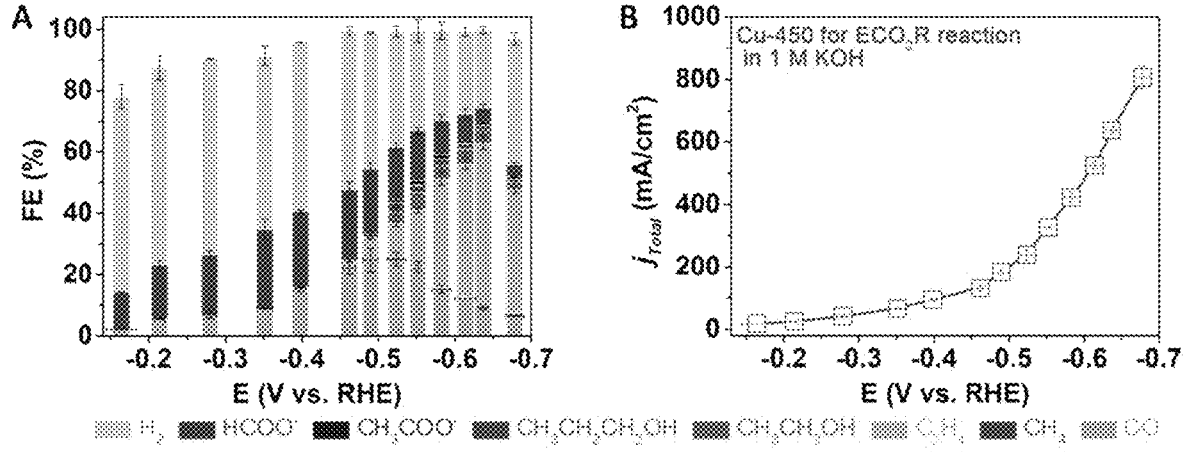
FIG. 20 shows $ECO_2R$ performance on Cu-450 under different applied potentials in a flow cell with 1 M KOH as the electrolyte: (A) FEs towards $ECO_2R$ products; (B) total current density; values are means; error bars indicate SD (n=3 replicates)

To confirm the probability of surface Cu atoms with low CNs, the lead underpotential deposition (Pb UPD) is used to identify the exposed facets of SF-Cu, which are Cu (111) and Cu (100) (FIG. 12). Then, the atomic structure simulations are carried out to show the possible CNs of Cu atoms on the exposed facets (111 and 100) of SF-Cu (FIGS. 13-16). The perfect Cu (111) plane is composed of the surface atoms with a CN of 9 (FIG. 13A), while other CNs (8, 7, 6 and 5) are also possible, depending on different sliding ways (FIGS. 13B-D and 14A-F). Similarly, the perfect Cu (100) plane contains surface atoms with a CN of 8 (FIG. 15A) and atomic sites with lower CNs include 7, 6, 5 and 4 (FIGS. 15B-C and 16A-D). As a result, CNs of Cu atoms on the SF-Cu surface vary from 9 to 4 due to abundant stacking faults and interlaced grain boundaries.

Figure 21:
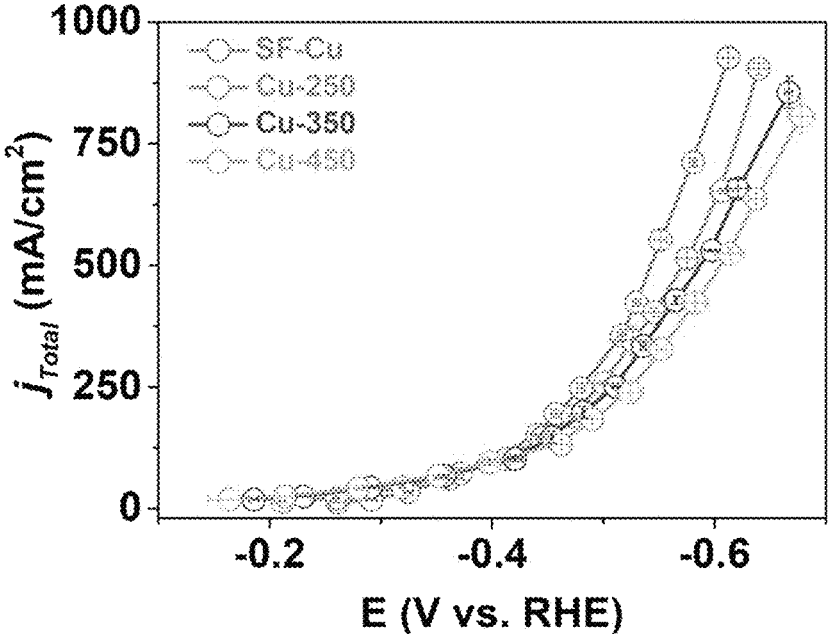
FIG. 21 shows a comparison of the total current densities on SF-Cu, Cu-250, Cu-350 and Cu-450 for the $ECO_2R$ reaction in a flow cell with 1 M KOH as the electrolyte under a range of applied potentials.
Figure 22:
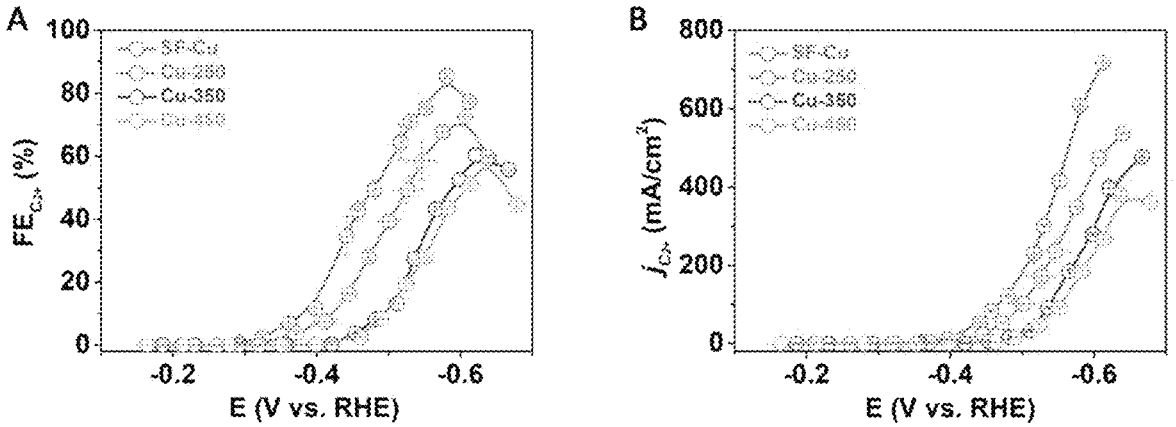
FIG. 22 shows a comparison of FEs and partial current densities toward $C_{2+}$ products on SF-Cu, Cu-250, Cu-350 and Cu-450 for the $ECO_2R$ reaction in a flow cell with 1 M KOH as the electrolyte under a range of applied potentials: (A) FEs toward $C_{2+}$ products; (B) Partial current densities of $C_{2+}$.
Figure 24:
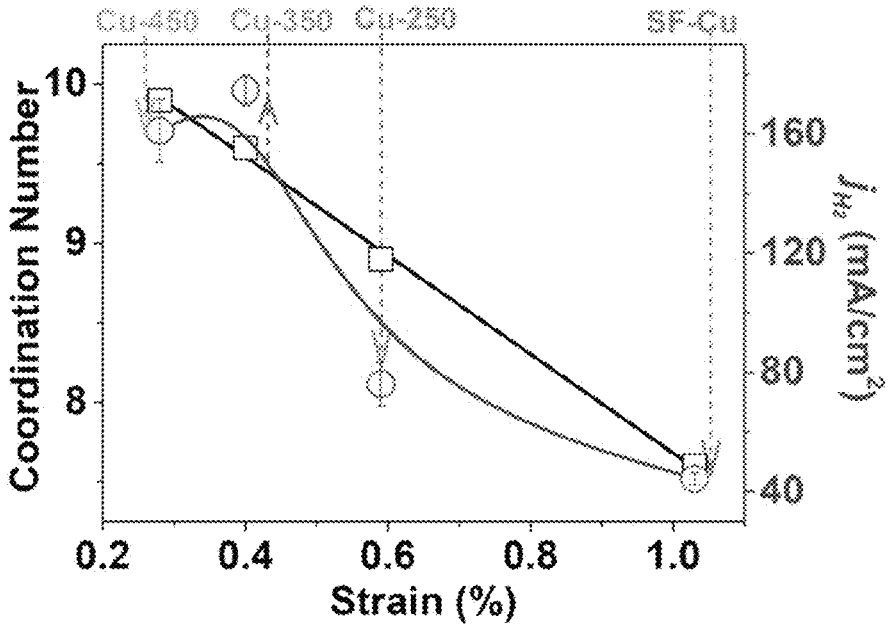
FIG. 24 shows a relationship between strain, CN and the $j_{H2}$ under the peak $ECO_2R$ performance in a flow cell with 1 M KOH as the electrolyte.

SF-Cu shows the best $ECO_2R$ performance and the highest FEs toward $C_2H_4$ and $C_{2+}$ in the flow cell among all the samples under 1 M KOH electrolyte condition (FIGS. 5C and 17-20). Specifically, for SF-Cu, the peak. FE toward $C_2H_4$ is up to ~80% at about −0.58 V, at which $j_{C2H4}$ reaches ~568 mA/cm$^2$. The half-cell energy efficiency ($EE_{half\text{-}cell}$) of $C_2H_4$ is up to ~51.0, With an increase in treatment temperature, the samples show a noticeable decline for $ECO_2R$ activity (FIG. 21). Such effect is apparent on $ECO_2R$-to-$C_2H/C_{2+}$, presumably due to higher CN and lower tensile strain at high temperatures (FIGS. 5D, 5E and 22). It prompts to study the relationships between the CN, tensile strain, and $ECO_2R$ performance. In FIG. 5F, the tensile strain and CNs show a strong linear correlation with the change in the annealing temperature because of the rearrangement of atoms (black line). More importantly, a monotonic increase in the partial current density ($j_{C2+}$, $j_{C2H4}$ or $j_{without\ H2}$, in which "$j_{without\ H2}$" refers to partial current density of all $ECO_2R$ products) is observed with a decline of the CN and an increment of the tensile strain (FIGS. 5F and 23). In other words, the partial current density ($j_{C2+}$, $j_{C2H4}$ or $j_{without\ H2}$) shows a strong linear correlation as a function of the tensile strain and CNs. In contrast, the function of the tensile strain and CN shows a low correlation to the partial current density of the competing reaction ($j_{H2}$) (FIG. 24).

Figure 25:
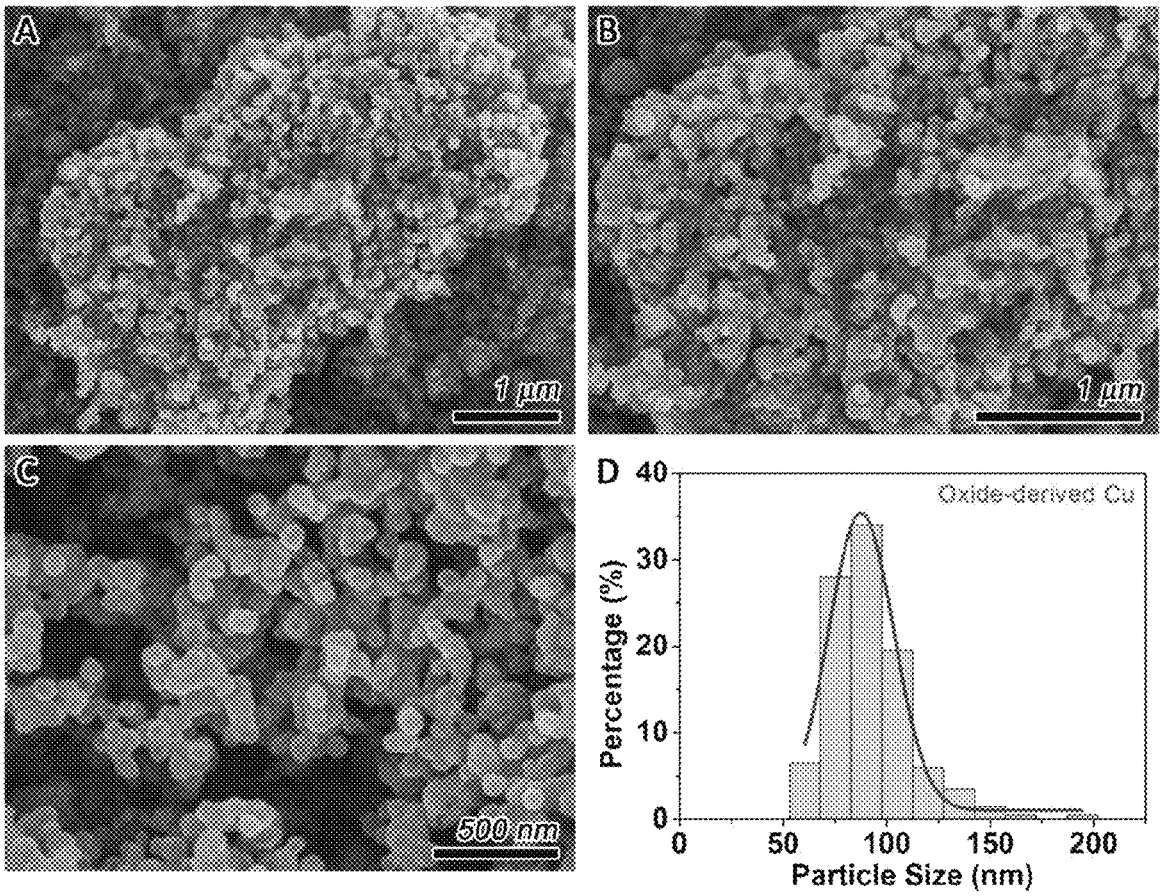
FIG. 25 shows SEM images (A-C) and size distribution (D) of the oxide-derived Cu nanoparticles.
Figure 26:
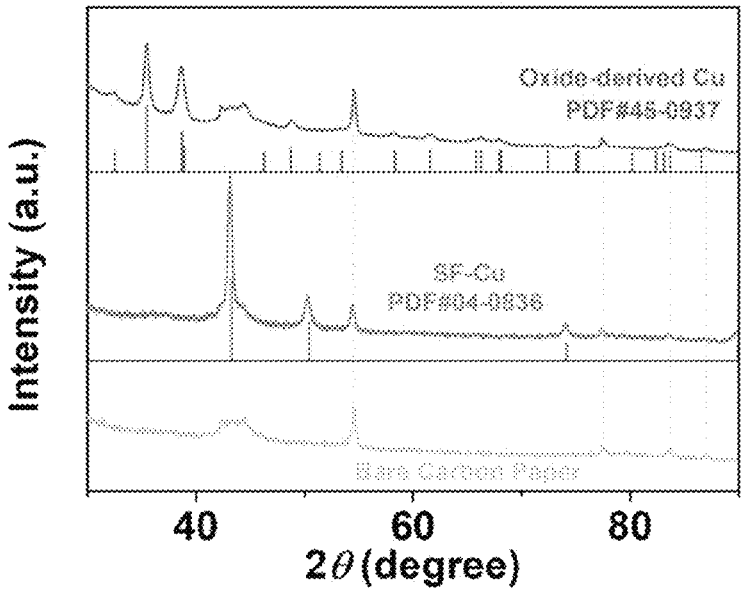
FIG. 26 shows XRD patterns of SF-Cu, oxide-derived Cu on the carbon paper, and bare carbon paper.
Figure 27:
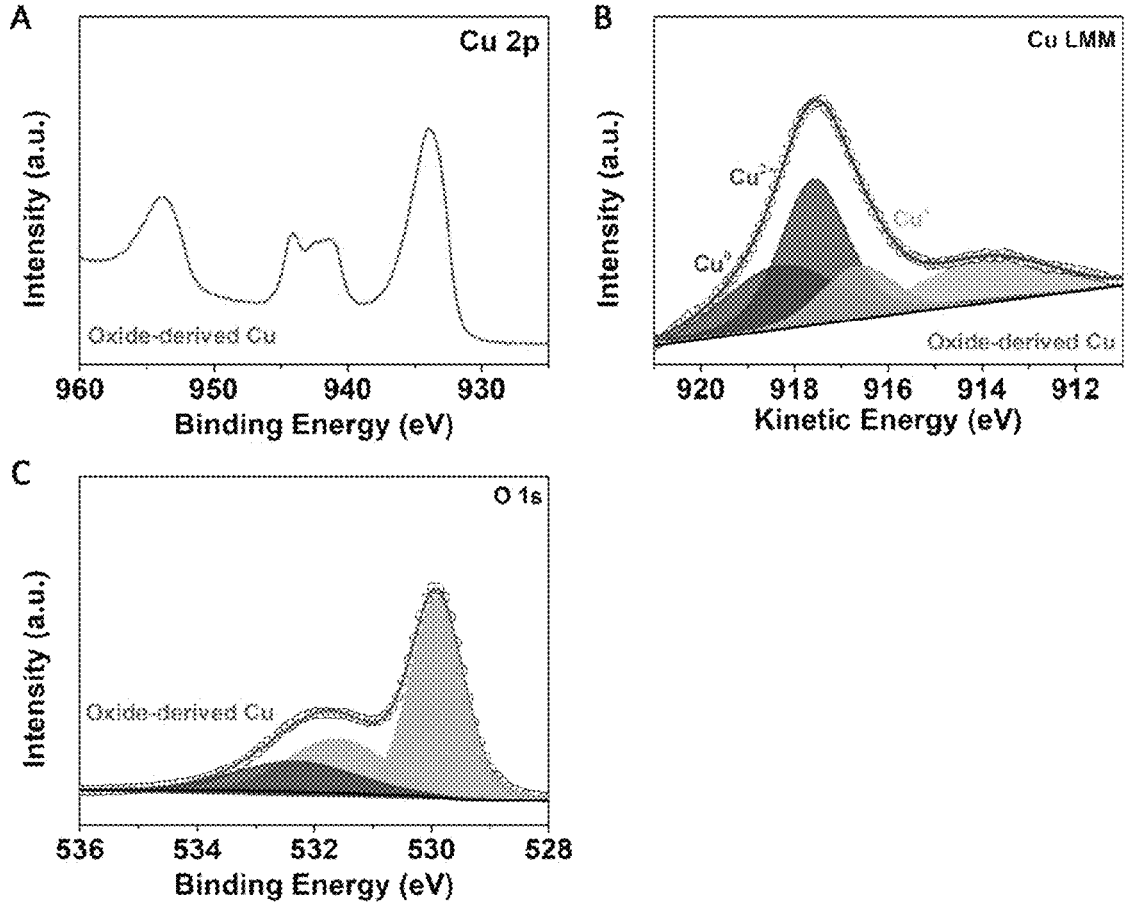
FIG. 27 shows XPS spectra of the oxide-derived Cu: (A) Cu 2p XPS spectrum; (B) Cu LMM Auger spectrum; (C) O 1s XPS spectrum.
Figure 28:
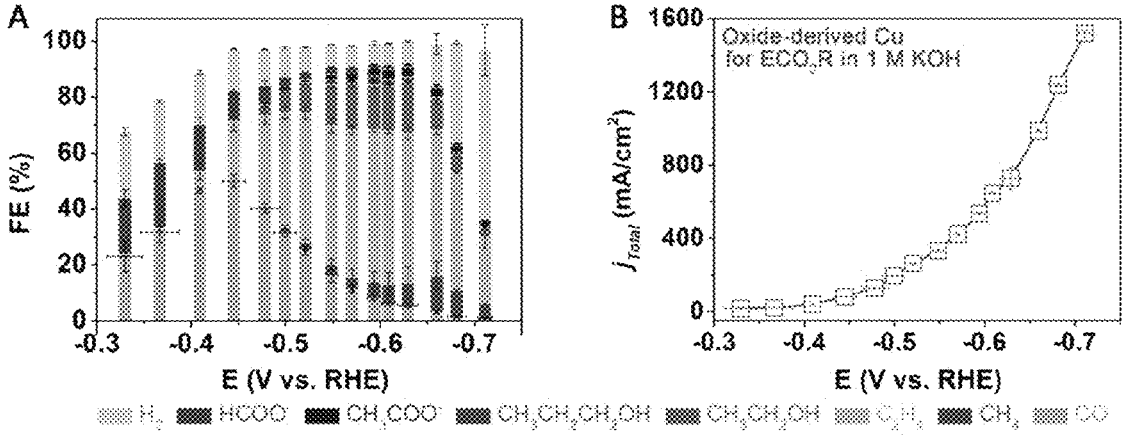
FIG. 28 shows $ECO_2R$ performance on the oxide-derived Cu under different applied potentials in 1 M KOH: (A) FEs toward $ECO_2R$ products; (B) Total current density; values are means; error bars indicate SD (n=3 replicates)
Figure 29:
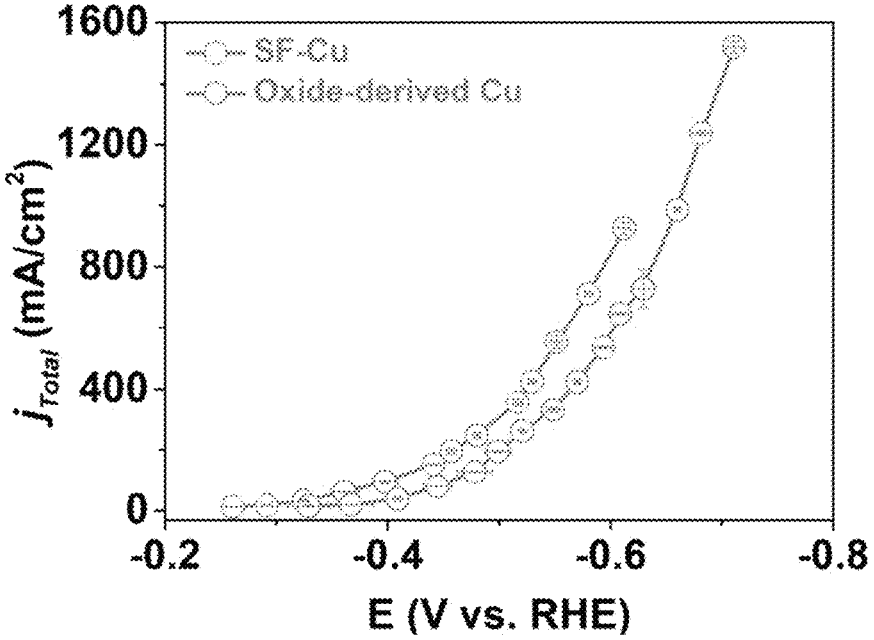
FIG. 29 shows a comparison of total current densities on SF-Cu and oxide-derived Cu for the $ECO_2R$ reaction in a flow cell with 1 M KOH as the electrolyte under a range of applied potentials.
Figure 30:
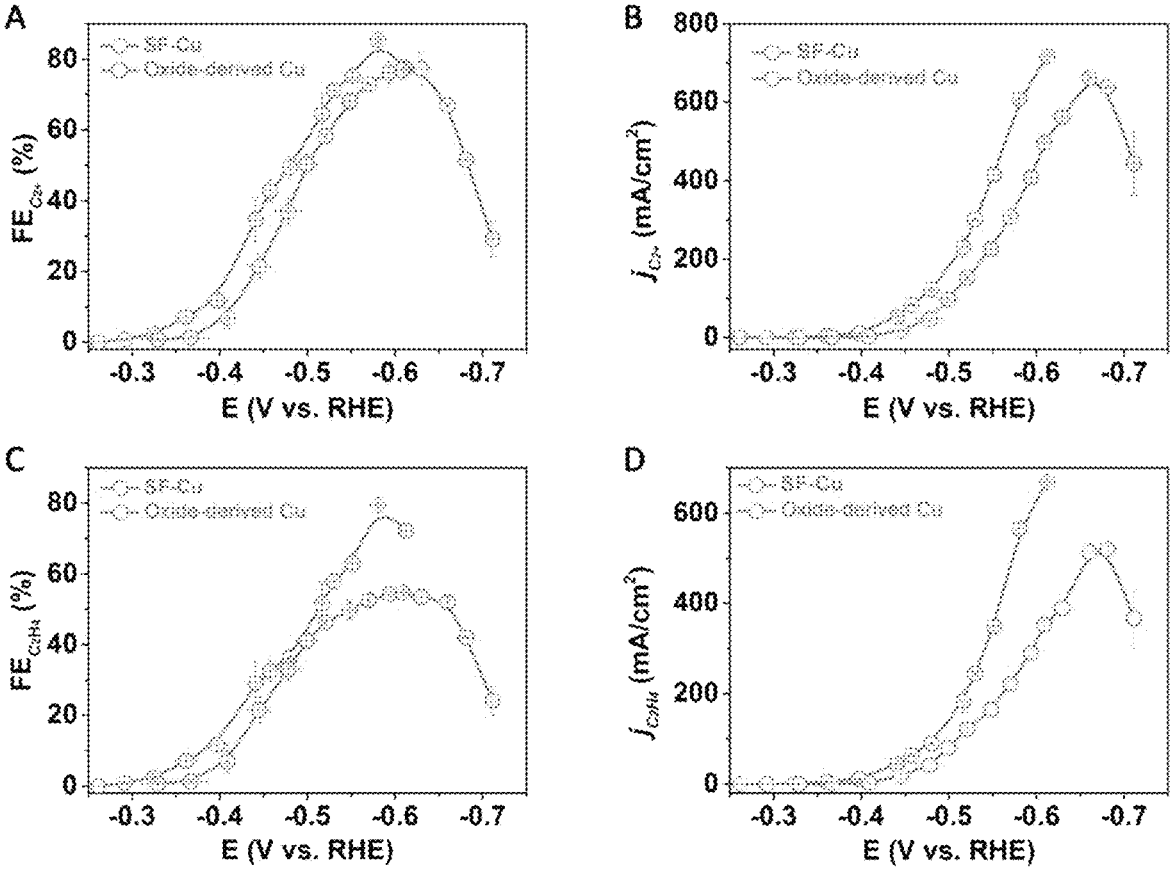
FIG. 30 shows comparisons of the $ECO_2R$ performance on SF-Cu and oxide-derived Cu in a flow cell with 1 M KOH as the electrolyte under a range of applied potentials: (A and C) comparisons of FEs toward $C_{2+}$ and $C_2H_4$, respectively; (B and D) comparisons of partial current densities of $C_{2+}$ and $C_2H_4$, respectively.

Additionally, to decouple the effect of oxidation state ($Cu^+/Cu^{2+}$) on the $ECO_2R$ performance, an oxide-derived Cu based on SF-Cu is prepared and characterized (FIGS. 25-27). Compared with SF-Cu, the oxide-derived Cu barely show any improvement in $ECO_2R$ performance in terms of either FEs or current densities (FIGS. 28-30), which suggests that oxide-derived Cu (or the oxidation state thereof) is not a crucial factor that determines the $ECO_2R$ performance in the present invention, as opposed to some previous findings. After excluding the convoluting effects of the sample size, crystal structure and oxidation state of Cu (FIGS. 4, 7 and 30), it is concluded the linkage of the low CN and high tensile strain with the high $ECO_2R$ activity in SF-Cu.

Carbonate formation caused by alkaline and neutral electrolytes such as KOH and $KHCO_3$ for $ECO_2R$ is fatal to the GDE and electrolysis system stability. Some previous studies proposed some strategies to eliminate carbonate formation, but those resulted in severe energy consumption/penalty. A cation, e.g., potassium ion ($K^+$), augmenting strategy based on the high-performance SF-Cu catalyst in strong acidic condition in a flow cell is assembled with a PEM (Nafion 117) to improve $ECO_2R$ reaction kinetics is provided.

Figure 31:
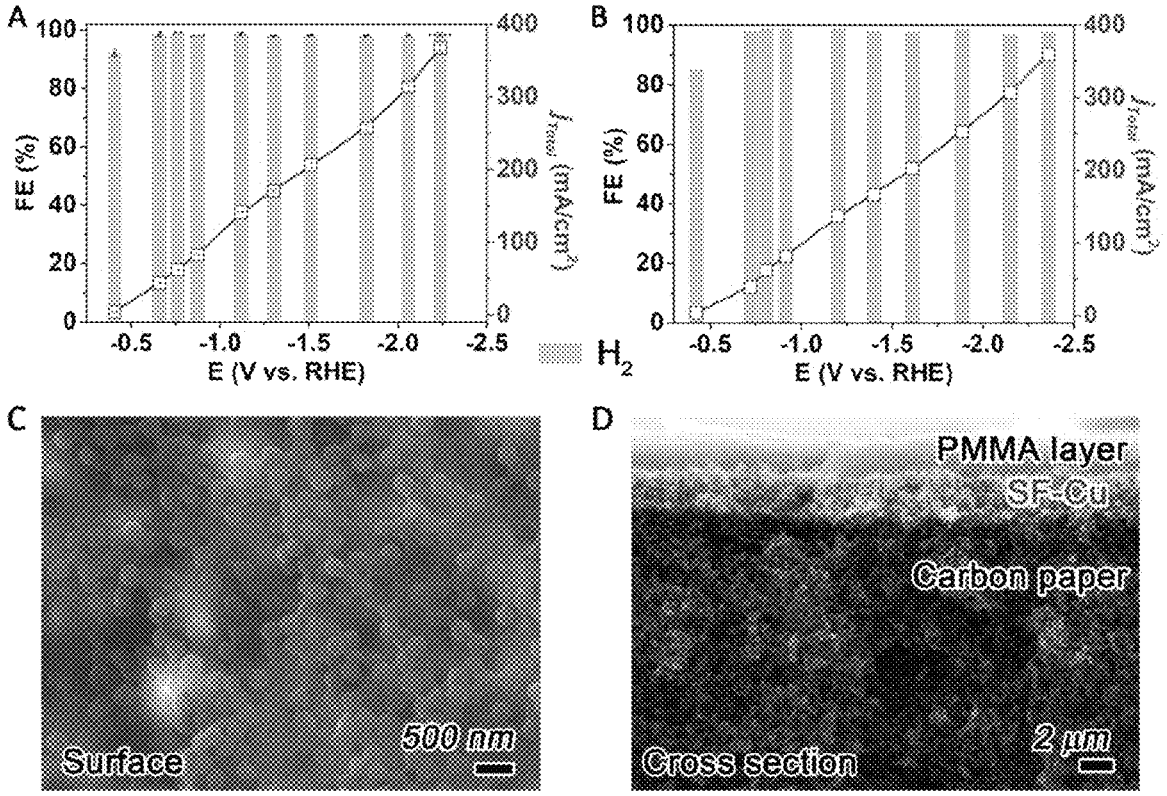
FIG. 31 shows $ECO_2R$ performance on SF-Cu and SF-Cu/PMMA in a flow cell with 1 M $H_3PO_4$: (A) The FE and total current density on SF-Cu under a range of applied potentials, no $ECO_2R$ product, just $H_2$; (B) The FE and total current density on SF-Cu/PMMA under a range of applied potentials, no $ECO_2R$ products, just $H_2$, where 1 M $H_3PO_4$ is used as the electrolyte; values are means, and error bars indicate SD (n=3 replicates); (C) SEM image of the surface of SF-Cu/PMMA; (D) Cross-sectional SEM image of SF-Cu/PMMA.
Figure 32:
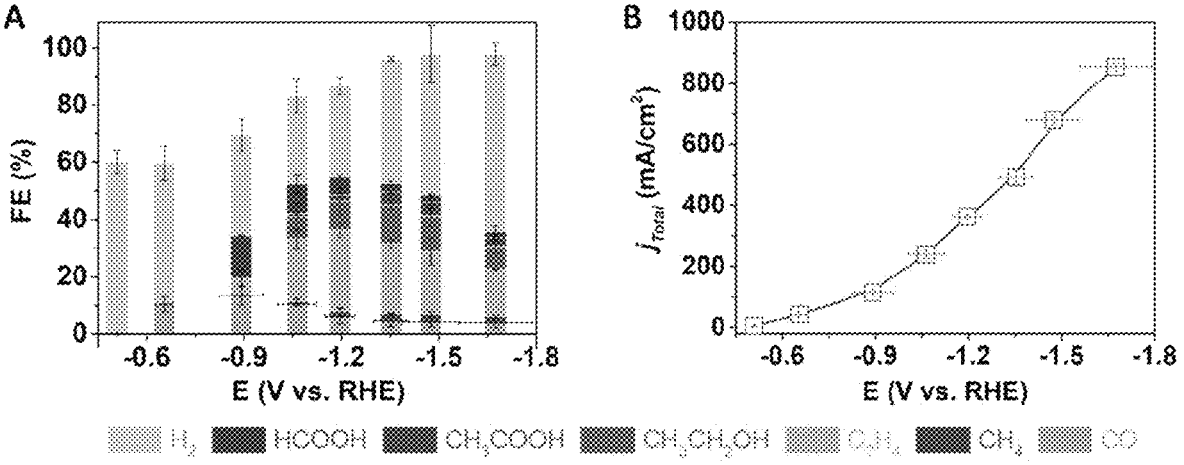
FIG. 32 shows $ECO_2R$ performance on SF-Cu/PMMA in a flow cell with 1 M $H_3PO_4$ containing 3 M KCl as the catholyte and 1 M $H_3PO_4$ as the anolyte: (A) FEs towards $ECO_2R$ products under a range of applied potentials; (B) corresponding total current density under a range of applied potentials; values are means; error bars indicate SD (n=3 replicates)
Figure 33:
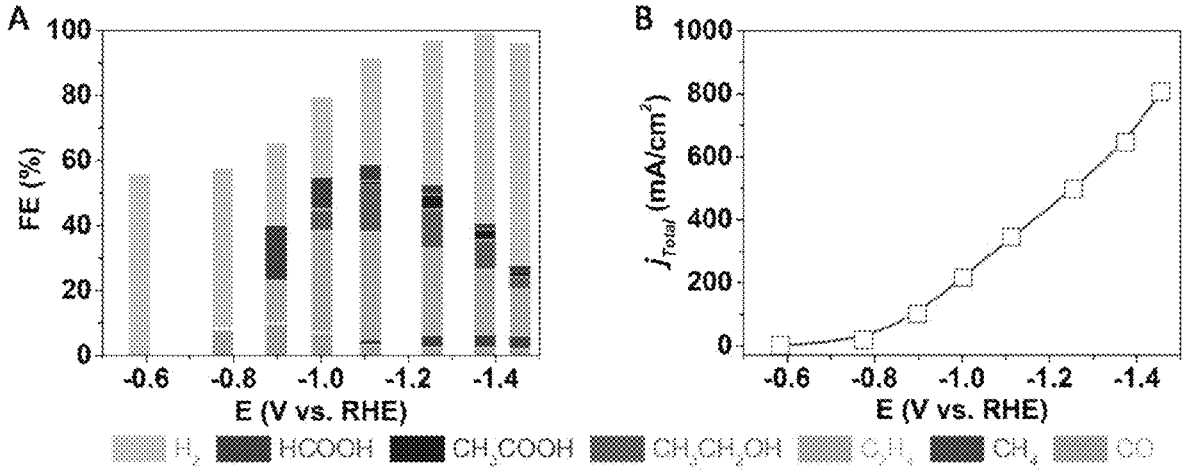
FIG. 33 shows $ECO_2R$ performance on SF-Cu/PMMA in a flow cell with 1 M $H_3PO_4$ containing 3 M KI as the catholyte and 1 M $H_3PO_4$ as the anolyte: (A) FEs towards $ECO_2R$ products under a range of applied potentials; (B) corresponding total current density under a range of applied potentials.

Initially, SF-Cu GDE is directly used as the cathode to perform $ECO_2R$ in a flow cell with 1 M $H_3PO_4$ as the electrolyte. No $ECO_2R$ product is observed, except $H_2$ (FIG. 31(A). Accordingly, a buffer layer is assembled on the SF-Cu GDE to slow the out diffusion of $OH^-$ and $K^+$ from SF-Cu surface, in order to enrich potassium ion concentration and increase local pH on said surface (FIGS. 31C and 31D). The buffer layer can be a cross-linked microporous polymethyl methacrylate (PMMA) layer and assembled on the SF-Cu GDE (SF-Cu/PMMA). However, a similar result shows no $ECO_2R$ product on SF-Cu/PMMA (FIG. 31B). According to the cation-augmenting strategy, when a high concentration of potassium ions (3 M KCl) is added into 1 M $H_3PO_4$ as the catholyte, and 1 M $H_3PO_4$ is used as the anolyte, SF-Cu/PMMA shows ~40% $C_{2+}$ FE (~28% toward $C_2H_4$, ~10% toward $C_2H_5OH$ and ~2% toward $CH_3COOH$) (FIG. 32A) and a total current density of ~360 mA/cm$^2$ at ~1.2 V (FIG. 32B). Instead of KCl, when KI is used as a source of potassium ions, the $C_{2+}$ FE is improved to ~48% (~33% toward $C_2H_4$, ~14% toward $C_2H_5OH$ and ~1% $CH_3COOH$) (FIG. 33A) with a total current density of ~345 mA/cm$^2$ at ~1.1 V (FIG. 33B). Overall, the present SF-Cu catalyst shows higher FEs toward $C_2H_4$ and $C_{2+}$ for $ECO_2R$ than any conventional acidic system such as that disclosed in Huang et al. (2021) (Table 2), due to an improved catalyst structure and morphology in the present SF-Cu catalyst.

TABLE 2

| Catalyst | Electrolyte | Potential (V vs. RHE) | $j_{C2H4}$ (mA/cm$^2$) | $C_2H_4$ Faradaic Efficiency | $j_{C2+}$ (mA/cm$^2$) | Total $C_{2+}$ Product Faradaic Efficiency | Stability (h) | Ref. |
|---|---|---|---|---|---|---|---|---|
| SF-Cu in the flow cell (Present Invention) | 1M KOH | ~−0.58 | ~569 | ~80% | ~607 | ~85.48% | <1 | — |
| | 1M $H_3PO_4$ + 3 M KI// 1M $H_3PO_4$ | ~−1.1 | ~114 | ~33% | ~167 | ~48.57% | <4 | |
| | 1M $H_3PO_4$ + 3M KCl//1M $H_3PO_4$ | ~−1.2 | ~101 | ~28% | ~147 | ~40.71% | — | |
| SF-Cu in single MEA cell (Present Invention) | 1M KOH | ~3.2 Cell Voltage | ~134 | ~40% | ~196 | ~58.85% | <4 | |
| | Pure $H_2O$ | ~4.3 Cell Voltage | ~129 | ~43% | ~155 | ~51.58% | — | |
| MEA cell stack: 6 MEA Cells (Present Invention) | Pure $H_2O$ | ~25 Cell Voltage | ~167 | ~50% | — | — | >1000 | |
| $Cu_2S$/Cu-V (Cu-Vacancy) | 1M KOH | −0.93 | ~84.8 | 21.20% | ~223.2 | 55.80% | — | Zhuang et al. (2018) |
| Cu nanoparticles | 1M KOH | −0.79 | ~140 | 45.60% | ~215 | 70% | 4 | Ma et al. (2016) |
| Cu-DAT wires | 1M KOH | −0.6 | ~75 | 38.20% | ~137.83 | 70.20% | — | Hoang et al. (2017) |
| Cu dimer distorted HKUST-1 | 1M KOH | −1.07 | 262 | 45% | N/A | N/A | ~138 | Nam et al. (2018) |
| Nanoporous Cu | 1M KOH | −0.67 | 256 | 38.60% | 411 | 62% | ~2.1 | Lv et al. (2018) |
| CuAg wire Alloys | 1M KOH | −0.68 | 172 | 55.20% | 265 | 85.10% | — | Hoang et al. (2018) |
| Cu wires | 1M KOH | −0.6 | ~74 | 38.20% | ~137 | 70.20% | — | |
| $Ag_{0.14}/Cu_{0.86}$ | 1M KOH | −0.67 | 80 | ~32% | 195 | a. 78% | ~2 | Li et al. (2019) |
| | 1M $KHCO_3$ | −0.84 | 75 | ~25% | 210 | a. 70% | — | |
| Graphite/ $CNP_S$/Cu/PT FE | 7M KOH | −0.55 | 55-70 | ~70% | 60-81 | ~81% | 150 | Dinh et al. (2018) |
| 25 nm Cu | 3.5M KOH + 5M KI | −0.67 | ~473 | ~65% | ~608 | ~81% | — | |
| 25 nm Cu | 10M KOH | −0.54 | 219 | 66% | 275 | 83% | <0.5 | |
| $Cu_4O_3$-rich catalyst | 0.5 m $Cs_2SO_4$// 2.5M KOH | −0.59 | 126 | 42.30% | 183.9 | 61.30% | 24 | Martić et al. (2019) |
| $Cu_2O$ films | 1.0M KOH | −0.74 | 122 | 67% | — | — | <0.6 | Anastasia dou et al. (2019) |

TABLE 2-continued

Figure 6A:
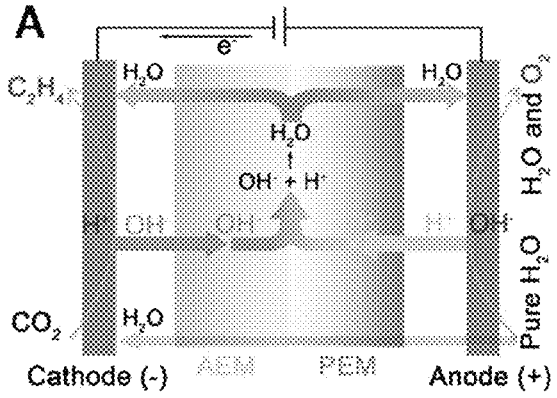
FIG. 6A schematically depicts reaction scheme of $ECO_2R$ in the pure-$H_2O$-fed MEA cell assembled with AEM and PEM according to certain embodiments of the present invention.
Figure 34:
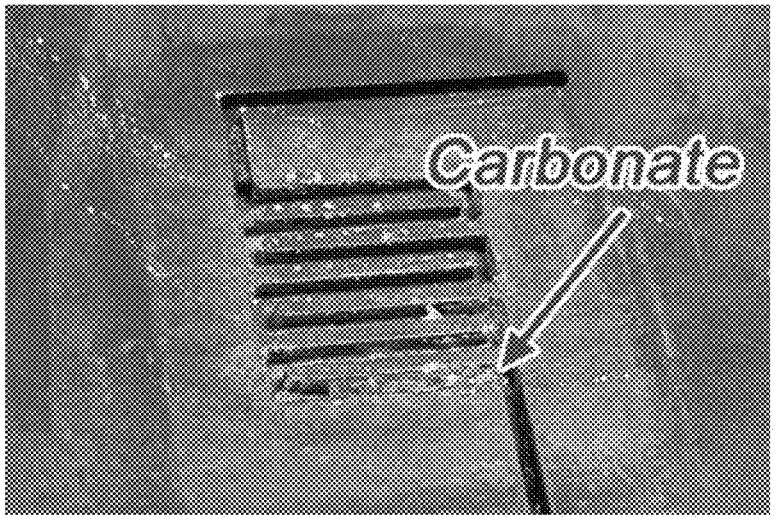
FIG. 34 shows a digital photograph of the flow channel after the $ECO_2R$ reaction on SF-Cu for ~10 min in an MEA cell with 1 M $H_3PO_4$ containing 3 M $KNO_3$ as the anolyte.

| Catalyst | Electrolyte | Potential (V vs. RHE) | $j_{C2H4}$ (mA/cm$^2$) | $C_2H_4$ Faradaic Efficiency | $j_{C2+}$ (mA/cm$^2$) | Total $C_{2+}$ Product Faradaic Efficiency | Stability (h) | Ref. |
|---|---|---|---|---|---|---|---|---|
| Cu-F | 0.75M KOH | −0.89 | 1040 | 65% | 1280 | 80% | — | Ma et al. (2020) |
| | 1.0M KOH | −0.75 | 720 | ~60% | 996 | ~83% | — | |
| | 2.5M KOH | −0.54 | 480 | 60% | 672 | 84% | — | |
| C/De-alloyed Cu-A1/PTFE | 1.0M KOH | ~−1.5 | 320 | 80% | — | — | 50 | Zhong et al. (2020) |
| Surface Reconstructed Cu | 3M KOH | −0.68 | — | — | 336 | 84% | — | Kibria et al. (2018) |
| Tetrahydro-bipyridine-functionalized Cu | 1.0M $KHCO_3$ | −0.83 | 230 | 72% | ~261 | ~82% | — | Li et al. (2020) |
| MEA | 0.1M $KHCO_3$ | b. 3.65/5 Cell Voltage | b. 384/5 | 64% | — | — | 195 | |
| Ionomer-coated Cu | 7M KOH | −0.91 | 930 | 60% | 1210 | ~92% | — | Arquer et al. (2020) |
| MEA | 0.1M $KHCO_3$ | b. 3.9/x Cell Voltage | b. 550/x | ~55% | — | — | 60 | |
| Cu (100) | 7M KOH | −0.67 | 217 | ~70% | 280 | 90% | — | Wang et al. (2020) |
| MEA | 0.15M $KHCO_3$ | b. 3.7/5 Cell Voltage | b. 192/5 | ~60% | — | — | 70 | |
| Polyamine-incorporated Cu | 1M KOH | −0.97 | 311 | 72% | 389 | 90% | <3 | Chen et al. (2021) |
| | 5M KOH | −0.62 | c. — | 84% | — | — | — | |
| | 10M KOH | 0.47 | ~28 | 87% | — | — | — | |
| 0.8:0.2Cu/Ag | 1M KOH | −0.72 | 159 | 48.1% | 287 | 87% | 100 | She et al. (2020) |
| MEA-0.8:0.2Cu/Ag | 0.5M KOH | b. 3/1 | b. 106/1 | 48% | b. 136/1 | 62% | 150 | |
| 0.8:0.1Cu/Ni—N—C | 1M KOH | −0.70 | 196 | 45% | 327 | 75% | — | |
| Cu/CAL | 1M $H_3PO_4$ + 3M KCl//1M $H_3PO_4$ | ~−1.34 | 276 | ~23% | 480 | 40% | 12.5 | Huang et al. (2021) |

a. A few percent of the propanol is not calculated.
b. The denominator is the area of the electrode.
x. The area of the electrode is not specified.
c. The current density is not missing.
—. N/A Considering the practical viability, an industrially more applicable MEA cell is initially assembled with Nafion membrane in acidic media to perform the $ECO_2R$ reaction. To enrich $K^+$ on the SF-Cu surface, 1 M $H_3PO_4$ containing 3 M $KNO_3$ is used as the anolyte. $K^+$ and $H^+/H_3O^+$ in the anolyte would pass through the Nafion membrane to the SF-Cu surface under the electric field. In principle, $K^+$ would promote $ECO_2R$ while $H^+/H_3O^+$ would serve as the proton source. Although some $ECO_2R$ products such as CO and $C_2H_4$ are formed during this initial testing, the $ECO_2R$ reaction is shut down after a few minutes, and hydrogen evolution reaction (HER) became dominant. It is due to a continuous $K^+$ flow from anode to cathode causing severe carbonate precipitation in the flow channel, which blocks $CO_2$ transport (FIG. 34). To solve this problem, pure water is used as the electrolyte for $ECO_2R$ reaction in the present MEA cell. One of the main problems of using MEA electrolyzer is how to maintain high local pH on the cathode catalyst's surface for efficient $ECO_2R$ reaction. When pure water is used as an electrolyte, PEM is employed for $H^+/H_3O^+$ transfer from the anode, and AEM is added between the cathode and PEM (FIG. 6A). Under a forward bias mode, $H_2O$ as the proton source will participate in the $ECO_2R$ reaction at the cathode, and it will be oxidized into $O_2$ at the anode (FIG. 6C). The remaining $OH^-$ at the cathode and $H^+$ at the anode will transport through AEM and PEM, respectively, forming $H_2O$ at the interface of AEM and PEM (Eq. 3-5), which can effectively increase the local pH on the surface of the cathode catalyst. Although a small amount of $CO_2$ can dissolve in pure $H_2O$ to form $H_2CO_3$ (Eq. 6), the alkaline AEM and acidic PEM will effectively suppress $H_2CO_3$ formation and shift the equilibrium reaction to the left.

$$\text{Cathode: } 2CO_2+8H_2O+12e^- \rightarrow C_2H_4+12OH^- \quad (3)$$

$$\text{Anode: } 6H_2O \rightarrow 3O_2+12H^++12e^- \quad (4)$$

At the interface: $12OH^- + 12H^+ \rightarrow 12H_2O$ (5)

$CO_2$ dissolution: $CO_2 + H_2O \rightleftharpoons H_2CO_3$ (6)

Moreover, due to the absence of cations at the cathode to maintain the electrical neutrality of pure water, $CO_2$ cannot react with the electrogenerated $OH^-$ to form carbonate and there will be no carbonate crossover problem. $H_2O$ can pass through both AEM and PEM. Thus, $H_2O$ as the proton source is sufficient for the cathodic reduction reaction.

In certain embodiments, when the total cathode electrode area is about 30 $cm^2$, the flow rate of the $CO_2$ inlet will be about 30 sccm.

In certain embodiments, all $ECO_2R$ reactions are conducted at a reaction temperature of about 60° C., and Ti fiber felt sputtered by Pt (Pt/Ti) is selected as the anode electrode.

In certain embodiments, Sustainion X37-50 is selected as AEM, and Nafion 117 is selected as PEM for electrogenerated $OH^-$ and $H^+$ ion exchange membranes, respectively.

In other embodiments, bipolar membrane can be used as the AEM/PEM.

Preferably, Sustainion X37-50 and Nafion 117 are respectively selected as AEM and PEM over bipolar membrane in assembling the present MEA cell system.

In certain embodiments, the present MEA cell system includes a cathode selected from SF-Cu GDE and an anode selected from Ti fiber felt sputtered by Pt (Pt/Ti), where between the cathode and anode there is a combination of the AEM and PEM separating the cathode from the anode such that the cathode is in contact with the AEM while the anode is in contact with the PEM.

To lower the pure $H_2O$ activation overpotential, the $ECO_2R$ reaction on the SF-Cu in the present MEA cell is carried out at a temperature not to suppress $ECO_2R$ and make HER dominant under a galvanostatic mode. In certain embodiments, the temperature sufficient to induce $ECO_2R$ and not to make HER dominant under the galvanostatic mode is about 60° C. (FIG. 6B).

Figure 6B:
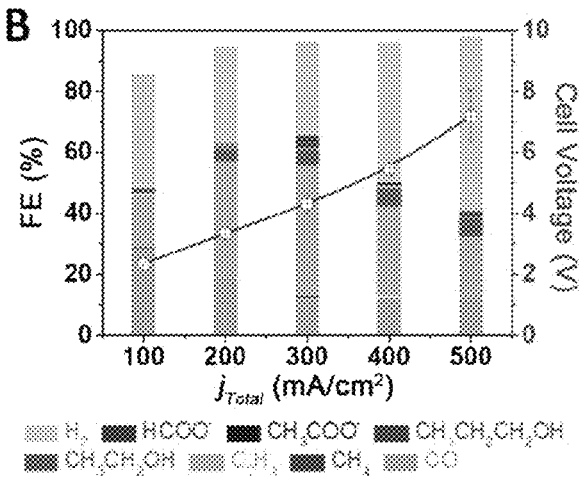
FIG. 6B shows FEs toward $ECO_2R$ products under a range of applied current densities in the MEA cell with pure $H_2O$ as the electrolyte, and the corresponding cell voltages without iR compensation; Pt/Ti is used as the anode electrode and the reaction temperature is set at 60° C.
Figure 6C:
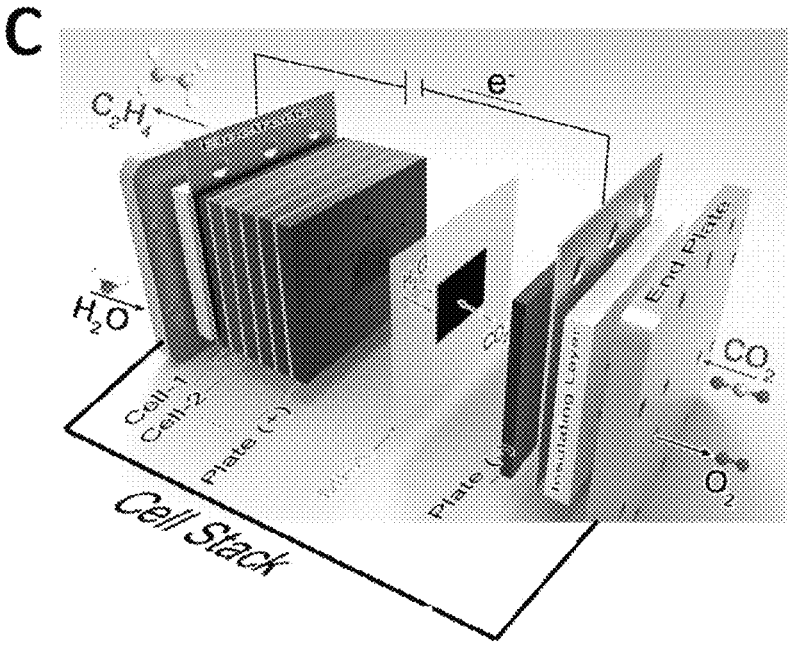
FIG. 6C schematically depicts the MEA-cell stack containing 6 MEA cells for $ECO_2R$ reaction according to certain embodiments of the present invention.
Figure 35:
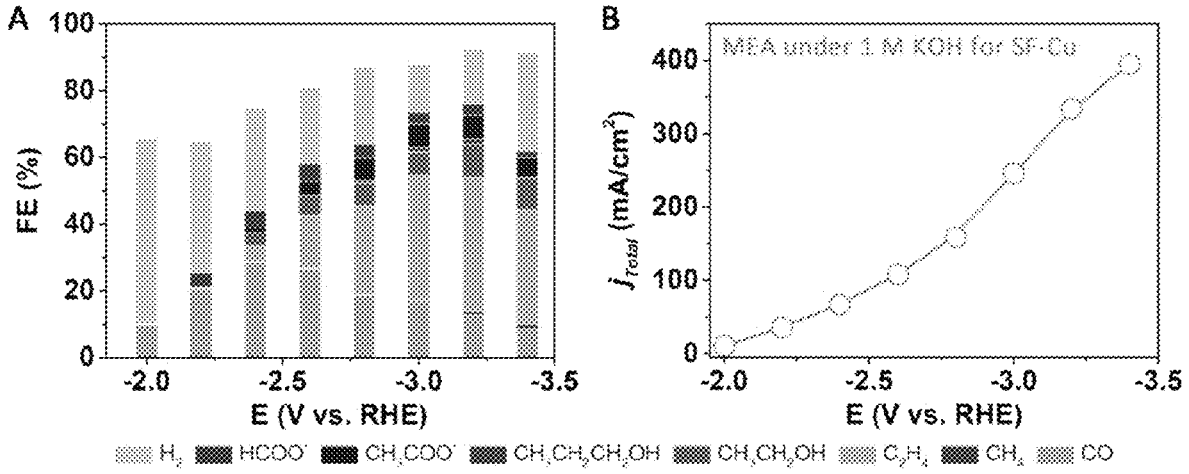
FIG. 35 shows $ECO_2R$ performance on SF-Cu in an MEA cell with 1 M KOH as the anolyte: (A) FEs toward $ECO_2R$ products under a range of applied potentials; (B) corresponding total current density under a range of applied potentials.
Figure 36:
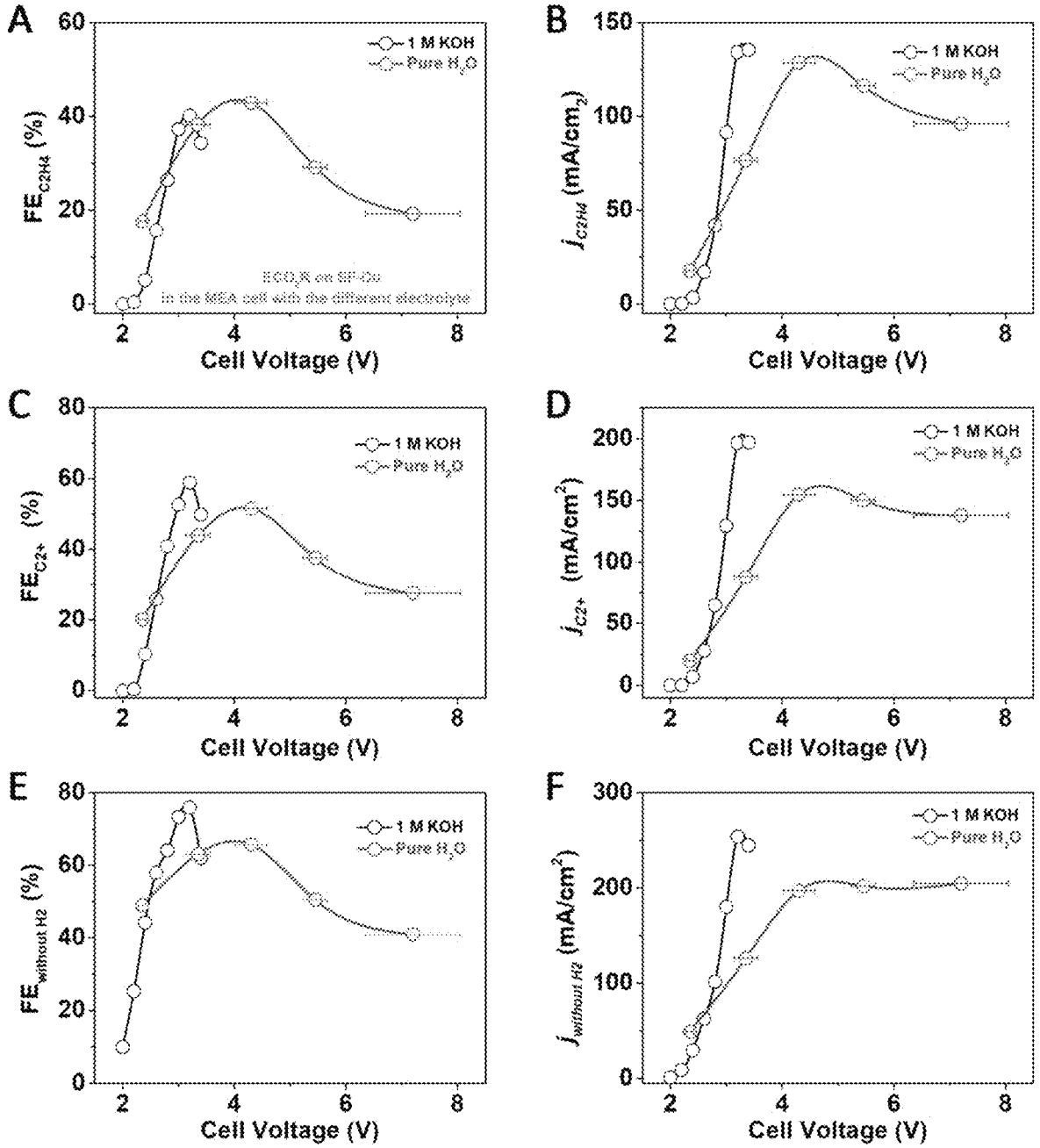
FIG. 36 shows comparisons of the $ECO_2R$ performance on SF-Cu in an MEA cell with 1 M KOH/pure $H_2O$ as the anolyte under a range of applied potentials: (A, C and E) show comparisons of FEs toward $C_2H_4$, $C_{2+}$, and all $ECO_2R$ products, respectively; (B, D and F) show comparisons of partial current densities of $C_2H_4$, $C_{2+}$, and all $ECO_2R$ products, respectively; the reaction temperature of the $ECO_2R$ reaction under pure $H_2O$ is 60° C. and other $ECO_2R$ reactions are carried out at room temperature.

In FIG. 6B, at a total current density of 300 mA/$cm^2$, the $ECO_2R$ selectivity reaches the peak up to ~66% FE, including ~52% FE toward $C_{2+}$ ($C_2H_4$ FE of ~43%, $C_2H_5OH$ FE of ~6%, $CH_3CH_2CH_2OH$ FE of 2% and $CH_3COOH$ FE of ~1%). The cell voltage is ~4.3 V without iR compensation. Without counting the energy consumed by the reaction temperature, the proposed pure-$H_2O$-fed MEA-cell architecture delivers a full-cell energy efficiency ($EE_{full\text{-}cell}$) of ~18.2%. The product analysis shows that the peak FEs and partial current densities of $ECO_2R$ products in the proposed pure-$H_2O$-fed MEA system are even comparable to those in the MEA cell with 1 M KOH (FIGS. 35 and 36). The pure-$H_2O$-fed MEA cell can circumvent the theoretical-$CO_2$-utilization limit for the $ECO_2R$ reaction by thoroughly eliminating the carbonate formation and crossover.

Figure 6D:
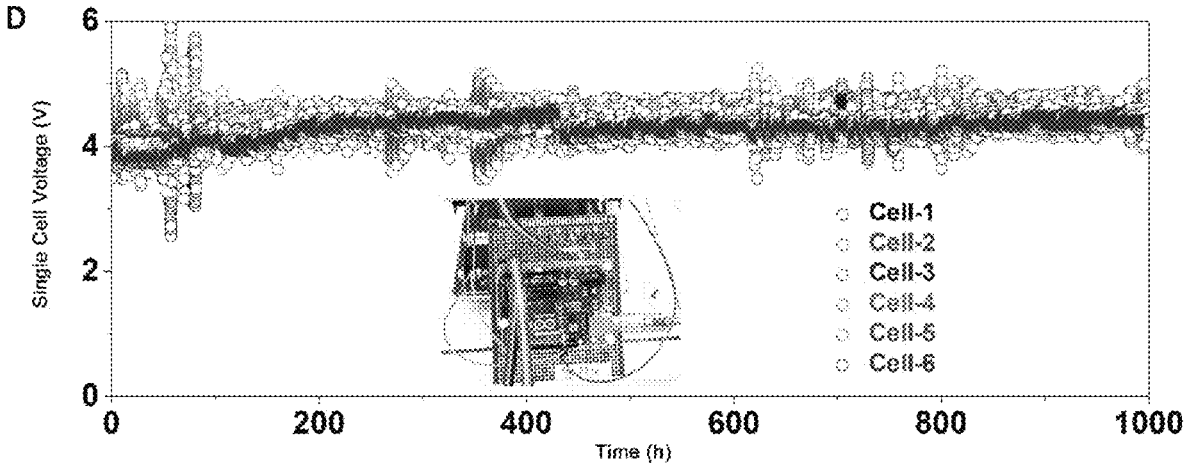
FIG. 6D shows stability monitoring of the MEA-cell stack containing 6 MEA cells at a constant current of 10 A according to certain embodiments of the present invention, where an inset shows a digital photograph of the monitoring system.
Figure 37:
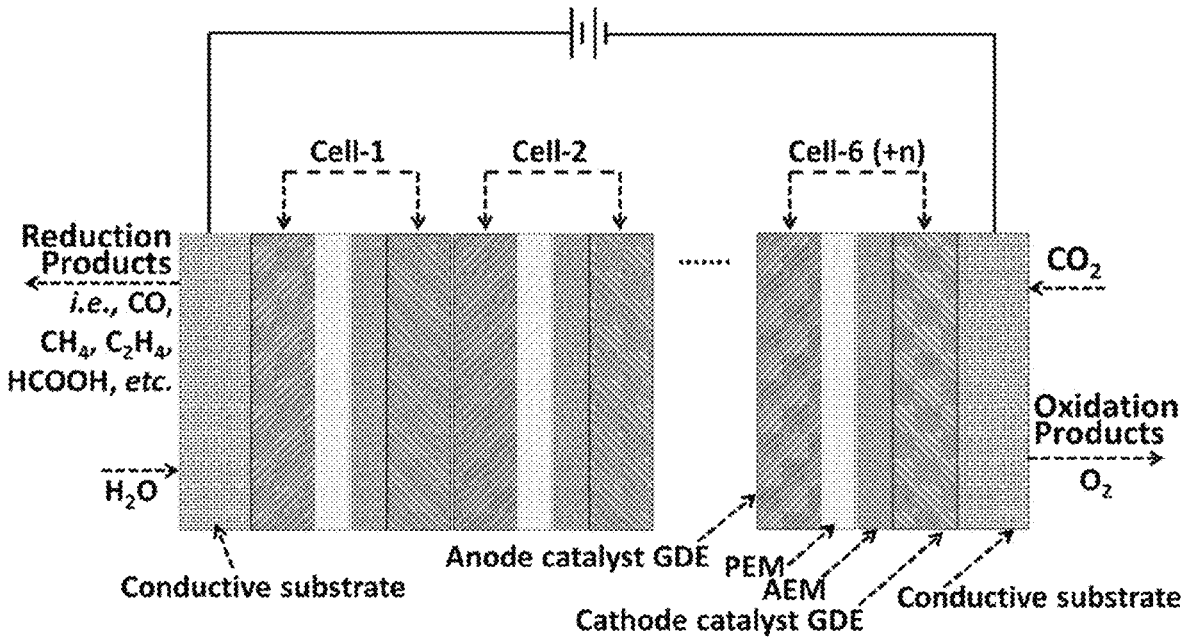
FIG. 37 schematically depicts the MEA-cell stack containing 6 repeating MEA cells for performing the $ECO_2R$ reaction according to certain embodiments of the present invention.
Figure 38:
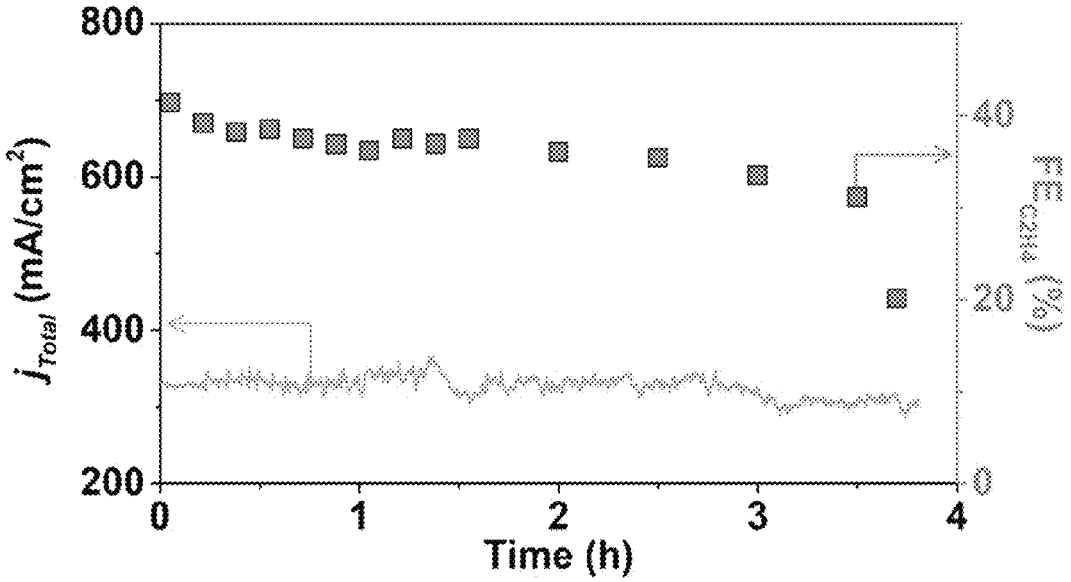
FIG. 38 shows stability performance of $ECO_2R$-to-$C_2H_4$ on SF-Cu in an MEA cell with 1 M KOH as the anolyte at 3.2 V cell voltage according to certain embodiments of the present invention.

In view of the superior $ECO_2R$ performance on SF-Cu in the proposed pure-$H_2O$-fed MEA cell system, an MEA-cell stack system containing 6 MEA cells (FIGS. 6C and 37) is assembled and tested to evaluate its durability and practicality. At a total current of 10 A, six sets of SF-Cu GDEs with a total geometrical area of 30 $cm^2$ deliver a FE of ~50% toward $C_2H_4$ (FIG. 1B). The 6-MEA cell stack system can remain stable for more than 1000 hours with a full-cell-stack voltage between 25 and 27 V without iR compensation (~4.4 V cell voltage for each set of the 6 MEA cells as shown in FIG. 6D). In contrast, the stability of $ECO_2R$ on SF-Cu in an MEA cell with the alkaline condition is even less than 4 h (FIG. 38). The 6-MEA cell stack system can deliver up to ~39% $CO_2$-to-$C_2H_4$ conversion, and no GDE flooding is observed after 1000-h operation. This significant difference in performance might be due to an elevated reaction temperature (~60° C.) which allows a small amount of accumulated $H_2O$ on the GDEs to be discharged more quickly along with the steam.

In certain embodiments, the pure-$H_2O$-fed MEA-cell stack system is further incorporated with an integrated circuit for monitoring $ECO_2R$ reaction, e.g., Arduino development, an inset in FIG. 6D. Each cell in the system shows an almost identical voltage throughout the 1000-h measurement, except for some fluctuations at the first 100 h, demonstrating the possibility of the MEA-cell stack for the stable $ECO_2R$ at the industrial level.

Figure 39:
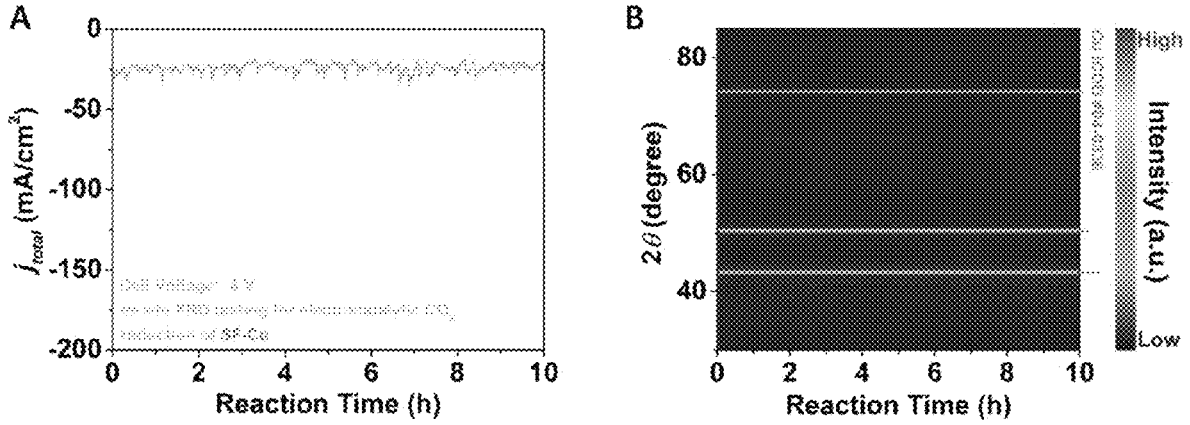
FIG. 39 shows in-situ XRD measurement on SF-Cu for the $ECO_2R$ reaction in 0.1 M KOH at the 4 V cell voltage for 10 h: (A) Total current density; (B) In-situ XRD patterns, corresponding to FIG. 39A)
Figure 40:
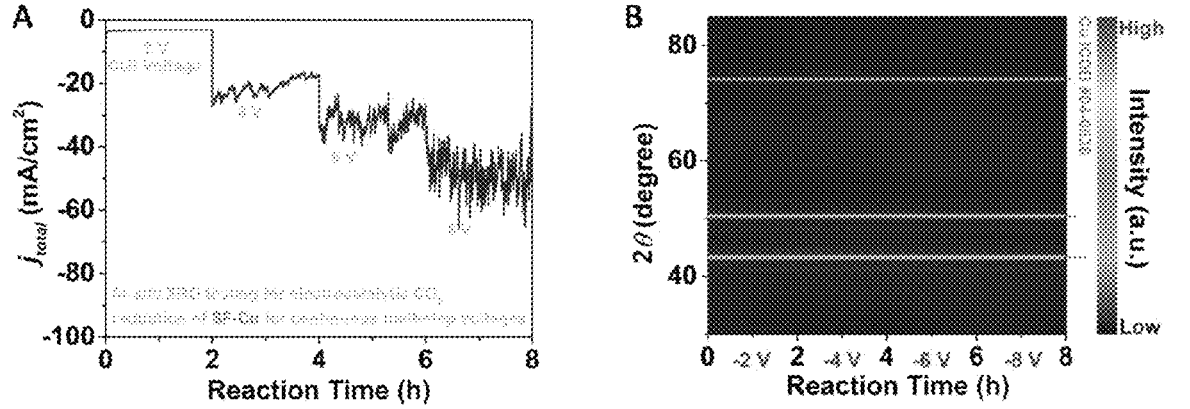
FIG. 40 shows in-situ XRD measurement on SF-Cu for the $ECO_2R$ reaction in 0.1 M KOH at the stepped cell voltages for 8 h: (A) Total current density; (B) In-situ XRD patterns, corresponding to FIG. 40(A)

Additionally, in-situ X-ray diffraction (XRD) measurements in a flow cell with a two-electrode system to assess the stability of the SF-Cu catalyst are performed, and the results are shown in FIG. 39. The crystal structure of SF-Cu is proved to be stable during the $ECO_2R$ reaction at different cell voltages (FIGS. 39 and 40). In conclusion, an overall $ECO_2R$-to-$C_2H_4$ performance of SF-Cu in the flow cell, MEA cell and MEA-cell stack, outperforms the most reported alkaline, neutral and acidic $ECO_2R$ performance in other conventional systems (FIG. 1A and Table 2). More importantly, the stability of more than 1000 h of the pure-$H_2O$-fed MEA system will render the $ECO_2R$ technology a step forward to the industrial level.

Turning to FIGS. 41-48, outstanding $ECO_2R$ to $C_2H_4$ performances of SF-Cu and $ECO_2R$ reaction pathway are demonstrated by density functional theory (DFT) calculations and in-situ and ex-situ measurements, where the SF-Cu in the pure $H_2O$ system is shown to attribute to the combination of this new electrolysis architecture with a superior catalytic activity due to the low CN and high tensile strain of the SF-Cu.

In the present disclosure, DFT calculations are performed on the perfect Cu (111) and SF-Cu (111) models to reveal the outstanding $ECO_2R$ to $C_2H_4$ performance of SF-Cu. To amplify the impact trend from CN and tensile strain, the unit cell of the SF-Cu model is expanded with a factor of 1.1, meaning 10% tensile strain, and CN of the SF-Cu model is set to 7. The reaction energy of $CO_2$-to-*COOH at the SF-Cu surface is 0.39 eV (FIG. 42), much lower than that of the perfect Cu (0.75 eV). Subsequently, the *COOH could be easily converted into *CO due to the negative reaction energies for the perfect Cu and SF-Cu model. As described herein, the *CO intermediate for the $ECO_2R$ on SF-Cu is observed by in-situ Raman measurements at different potentials (FIGS. 41A and 43-45). The peaks located in the range of 270-360 $cm^{-1}$ are related to the Cu—CO frustrated rotation and Cu—CO stretch. The peaks at the 1900-2200 $cm^{-1}$ can be ascribed to the C≡O stretch of the surface-absorbed CO, including atop-bound CO and bridge-bound CO. The vibration of C—H is also observed in the region from 2700 to 3000 $cm^{-1}$, which can be derived from hydrogenated intermediates (such as *CHO, *COCHO, etc.). A more precise assignment of these peaks is highly challenging due to the complexity of hydrogenated intermediates of $ECO_2R$.

Figure 47:
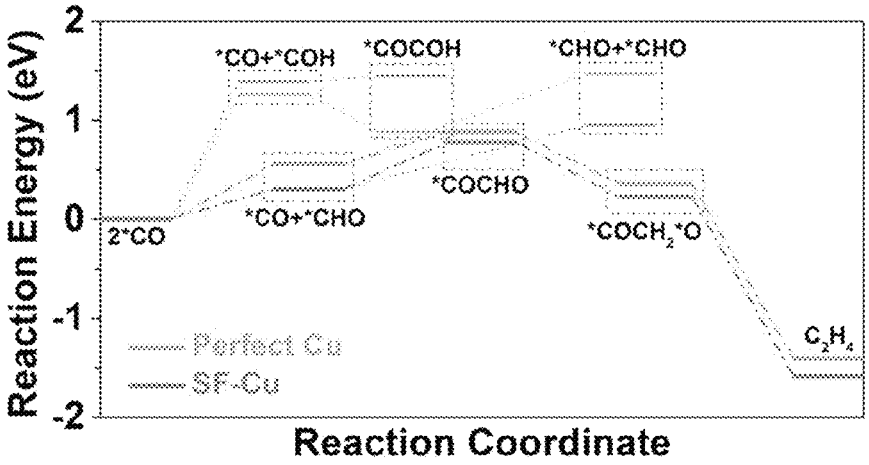
FIG. 47 shows a comparison in reaction energy for the $ECO_2R$ on the perfect Cu and SF-Cu models via the direct *CO hydrogenation to *CHO followed by the unoccupied *CO and the *CHO dimerization pathway versus the direct *CO hydrogenation to *COH followed by the unoccupied *CO and the *COH dimerization pathway versus 2*CO hydrogenation to 2*CHO followed by *CHO dimerization pathway.

The general assumption is that C—C coupling starts with *CO. The subsequent dimerization reaction, however, is not verified. If the *CO dimerization to *OCCO is considered the main pathway for C—C coupling, $j_{C2H4}/j_{C2+}$ (productivity) of the electrocatalytic CO reduction (ECOR) to $C_2H_4/C_{2+}$ on SF-Cu should be higher than that of $ECO_2R$-to-$C_2H_4/C_{2+}$. To verify this assumption, direct *CO dimerization is demonstrated by carrying out an ECOR on SF-Cu due to the high CO coverage. If the assumption is verified, one would expect the FE towards $C_2H_4/C_{2+}$ be higher than $ECO_2R$. Interestingly, SF-Cu shows a lower $j_{C2H4}/j_{C2+}$ for the direct ECOR (FIGS. 41B, 41C and 46), indicating that the *CO dimerization to *OCCO may not be the main C—C coupling pathway for the $ECO_2R$ on SF-Cu. Then, two hydrogenation paths of *CO (*CO-to-*CHO and *CO-to-*COH) are calculated (FIG. 47). The *CO-to-*CHO hydrogenation has less reaction energy than that of *CO-to-*COH. FIG. 41D shows that SF-Cu decreases the reaction energy of *CO-to-*CHO hydrogenation from 0.56 to 0.30 eV (FIG. 41D). Thus, two possible pathways are proposed in the present disclosure, which are, the unoccupied *CO hydrogenation into *CHO to form 2*CHO (*CHO+*CHO) and the direct coupling of the unoccupied *CO and *CHO to form *COCHO. High uphill reaction energy is required to form two *CHO on the perfect Cu and SF-Cu (FIG. 47), which indicates that C—C coupling by *CHO dimerization is not favorable. In contrast, the coupling of *CO and *CHO requires lower reaction energy, and the reaction energy of the coupling of *CO and *CHO to form *COCHO at the SF-Cu surface (0.77 eV) is less than that of the perfect Cu (0.88 eV). The subsequent hydrogenation of *COCHO-to-*$COCH_2O$ is exergonic for the perfect Cu and SF-Cu. Hence, the hydrogenation of *CO-to-*CHO followed by the subsequent coupling of the unoccupied *CO and *CHO to *COCHO to *$COCH_2O$ should be the most favorable pathway for the $C_2H_4$ formation. The DFT results show that SF-Cu would electrocatalyze $CO_2$ reduction to $C_2H_4$ more easily than the perfect Cu from the thermodynamics.

Figure 48:
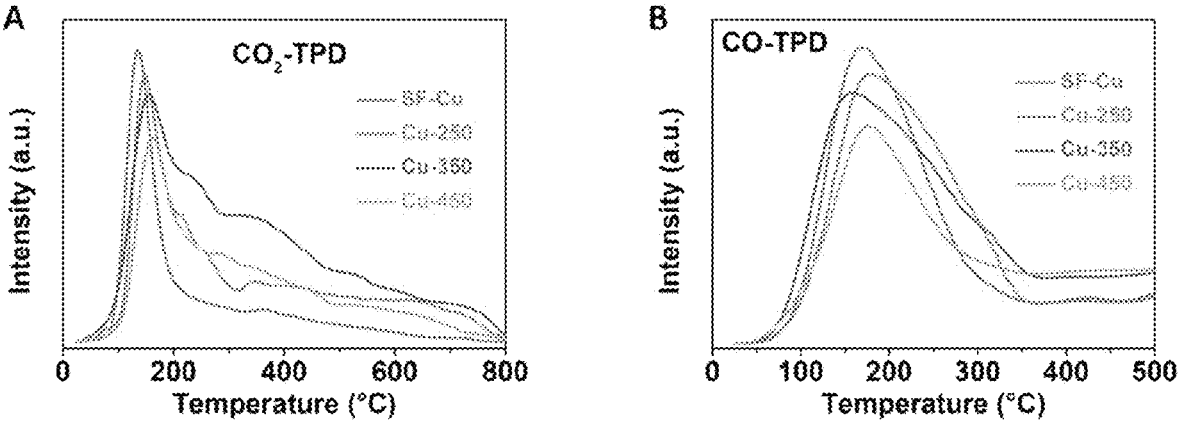
FIG. 48 shows temperature-programmed desorption (TPD) of (A) $CO_2$ and (B) CO on SF-Cu, Cu-250, Cu-350 and Cu-450.

In addition, temperature-programmed desorption (TPD) measurements of $CO_2$ and CO show that the $CO_2$/CO adsorption capacities of samples decrease with an increase in treatment temperature of samples (SF-Cu>Cu-250>Cu-350>Cu-450) (FIG. 48). The surface Cu atoms with the lower CNs tend to bond/adsorb more $CO_2$/CO to compensate for the lack of coordination, which would accelerate $ECO_2R$ reaction kinetics. It is believed that the above thermodynamic and kinetic advantages are ascribed to the effects of the low CN and high tensile strain of SF-Cu.

In accordance with various embodiments of the present invention, it is evident that the abundant stacking faults and grain boundaries correlate to the low CNs and high tensile strain in SF-Cu, creating high-energy active surfaces for $ECO_2R$ to $C_2H_4$. It suggests a linkage of the lower CN and higher tensile strain with the higher $ECO_2R$ activity. Based on the present SF-Cu and proposed MEA electrolysis architecture, the $ECO_2R$ reaction is efficiently performed under pure water, eliminating the carbonate formation and crossover, and thus circumventing the $CO_2$ utilization limit and prolonging the $ECO_2R$ system stability. In addition, the scale-up of $ECO_2R$ on SF-Cu in a pure-$H_2O$-fed MEA-cell stack is demonstrated. FE up to 50% towards $C_2H_4$ is achieved with $CO_2$-to-$C_2H_4$ conversion of ~39% at a total current of 10 A, with a system stability in terms of constant output over 1000 h. In certain embodiments, to further enhance energy efficiency of the system, selectivity of products can be improved and operating voltage thereof may be decreased. It is believed that pure-$H_2O$-fed $ECO_2R$-to-$C_2H_4$ in the proposed MEA architecture injects new vitality into the $ECO_2R$ technology.

EXAMPLES (A) Chemicals

Deuterium oxide ($D_2O$, 99.9 at. % D, 151882), 3-(Trimethylsilyl)propionic-2,2,3,3-d4 acid sodium salt (TSP, ≥98.0% (NMR), 269913), Nafion™ solution (5 wt. %, 274704), Polytetrafluoroethylene preparation (PTFE solution, 60% in $H_2O$, 665800), Oleylamine (70%, O7805), Copper(I) chloride (CuCl, 97%, 212946), n-hexane ($C_6H_{14}$, 99%, HX0293), Octadecylamine (≥99%, 305391), Trioctylphosphine (90%, 117854), squalane (96%, 234311), Potassium hydroxide (KOH, 99.99%, 306568), Phosphoric acid ($H_3PO_4$, 85%, 345245), Potassium nitrate ($KNO_3$, 99.0%, 221295), Lead(II) nitrate ($Pb(NO_3)_2$, ≥99%, 228621), Potassium iodide (KI, 99%, 221945) and Potassium chloride (KCl, 99.0-100.5%, P3911) were purchased from Sigma Aldrich. Potassium hydroxide (KOH, >85.0%), Nickel foam (2 mm thickness, 99.9%), and Titanium fiber felt (0.25 mm thickness, 99.9%) were purchased from Sinopharm Chemical Reagent Co., Ltd. (China). Nitric Acid ($HNO_3$, pH=−1.0, 70%, A200), and Isopropanol ($C_3H_8O$, IPA, >99.5%, 3776) were purchased from Fisher Scientific. The anion exchange membrane (Fumasep FAA-3-PK-75), gas diffusion layer (carbon paper, GDE, Sigracet 39 BB), and Nafion® 117 membrane (591239) were purchased from FuelCellStore. The alkaline ionomer solution (5% in ethanol, Sustainion XA-9) and anion exchange membrane (Sustainion X37-50) were purchased from Dioxide Materials.

(B) Catalysts Preparation

In a typical synthesis, 0.05 g of CuCl and 0.1 g of octadecylamine were dissolved in 1 mL of squalane at 80° C. under the Ar atmosphere and kept this temperature for 0.5 h to form the Cu-based stock solution. 10 mL of oleylamine and 0.5 mL of trioctylphosphine were added to a flask and heated to 200° C. under the Ar atmosphere with intense magnetic agitation. Then, the Cu-based stock solution was quickly injected into the above 200° C. oleylamine solution and kept at this temperature for 5 h. After natural cooling, the resulting sample was collected by centrifugation and washed several times with n-hexane. Finally, the sample was blown dried with Ar gas at room temperature. Due to the stepped-facet surface, the sample was denoted as SF-Cu.

To study the structure-activity relationship of SF-Cu for the electrocatalytic $CO_2$ reduction, the SF-Cu samples were annealed at various temperatures (250, 350, and 450° C.; Cu-250, Cu-350, and Cu-450) in the tube furnace for 2 h under a mixed gas ($H_2$/Ar: 5 v/v %; 200 seem (standard cubic centimeters per minute)) to prevent oxidization. In addition, the oxide-derived Cu was prepared by directly calcining SF-Cu at 450° C. in the air for 2 h.

(C) GDEs Fabrication

For the flow cell and MEA cell measurements under the alkaline condition: Cathode GDEs were prepared on conventional carbon paper. The catalyst was dispersed in a mixed solution containing $H_2O$, IPA (1:4 v/v) and some alkaline ionomer solution (5 wt. % vs. catalyst, Sustainion XA-9) by the sonication for 1 h to form a 1 mg/mL catalyst ink. GDEs were fabricated by spraying the ink onto the carbon paper with a microporous carbon gas diffusion layer with the loading of ~1 mg/cm$^2$, followed by drying at 120° C. in a vacuum for 1 h before use (SF-Cu GDE). Anode electrode was the mixture of $IrO_x$ and $RuO_x$ supported carbon paper.

For the flow cell and MEA cell measurements under the acidic condition: The alkaline ionomer was replaced with Nafion™ solution. PMMA containing PTFE solution was spray-coated on the SF-Cu GDE as the cathode GDE (SF-Cu/PMMA), and the mixture of Pt-supported Ti fiber felt (Pt/Ti) was used as the anode electrode. Pt was sputtered on the Ti fiber felt using a pure Pt target in an Ar environment ($5\times10^{-3}$ Torr) in a magnetron sputtering system.

For MEA measurements under pure $H_2O$, the SF-Cu GDE and Pt/Ti GDE were directly used as the cathode and anode electrodes, respectively.

(D) Electrocatalytic $CO_2$/CO Reduction

Electrochemical tests in the flow cell and MEA cell were performed using an electrochemical workstation (CHI 660E) connected to a current booster (CHI 680C), except for the MEA-cell stack. The mass flow controller (MFC, Alicate Scientific MC) was used to control the $CO_2$ flow rate. The flow rate of the electrolyte stream was 5 mL/min controlled by a peristaltic pump unless otherwise noted. The area of the cathode in the flow cell and MEA was 1 cm×1 cm unless otherwise noted. All $ECO_2R$ measurements were carried out at room temperature unless otherwise noted. For all flow cell measurements, the $Hg/Hg_2Cl_2$ (SCE, saturated KCl) was used as the reference electrode, and all cathode potentials (vs. $Hg/Hg_2Cl_2$) were converted to RHE scale via the following equation:

$$E_{(RHE)}=E_{(Hg/Hg_2Cl_2)}+0.241+0.0591\times pH+iR$$

where R is the resistance between the cathode and reference electrodes measured by electrochemical impedance spectroscopy (EIS) with a frequency range from $10^5$ Hz to 0.01 Hz at open circuit potential. For all MEA measurements, the full-cell voltages were directly presented without iR compensation.

Under the alkaline condition: For the flow cell measurements, 1 M KOH was used as the electrolyte, and the anion exchange membrane (AEM, Fumasep FAA-3-PK-75) was used to separate the catholyte and anolyte compartments. The $CO_2$/CO was supplied to the cathode at a flow rate of 30 sccm. For $ECO_2R$ in an MEA cell with the alkaline condition, 1 M KOH was used as the anolyte, the cathode and anode GDEs were separated by an AEM (Sustainion X37-50).

For scale-up MEA-cell stack measurements, an integrated circuit based on the Arduino development board (UNO R3, A000066) was used as an aided monitoring system connected with the CoolTerm serial port terminal application tool. All electrocatalytic $CO_2$ reduction measurements in the scale-up MEA-cell stack were carried out by the customized Varied DC power supply (1000 W). The flow rates of the anolyte and $CO_2$ were 15 mL/min and 30 sccm, respectively. The reaction temperature was 60°.

(E) Products Analysis

For both of the electrocatalytic $CO_2$ and CO reduction, the gas and liquid products were quantified by the gas chromatograph (GC, GC-2030, Shimadzu) and nuclear magnetic resonance (NMR, ECZ500R, 500 MHz, JEOL) spectroscopy. GC was equipped with two thermal conductivity detectors (TCD) for $H_2$, $O_2$, $N_2$, He, CO and $CO_2$ signals and a flame ionization detector (FID) for $CH_4$, $C_2H_4$ and $C_2H_6$ signals. GC was composed of packed columns of two Porapak-N, a Molecular sieve-13X, a Molecular sieve-5A, a Porapak-Q and an HP-PLOT AL/S column, and employed He (99.999%) and $N_2$ (99.999%) as the carrier gases. To calibrate the $CO_2$ flow rate at the outlet of the cell ($f_{CO2}$), He used as the internal standard was fed at 10 seem and mixed with the outlet gas stream of the cell before injecting to GC (20). The FEs of gas products were calculated by the following equation:

$$FE(\%) = N_x \times F \times m_x \times \frac{f_{CO_2}}{j_{total}} \times 100\%$$

where $N_x$ is the number of electrons transferred for the specific product (x), F is the Faradaic constant, $m_x$ is the molar fraction of the specific product (x) determined by GC, $f_{CO2}$ is the molar flow rate of the $CO_2$, and $j_{total}$ is the total current density.

The liquid products were analyzed by 500 M Hz $^1$H NMR spectroscopy (ECZ500R, JEOL) with water suppression. TSP and $D_2O$ were used as the reference standard and lock solvent, respectively. The FEs of liquid products were calculated by the following equation:

$$FE(\%) = N_x \times F \times \frac{C_x \times V_x}{Q_{total}} \times 100\%$$

where $N_x$ is the number of electrons transferred for the specific liquid product (x), F is the Faradaic constant, $C_x$ is the concentration of the specific liquid product (x) determined by $^1$H NMR, $V_x$ is the volume of the electrolyte, and $Q_{total}$ is the total charge.

The half-cell and full-cell energy efficiencies ($EE_{Half\text{-}cell}$ and $EE_{Full\text{-}cell}$) were calculated as the following equations (take oxygen evolution reaction (OER) as an example of the anode reaction and assume it to occur with an overpotential of 0 V, $E_{OER}^{\Theta}$=1.23 V vs. RHE)):

$$EE_{Half-cell}(\%) = \frac{(E_{OER}^{\theta} - E_x^{\theta}) \times FE_x}{E_{OER}^{\theta} - E_C} \times 100\% = \frac{(1.23 - E_x^{\theta}) \times FE_x}{1.23 - E_C} \times 100\%$$

$$EE_{Full-cell}(\%) = (E_{OER}^{\theta} - E_x^{\theta})/E_{Full-cell} \times FE_x \times 100\% = \frac{1.23 - E_x^{\theta}}{E_{Full-cell}} \times FE_x \times 100\%$$

where $E_{OER}^{\Theta}$ and $E_x^{\Theta}$ are the thermodynamic potentials (vs. RHE) for OER and the electrocatalytic $CO_2$ reduction to the product (x), respectively, $FE_x$ is the FE of the product (x), $E_C$ is the applied potentials at the cathode, and $E_{Full\text{-}cell}$ is the cell voltage of the MEA system.

$CO_2$ conversion was calculated by the following equations:

$$f_x = \frac{Q_{total} \times FE_x}{F \times N_x \times t \times A}$$

$$CO_2\text{Conversion}(\%) = (f_{CO} + f_{HCOO^-} + f_{CH_4} + 2f_{C_2H_4} + 2f_{C_2H_5OH} + 2f_{CH_3COO^-} + 3f_{1-C_3H_7OH}) \times \frac{A}{f_{CO_2}} \times 100\%$$

where $f_x$ is the molar rate of the product (x) formation, t is the electrolysis reaction time, and A is the geometric area of the electrode.

(F) In-Situ Electrochemical Raman Measurements

In-situ Raman measurements were carried out by a customized spectro-electrochemical flow cell fabricated with a sapphire window (the thickness of 0.15±0.02 mm) in front of the cathode GDE. The Ni felt was used as a counter electrode. The overall system was operated in a two-electrode setup. The electrolyte (0.1 M KOH) was pumped into a sapphire window at a constant flow rate of 5 mL/min by a peristaltic pump over the cathode GDE, and the thickness of the electrolyte level on the cathode surface was 1.5 mm. $CO_2$ was supplied to the back of the cathode GDE through the serpentine flow channel to guide the $CO_2$ at a flow rate of 30 seem controlled by an MFC (Alicate Scientific MC). Raman spectra were collected under the accumulation time of 4 s and accumulation number of 10 times by using a WITEC Confocal Raman microscope with an objective (50×) and a 633 nm laser. The cell voltage was applied in potentiostatic mode and recorded without iR compensation.

(G) In-Situ Electrochemical XRD Measurements

The customized spectro-electrochemical flow cell was employed to perform the in-situ XRD measurements operated in a two-electrode setup. Ni felt was used as a counter electrode, 0.1 M KOH was used as the electrolyte, and the $CO_2$ (30 sccm) was supplied to the back of the cathode GDE. The in-situ XRD patterns were collected on an X-ray diffractometer (Rigaku SmartLab 9 kW—Advance) using Cu Kα radiation (λ=1.5418 Å) at 45 kV and 200 mA. The single test time was about ~8 min in the range (2Θ) of 300 to 85°. The cell voltage was applied in potentiostatic mode and recorded without iR compensation.

(H) In-Situ Heating TEM Measurements

In-situ heating TEM measurements were performed on the JEOL Model JEM-2100F at 200 kV with a Fusion Select holder (Protochips) and a holey carbon-coated MEMS E-chip.

(I) Pb Underpotential Deposition Measurements

Relative populations of the exposed facets of Cu were probed using Pb underpotential deposition (Pb-UPD). Pb-UPD measurements were conducted in a three-electrode single-compartment cell. A graphite carbon rod and Ag/AgCl (3 M KCl) were used as the counter electrode and reference electrode, respectively. An L-type glassy-carbon electrode loaded the sample with a diameter of 3 mm was employed as the working electrode. An $N_2$-purged 0.1 M $KNO_3$ with 1 mM $Pb(NO_3)_2$ was added with $HNO_3$ to adjust the pH to 1, used as the electrolyte. Cyclic voltammetry (CV) with a sweep rate of 100 mV/s was used for measurements.

(J) Temperature-Programmed Desorption Measurements

Temperature-programmed desorption (TPD) measurements of $CO_2$ on samples were conducted with an adsorption/desorption system. In a typical experiment, 1 $cm^2$ GDE with the catalyst load of ~1 $mg/cm^2$ was ground into powder, the powder was placed in a U-shaped quartz microreactor. Next, the outlet of the U-shaped quartz microreactor was connected to GC (GC-2014, Shimadzu) with a TCD detector. Afterward, the $CO_2$ (40 sccm) was injected into the U-shaped quartz microreactor and kept flowing for 60 min, followed by flushing the sample using the He stream (40 sccm) until obtaining a stable baseline of GC. TPD measurements were then conducted from room temperature to 800/500° C. at a ramp rate of 10° C./min, and GC would detect the desorbed $CO_2$ from the sample surface.

(K) DFT Calculations

All DFT calculations were performed on Vienna ab initio simulation program (VASP). The generalized gradient approximation (GGA) with the Perdew Burke-Ernzerhof (PBE) exchange-correlation functional was adopted to describe the electronic exchange and correlation interactions with a cut-off energy of 500 eV. The energy convergence criteria was set to be $10^{-5}$ eV for self-consistent calculations, and the lattice parameters were optimized until the convergence tolerance of force on each atom was smaller than 0.05 eV. The 4×4×1 Monkhorst-Pack k-point mesh was used for the Brillouin zone integration.

For the perfect Cu, the copper crystal structure was optimized with a lattice constant of α=3.636 Å. For Cu-SF, the unit cell was expanded with a factor of 1.1 and then fully relaxed until getting convergence. The lattice constant was determined to be 4.000 Å. Six-layer p(4×4) supercells of Cu (111) facet were used, with the lower three layers fixed. For all slab models, the vacuum thickness in a direction perpendicular to the plane of the catalyst was at least 15 Å to avoid the attractions from adjacent periodic mirror images. At all intermediate states, two water molecules are added near the slab surface to take the effect of solvation into account.

The Gibbs free energy (ΔG) of the reaction intermediates is defined as the following equation:

$$\Delta G=\Delta E+\Delta ZPE-T\Delta S$$

where ΔE is the total energy difference, ΔZPE is the difference of the zero-point energy, and TΔS is the difference of entropy. Note that E(H) is half of the $H_2$ (g) energy under 1.013 bar at 298.15K, $E(H_2O)$ is the energy of $H_2O$ (g) under 0.035 bar at 298.15 K and $E(OH)=E(H_2O)-E(H)$. The zero-point energy and entropy were corrected by calculating the vibrational frequencies through density functional perturbation theory at 298.15 K.

(L) Materials Characterizations

TEM images were collected on a JEOL JEM-2100F at 200 kV. Aberration-corrected HAADF-STEM images were collected on a TFS Spectra 300 at 300 kV. GPA analysis on atomic-resolution images was performed using Digital Micrograph software to derive the lattice strain. Only strain perpendicular to the stacking faults and twin boundaries was measured, using the lattice far from these defects as a reference (zero strain). SEM images were taken on the field emission Tescan MAIA3. The XRD patterns were recorded on a Rigaku SmartLab 9 kW-Advance diffractometer with Cu Kα radiation (λ=1.5418 Å). XPS spectra were collected on a Thermo Scientific Nexsa X-ray photoelectron spectroscopy using Al Kα radiation, and C is (284.6 eV) as a reference. The hard X-ray absorption spectroscopy measurements were conducted at the beamline BL01C of the Synchrotron Radiation Research Center (SRRC) in Hsinchu (Taiwan).

Although the invention has been described in terms of certain embodiments, other embodiments apparent to those of ordinary skill in the art are also within the scope of this invention. Accordingly, the scope of the invention is intended to be defined only by the claims which follow.

INDUSTRIAL APPLICABILITY

The present invention provides a stackable MEA electrolysis cell system that can be operable with pure $H_2O$ such that carbonate formation and crossover can be eliminated. It is easy to be fabricated and scaled up or down according to industrial application and $CO_2$ reduction demand. The present invention is not just cost-efficient but also a more environmental-friendly way to reduce $CO_2$. Higher yield of useful by-products from $ECO_2R$ reaction generated by the present invention is also resulted.

REFERENCE

The following literatures are cited herein:

1. T. T. Zhuang, Z. Q. Liang, A. Seifitokaldani, Y. Li, P. De Luna, T. Burdyny, F. L. Che, F. Meng, Y. M. Min, R. Quintero-Bermudez, C. T. Dinh, Y. J. Pang, M. Zhong, B.

Zhang, J. Li, P. N. Chen, X. L. Zheng, H. Y. Liang, W. N. Ge, B. J. Ye, D. Sinton, S. H. Yu, E. H. Sargent, Steering post-C—C coupling selectivity enables high efficiency electroreduction of carbon dioxide to multi-carbon alcohols. *Nat. Catal.* 1, 421-428 (2018). doi: 10.1038/s41929-018-0084-7;

2. S. C. Ma, M. Sadakiyo, R. Luo, M. Heima, M. Yamauchi, P. J. A. Kenis, One-step electrosynthesis of ethylene and ethanol from $CO_2$ in an alkaline electrolyzer. *J. Power Sources* 301, 219-228 (2016). doi:10.1016/j.jpowsour.2015.09.124;
3. T. T. H. Hoang, S. C. Ma, J. I. Gold, P. J. A. Kenis, A. A. Gewirth, Nanoporous copper films by additive-controlled electrodeposition: $CO_2$ reduction catalysis. *ACS Catal.* 7, 3313-3321 (2017). doi: 10.1021/acscatal.6b03613;
4. D. H. Nam, O. S. Bushuyev, J. Li, P. De Luna, A. Seifitokaldani, C. T. Dinh, F. P. Garcia de Arquer, Y. H. Wang, Z. Q. Liang, A. H. Proppe, C. S. Tan, P. Todorovic, O. Shekhah, C. M. Gabardo, J. W. Jo, J. M. Choi, M. J. Choi, S. W. Baek, J. Kim, D. Sinton, S. O. Kelley, M. Eddaoudi, E. H. Sargent, Metal-organic frameworks mediate Cu coordination for selective $CO_2$ electroreduction. *J. Am. Chem. Soc.* 140, 11378-11386 (2018). doi: 10.1021/jacs.8b06407;
5. J. J. Lv, M. Jouny, W. Luc, W. L. Zhu, J. J. Zhu, F. Jiao, A highly porous copper electrocatalyst for carbon dioxide reduction. *Adv. Mater.* 30, 1803111 (2018). doi: 10.1002/adma.201803111;
6. T. T. H. Hoang, S. Verma, S. C. Ma, T. T. Fister, J. Timoshenko, A. I. Frenkel, P. J. A. Kenis, A. A. Gewirth, Nanoporous copper-silver alloys by additive-controlled electrodeposition for the selective electroreduction of $CO_2$ to ethylene and ethanol. *J. Am. Chem. Soc.* 140, 5791-5797 (2018). doi: 10.1021/jacs.8b01868;
7. Y. G. C. Li, Z. Y. Wang, T. G. Yuan, D. H. Nam, M. C. Luo, J. Wicks, B. Chen, J. Li, F. W. Li, F. P. Garcia de Arquer, Y. Wang, C. T. Dinh, O. Voznyy, D. Sinton, E. H. Sargent, Binding site diversity promotes $CO_2$ electroreduction to ethanol. *J. Am. Chem. Soc.* 141, 8584-8591 (2019). doi: 10.1021/jacs.9b02945;
8. C. T. Dinh, T. Burdyny, M. G. Kibria, A. Seifitokaldani, C. M. Gabardo, F. P. Garcia de Arquer, A. Kiani, J. P. Edwards, P. De Luna, O. S. Bushuyev, C. Q. Zou, R. Q. Bermudez, Y. J. Pang, D. Sinton, E. H. Sargent, $CO_2$ electroreduction to ethylene via hydroxide-mediated copper catalysis at an abrupt interface. *Science* 360, 783-787 (2018). doi:10.1126/science.aas9100;
9. N. Martid, C. Reller, C. Macauley, M. Löffler, B. Schmid, D. Reinisch, E. Volkova, A. Maltenberger, A. Rucki, K. J. J. Mayrhofer, G. Schmid, Paramelaconite-enriched copper-based material as an efficient and robust catalyst for electrochemical carbon dioxide reduction. *Adv. Energy Mater.* 9, 1901228 (2019). doi: 10.1002/aenm.201901228;
10. D. Anastasiadou, M. Schellekens, M. de Heer, S. Verma, E. Negro, Electrodeposited $Cu_2O$ films on gas diffusion layers for selective $CO_2$ electroreduction to ethylene in an alkaline flow electrolyzer. *ChemElectroChem* 6, 3928-3932 (2019). doi: 10.1002/celc.201900971;
11. W. C. Ma, S. J. Xie, T. T. Liu, Q. Y. Fan, J. Y. Ye, F. F. Sun, Z. Jiang, Q. H. Zhang, J. Cheng, Y. Wang, Electrocatalytic reduction of $CO_2$ to ethylene and ethanol through hydrogen-assisted C—C coupling over fluorine-modified copper. *Nat. Catal.* 3, 478-487 (2020). doi: 10.1038/s41929-020-0450-0;
12. M. Zhong, K. Tran, Y. M. Min, C. H. Wang, Z. Y. Wang, C. T. Dinh, P. De Luna, Z. Q. Yu, A. S. Rasouli, P. Brodersen, S. Sun, O. Voznyy, C. S. Tan, M. Askerka, F. L. Che, M. Liu, A. Seifitokaldani, Y. J. Pang, S. C. Lo, A. Ip, Z. Ulissi, E. H. Sargent, Accelerated discovery of $CO_2$ electrocatalysts using active machine learning. *Nature* 581, 178-183 (2020). doi: 10.1038/s41586-020-2242-8;
13. M. G. Kibria, C. T. Dinh, A. Seifitokaldani, P. De Luna, T. Burdyny, R. Quintero-Bermudez, M. B. Ross, O. S. Bushuyev, F. P. Garcia de Arquer, P. D. Yang, D. Sinton, E. H. Sargent, A surface reconstruction route to high productivity and selectivity in $CO_2$ electroreduction toward $C_{2+}$ hydrocarbons. *Adv. Mater.* 30, 1804867 (2018). doi: 10.1002/adma.201804867;
14. F. W. Li, A. Thevenon, A. R. Hernindez, Z. Y. Wang, Y. L. Li, C. M. Gabardo, A. Ozden, C. T. Dinh, J. Li, Y. H. Wang, J. P. Edwards, Y. Xu, C. McCallum, L. Z. Tao, Z. Q. Liang, M. C. Luo, X. Wang, H. H. Li, C. P. O'Brien, C. S. Tan, D. H. Nam, R. Q. Bermudez, T. T. Zhuang, Y. G. C. Li, Z. J. Han, R. D. Britt, D. Sinton, T. Agapie, J. C. Peters, E. H. Sargent, Molecular tuning of $CO_2$-to-ethylene conversion. *Nature* 577, 509-513 (2020). doi: 10.1038/s41586-019-1782-2;
15. F. P. Garcia de Arquer, C. T. Dinh, A. Ozden, J. Wicks, C. McCallum, A. R. Kirmani, D. H. Nam, C. Gabardo, A. Seifitokaldani, X. Wang, Y. C. Li, F. Li, J. Edwards, L. J. Richter, S. J. Thorpe, D. Sinton, E. H. Sargent, $CO_2$ electrolysis to multicarbon products at activities greater than 1 A $cm^{-2}$. *Science* 367, 661-666 (2020). doi:10.1126/science.aay4217;
16. Y. H. Wang, Z. Y. Wang, C. T. Dinh, J. Li, A. Ozden, M. G. Kibria, A. Seifitokaldani, C. S. Tan, C. M. Gabardo, M. C. Luo, H. Zhou, F. W. Li, Y. W. Lum, C. McCallum, Y. Xu, M. X. Liu, A. Proppe, A. Johnston, P. Todorovic, T. T. Zhuang, D. Sinton, S. O. Kelley, E. H. Sargent, Catalyst synthesis under $CO_2$ electroreduction favours faceting and promotes renewable fuels electrosynthesis. *Nat. Catal.* 3, 98-106 (2020). doi: 10.1038/s41929-019-0397-1;
17. X. Y. Chen, J. F. Chen, N. M. Alghoraibi, D. A. Henckel, R. X. Zhang, U. O. Nwabara, K. E. Madsen, P. J. A. Kenis, S. C. Zimmerman, A. A. Gewirth, Electrochemical $CO_2$-to-ethylene conversion on polyamine-incorporated Cu electrodes. *Nat. Catal.* 4, 20-27 (2021). doi: 10.1038/s41929-020-00547-0;
18. X. J. She, T. Y. Zhang, Z. Y. Li, H. M. Li, H. Xu, J. J. Wu, Tandem electrodes for carbon dioxide reduction into $C_{2+}$ products at simultaneously high production efficiency and rate. *Cell Rep. Phys. Sci.* 1, 100051 (2020). doi: 10.1016/j.xcrp.2020.100051;
19. J. E. Huang, F. W. Li, A. Ozden, A. S. Rasouli, F. P. G. D. Arquer, S. J. Liu, S. Z. Zhang, M. C. Luo, X. Wang, Y. W. Lum, Y. Xu, K. Bertens, R. K. Miao, C. T. Dinh, D. Sinton, E. H. Sargent, $CO_2$ electrolysis to multicarbon products in strong acid. *Science* 372, 1074-1078 (2021). doi: 10.1126/science.abg6582

What is claimed is:

1. A pure-$H_2O$-fed membrane-electrode assembly electrolysis system for electrocatalytic $CO_2$ reduction to ethylene and $C_{2+}$ compounds under an industrial applicable continuous flow condition with at least 1000-hour lifetime, the system comprising one or more membrane-electrode assemblies each comprising:

an anode;

a cathode;

an anion exchange membrane;

a proton exchange membrane;

a step-facet-rich copper catalyst disposed at the cathode, wherein the step-facet-rich copper catalyst has a surface atom coordination number of 7 or lower at Cu (111) exposed facet; and an electrolyte, the cathode being arranged in contact with the anion exchange membrane;

the anode being arranged in contact with the proton exchange membrane;

the anion exchange membrane and proton exchange membrane being arranged in contact with each other;

the electrolyte being selected from pure $H_2O$ as proton source for the electrocatalytic $CO_2$ reduction at the cathode under a forward bias mode of the system;

the anion exchange membrane being selected from alkaline anion exchange membrane; and the proton exchange membrane being selected from acidic proton exchange membrane.

2. The system of claim 1, wherein the cathode is selected from a gas diffusion electrode deposited with at least a layer of the step-facet-rich copper catalyst.

3. The system of claim 1, wherein the anode is selected from titanium fiber felt supported by one or more of platinum, iridium, ruthenium, and palladium, and any oxide or alloy thereof.

4. The system of claim 1, wherein the electrocatalytic $CO_2$ reduction is conducted at a temperature of about 60° C. or lower but above room temperature.

5. The system of claim 1, wherein the alkaline anion exchange membrane is an anion exchange membrane made of N-methylimidazolium-functionalized styrene polymer.

6. The system of claim 5, wherein the anion exchange membrane has a thickness of about 0.002 inches.

7. The system of claim 1, wherein the acidic proton exchange membrane is a proton exchange membrane made of tetrafluoroethylene-perfluoro-3,6-dioxa-4-methyl-7-octenesulfonic acid copolymer.

8. The system of claim 7, wherein the proton exchange membrane has a thickness of about 0.007 inches and an equivalent weight of about 1100 g/mol.

9. The system of claim 1, wherein the step-facet-rich copper catalyst has a surface atom coordination number from 4 to 9 at (100) exposed facet and from 4 to 7 at the Cu (111) exposed facet.

10. The system of claim 1, wherein the step-facet-rich copper catalyst has a surface tensile strain being within 10% increase of an initial tensile strain thereof measured at room temperature.

11. The system of claim 1, wherein the electrolyte at the cathode is identical to an electrolyte at the anode.

12. The system of claim 1, wherein at least six of the membrane-electrode assemblies are stacked together.

13. The system of claim 12, wherein up to about 50% of Faradaic efficiency towards ethylene with a carbon dioxide-to-ethylene conversion efficiency of about 39% is achieved when a total current of 10 A is supplied across the at least six membrane-electrode assemblies through two conductive substrates sandwiching the stack of the at least six membrane-electrode assemblies with a total geometrical area of 30 $cm^2$.

14. A method for fabricating a pure-LO-fed membrane-electrode assembly electrolysis system for electrocatalytic $CO_2$ reduction to ethylene and $C_{2+}$ compounds with at least 1000-hour lifetime, comprising:

providing a step-facet-rich copper catalyst, wherein the step-facet-rich copper catalyst has a surface atom coordination number of 7 or lower at Cu (111) exposed facet;

preparing a step-facet-rich copper catalyst-containing ink composition for forming a cathode with the step-facet-rich copper catalyst thereon;

forming the cathode with the step-facet-rich copper catalyst thereon;

preparing an anode-forming mixture for forming an anode;

forming the anode from the anode-forming mixture supporting an anode material;

providing an alkaline anion exchange membrane and an acidic proton exchange membrane between said cathode and anode, the alkaline anion exchange membrane being arranged in contact with the cathode, the acidic proton exchange membrane being arranged in contact with the anode, and the alkaline exchange membrane and acidic proton exchange membrane being in contact with each other, thereby forming a multi-layered structure of the membrane-electrode assembly;

sandwiching one or more of the membrane-electrode assemblies with two conductive substrates;

feeding, pure $H_2O$ as an electrolyte into a container containing the one or more of the membrane-electrode assemblies being sandwiched between the two conductive substrates;

providing a power supply to the one or more of the membrane-electrode assemblies through the two conductive substrates;

maintaining the electrolyte at a temperature sufficient for the electrocatalytic $CO_2$ reduction to ethylene to last for at least 1000 hours with no dominant hydrogen evolution reaction.

15. The method of claim 14, wherein said providing the step-facet-rich copper catalyst comprises:

dissolving copper chloride and octadecylamine into squalene at about 80° C. under an argon atmosphere for about 0.5 hours until a copper-based stock solution is formed;

mixing oleylamine and trioctylphosphine under heating the mixture to about 200° C. at the argon atmosphere with vigorous agitation to form a mixture;

injecting the copper-based stock solution into the mixture at about 200° C. and maintained for about 5 hours to form a reaction mixture;

cooling the reaction mixture naturally, centrifuging the cooled reaction mixture, followed by washing with n-hexane for a few times;

removing supernatant after said washing and blow drying pellet with argon gas under room temperature to obtain the step-facet-rich copper catalyst in solid form.

16. The method of claim 15, wherein said forming the cathode with the step-facet-rich copper catalyst thereon comprises:

dispersing the solid step-facet-rich copper catalyst into a mixed solution containing water, isopropyl alcohol and an alkaline ionomer solution;

mixing the solid step-facet-rich copper catalyst with the mixed solution by sonication for about an hour until the step-facet-rich copper catalyst-containing ink composition is formed;

coating the step-facet-rich copper catalyst-containing ink composition onto a carbon paper with a microporous carbon gas diffusion layer;

drying the coated step-facet-rich copper catalyst-containing ink composition on the carbon paper in vacuum for about an hour.

17. The method of claim 14, wherein the anode is formed from a titanium fiber felt supported by the anode forming mixture comprising one or more of platinum, iridium, ruthenium, and palladium, and any oxide or alloy thereof.

18. The method of claim 14, wherein the alkaline anion exchange membrane is selected from an anion exchange membrane made of N-methylimidazolium-functionalized styrene polymer with a thickness of about 0.002 inches.

19. The method of claim 14, wherein the acidic proton exchange membrane is selected from a proton exchange membrane made of tetrafluoroethylene-perfluoro-3,6-dioxa-4-methyl-7-octenesulfonic acid copolymer with a thickness of about 0.007 inches and equivalent weight of 1100 g/mol.

20. The method of claim 14, wherein at least six of the membrane-electrode assemblies are stacked with each other and sandwiched between the two conductive substrates; the electrolyte temperature is maintained at about 60° C.

* * * * *